US011819769B2

(12) United States Patent
Textores, III

(10) Patent No.: US 11,819,769 B2
(45) Date of Patent: Nov. 21, 2023

(54) MARBLE RACING GAME

(71) Applicant: William O. Textores, III, Succasunna, NJ (US)

(72) Inventor: William O. Textores, III, Succasunna, NJ (US)

( * ) Notice: Subject to any disclaimer, the term of this patent is extended or adjusted under 35 U.S.C. 154(b) by 18 days.

(21) Appl. No.: 17/733,950

(22) Filed: Apr. 29, 2022

(65) Prior Publication Data

US 2023/0046921 A1 Feb. 16, 2023

Related U.S. Application Data

(60) Provisional application No. 63/286,006, filed on Dec. 4, 2021, provisional application No. 63/181,699, filed on Apr. 29, 2021.

(51) Int. Cl.
*A63F 9/14* (2006.01)

(52) U.S. Cl.
CPC ..... *A63F 9/14* (2013.01)

(58) Field of Classification Search
CPC ..... A63F 3/00082; A63F 3/00176; A63F 3/00214; A63F 3/00261; A63F 2003/00324; A63F 2003/00353; A63F 7/00; A63F 7/0023; A63F 7/04; A63F 2007/4006; A63F 9/14; A63F 7/3622; A63F 2250/505; A63F 2009/0035; A63F 2007/3662
See application file for complete search history.

(56) References Cited

U.S. PATENT DOCUMENTS 4,874,342 A * 10/1989 Klitsner ..... A63F 7/3622 446/168
5,007,876 A * 4/1991 Klitsner ..... A63F 7/3622 446/168
11,364,429 B2 * 6/2022 Lenfers ..... A61N 5/0603
2009/0084863 A1 * 4/2009 Sorenson ..... A63F 7/3622 238/122
2012/0161397 A1 * 6/2012 Moran ..... A63F 9/02 273/359
2013/0252506 A1 * 9/2013 Ridinger ..... A63F 7/3622 446/168
2019/0038963 A1 * 2/2019 Forgrave ..... A63H 33/08
2021/0245038 A1 * 8/2021 Forgrave ..... A63F 7/28
2022/0047936 A1 * 2/2022 Schuberg ..... A63F 7/30
2022/0152518 A1 * 5/2022 Shweka ..... A63H 18/02

* cited by examiner

*Primary Examiner* — Omkar A Deodhar
(74) *Attorney, Agent, or Firm* — LORUSSO & ASSOCIATES

(57) ABSTRACT

A racing game comprising track modules formed from flat sheet material manipulated into three-dimensional track segments or modules, rigidified connectors to connect the track modules and specialized track accessories to form a modular racing track to race spherical objects. Racing track assemblies include elevated, helically-coiled assemblies that mimic Christmas tree shapes.

20 Claims, 72 Drawing Sheets

26-2

40
240
248
242
246
244

240
50
245
42
50
48
44
42
43
46
41
46
246

50
240
242
220
48
246
240

10
14
15
24
262
260
253
10
14
15
22
24

256
14
15
10
254
252
253
254
10
250
14
256
15

MARBLE RACING GAME

CROSS-REFERENCE TO RELATED APPLICATIONS

This regular utility application claims the benefit of U.S. Provisional Patent Application Ser. No. 63/181,699, filed Apr. 29, 2021 and U.S. Provisional Patent Application Ser. No. 63/286,006, filed Dec. 4, 2021, the contents all of which are incorporated herein by reference.

FIELD OF THE DISCLOSURE

The disclosure relates to games and more particularly to modular games involving spherical rolling objects. A ball racing toy and construction toy utilizing flat sheets of plastic, cardboard, or composites in designs that can support a dual marble racing experience. The disclosure further relates to building toys, and more specifically, kits for designing, building and using marble run tracks and structures.

BACKGROUND OF THE DISCLOSURE

Marble rolling toys are generally small, tabletop assemblies whereby a single marble run is completed in about 30 seconds or less. This illustrates a notable problem with these types of assemblies—short run times. Longer assemblies are needed. Longer marble runs, however, are costly and require extensive material and time to build a support structure to achieve the higher elevations needed to effectuate such gravity-driven assemblies.

Relatively tall marble runs are generally skeleton structures with few solid surfaces. The application of solid surfaces would provide an aesthetically pleasing improvement. An additional problem is the difficulty and cost to build marble runs with more than one track, especially two separate tracks to create a competition. A double marble run with continuous parallel "lanes" is an excellent racing adventure unavailable for large toys. Because of the twists and turns incorporated into marble run tracks, it is difficult to structure the tracks to be equal in length and function. If two tracks are positioned side by side, one track will inevitably be favored if it is the outside track at turns due to the favorable transfer of speed of a larger diameter turn.

A further problem has to do with the surfaces used to construct and assemble a gravity-driven marble track run. A table top is an obvious choice, but one with immediate limitations because of the dimensional limitations of a table and the fact that a table is a flat surface. Any marble track constructed on a table will require support structures to elevate and grade the track to enable gravity to propel marbles along the track. For surfaces such as staircases that have multi-level, vertically-arranged sections well suited for facilitating gravity-driven movement of marbles or other spherical bodies, marble tracks or runs are not easily integrated into such large structures with vertically-cascading support surfaces, i.e., stair treads and risers.

A yet further problem is the weight associated with large structures. For every incremental increase in the height of a track, additional vertical support structures of incrementally-increasing length will be needed. Lateral supports also will be needed to stabilize the vertical support structures to guard against lateral displacement of the vertical supports and the attached track segments. The more structural supports needed, the larger the shipping containers needed.

The weight of the tracks themselves is potentially another problem. The longer and the higher a track is constructed, the heavier the track will be. The weight of the individual components can become an issue as a track length increases. What is needed is lightweight materials to construct longer, multi-tiered tracks to improve the entertainment factor of the marble-running track without compromising the structural integrity of the track.

Yet another problem is the use of walls to support elevated portions of a marble run track. Anything used to adhere or affix track components to a wall, e.g., adhesives and nails/screws), can ultimately damage the wall. What is needed is a means to construct a multi-tiered marble run track with wall support that does not damage wall surfaces. These and other objects of the disclosure will become apparent from a reading of the following summary and detailed description of the disclosure.

SUMMARY OF THE DISCLOSURE

In one aspect of the disclosure, to achieve the solutions provided by the disclosure, flat sheets of material are manipulated into interlocking 3-D structures to form the components of a marble run track. By use of symmetrical, light-weight sheets, the sheets essentially can be rolled to form symmetrical dual-track sections. The light-weight characteristic of the material permits the assembly of large circuitous, multi-level tracks that can be supported with simple light-weight support structures.

In another aspect of the disclosure, sheets can be modified to create specialty tracks such as twists, spirals and loops to add heightened entertainment features to the dual-track structure. Single or multiple sheet sections can be used to create the specialty track sections.

In another aspect of the disclosure, track section connectors provide a means to releasably lock adjacent sections of track together to form an open (start to finish) or closed circuit, i.e., one that permits continual play by elevating the marbles from a finish line to a start line. For an open circuit, a marble transport section permits marbles to be delivered onto the tracks for racing. The track section connectors are constructed in a variety of configurations to permit the application of illustratively turns, twists, inversions and elevational changes to add further entertainment value to the dual-track racing game.

In a further aspect of the disclosure, elevational support structures and/or suspension elevation support structures permit track sections to be elevated from a base surface, or from an elevated surface, respectively, to create elevational grading of segments of assembled tracks to harness gravitationally-driven inertia of the spherical objects placed on the tracks. This permits locomotion of the objects without the need of any accessory energy-producing elements such as transformers. The track assemblies can be assembled in multiple configurations including configurations mimicking Christmas trees. These and other aspects of the disclosure will become apparent from a review of the appended drawings and a reading of the following detailed description of the disclosure.

BRIEF DESCRIPTION OF THE DRAWINGS

FIG. 121 is a top, end perspective view of a curve connector with a rotating ornament according to a yet another embodiment of the disclosure.

FIG. 122 is a top, end perspective view of a musical drop segment or musical ramp with a rotating ornament according to still another embodiment of the disclosure.

FIG. 123 is a top perspective view of a color/design/advertising track segment insert according to a further embodiment of the disclosure.

FIG. 124 is a color/design/advertising track segment insert assembled to a dual-track segment according to the embodiment of the disclosure shown in FIG. 123.

FIG. 125 is a top/end perspective view of a horticulture growing segment according to a yet further embodiment of the disclosure.

FIG. 126 is a top view of a lighting strip according to a still further embodiment of the disclosure.

FIG. 127 is a side/top perspective view of a light strip assembled to a dual-track segment according to the embodiment of the disclosure shown in FIG. 126.

FIG. 128 is a perspective view of a central elevator loading platform according to another embodiment of the disclosure.

FIG. 128 is a perspective view of a central coil elevator according to the embodiment of the disclosure shown in FIG. 127.

FIG. 129 is a top, side perspective view of a central coil elevator according to the embodiment of the disclosure shown in FIG. 127.

DETAILED DESCRIPTION OF THE DISCLOSURE

I. Track Segment Modules

Figure 1:
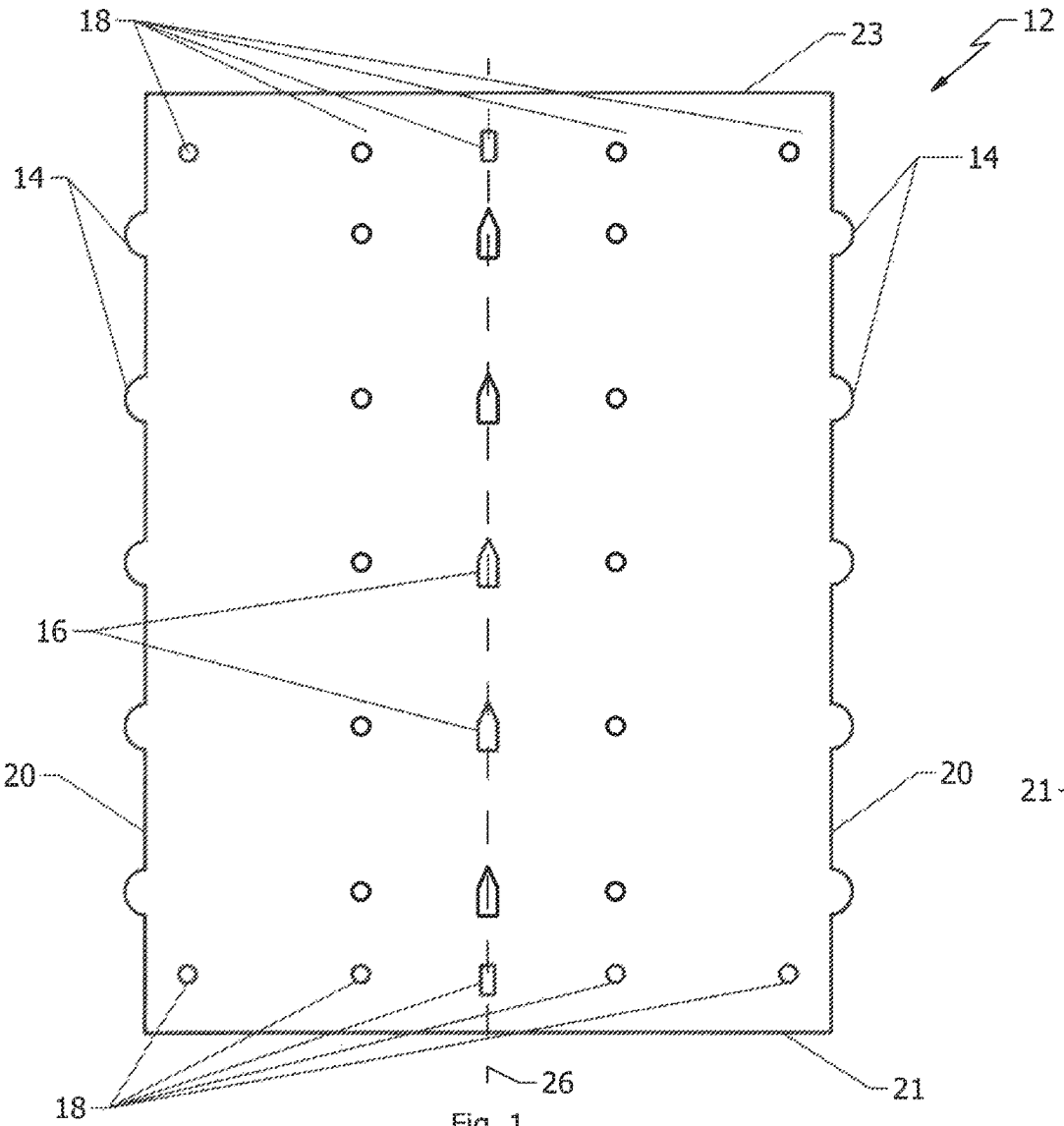
FIG. 1 is a top perspective view of a track segment assembly sheet according to one embodiment of the disclosure.

Referring now to FIGS. 1-4, in one aspect of the disclosure, a straight dual-track segment or module, designated generally as 10, is formed from a single sheet of material, designated generally as 12, as shown in FIG. 1. Sheet 12 has substantially parallel sides 20 and parallel ends, leading end 21 and trailing end 23 that collectively define a field. A plurality of tabs 14 extend laterally from sheet 12 and occupy substantially the same plane as sheet 12. A plurality of corresponding slots 16 are formed in the field at an approximate centerline 26 of sheet 12 and laterally aligned with tabs 14. Slots 16 are dimensioned to receive tabs 14 in a mechanical interlocking arrangement as disclosed in more detail herein.

Due to the manner in which the dual-track segment is assembled, the number of slots 16 is equal to the largest number of tabs 14 on either side of sheet 12. This ensures there is a slot for every tab. For dual-track segments such as dual-track segment 10, each slot 16 is dimensioned to receive two tabs 14, one from each side 20 of sheet 12. By aligning opposing tabs 14 and slots 16 along the same lateral axes, a uniform, symmetrical dual-track segment can be assembled from sheet 12.

Figure 2:
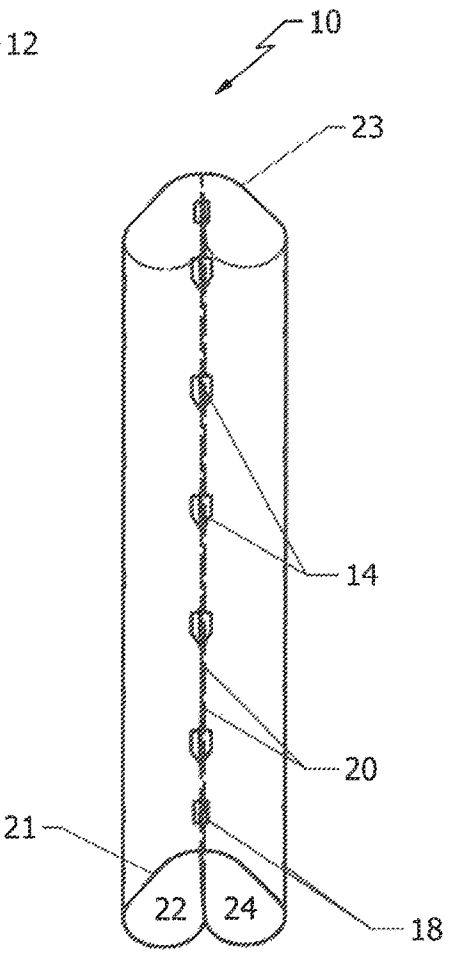
FIG. 2 is a top end perspective view in partial phantom of a straight dual-track segment assembled from the assembly sheet shown in FIG. 1.
Figure 3:
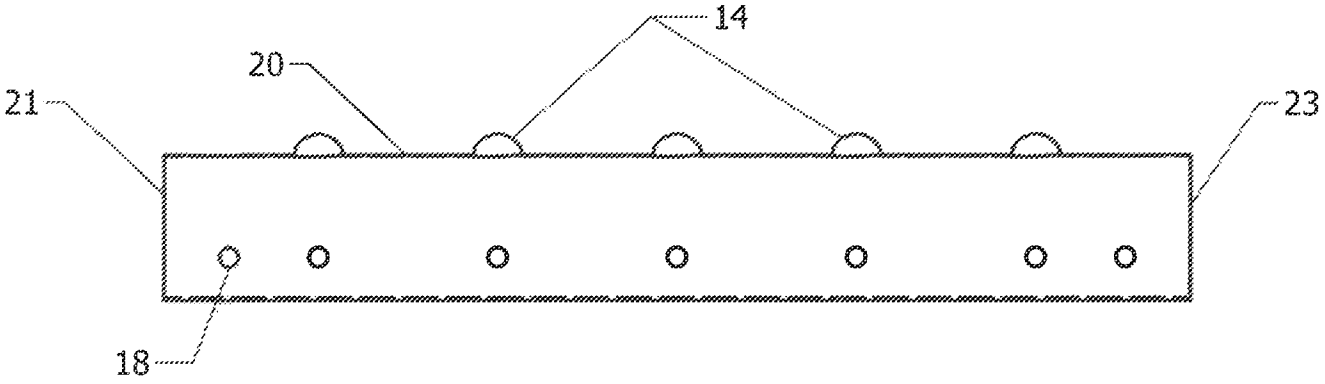
FIG. 3 is a side view in elevation and in partial phantom of the straight dual-track segment shown in FIG. 2.
Figure 4:
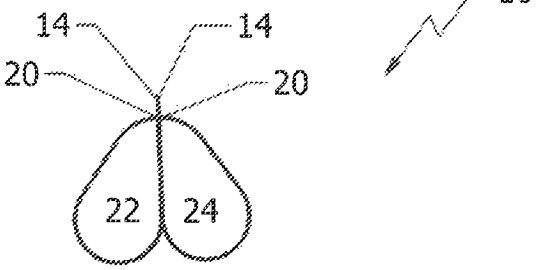
FIG. 4 is an end view of the straight dual-track segment shown in FIG. 2.

As shown in FIGS. 2-4, to assemble straight dual-track segment 10, sides 20 are rolled with the side edges drawn toward centerline 26 of sheet 12. Tabs 14 are inserted into slots 16 the result of which is the formation of two uniform, track tunnels, a left track tunnel 22 and a right track tunnel 24. The sheet sides register against one another and form a central wall shared in common by the tunnels. Because slots 16 are formed along a centerline of sheet 12, tunnels 22 and 24 are uniform, substantially parallel and symmetrical. Due to flexion characteristics of the material used, and the stresses placed on the material by the construction method, the tunnels take on a teardrop shape in cross-section. It should be understood that any cross-sectional shape realized by the construction method used remains within the scope of the disclosure. If asymmetrical track tunnels are desired, slots 16 can be offset from centerline 26. The side toward which the slots are biased will result in a tunnel on that side having a smaller diameter than the other tunnel. It should be understood that any dimensional relationship between the parallel tunnels, e.g., identical dimensions and different dimensions, remains within the scope of the disclosure.

Figure 12:
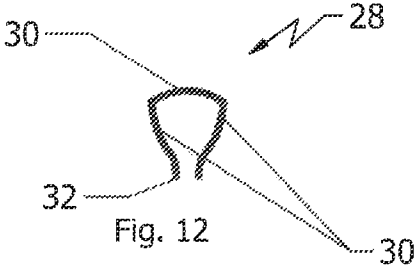
FIG. 12 is an end view of the retaining clip shown in FIG. 11.
Figure 11:
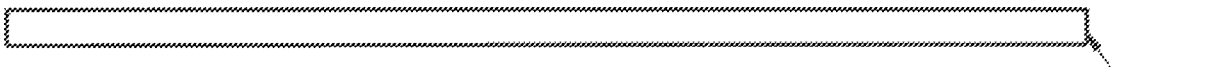
FIG. 11 is a side view of an elongated retaining clip used in the embodiment shown in FIG. 10.
Figure 10:
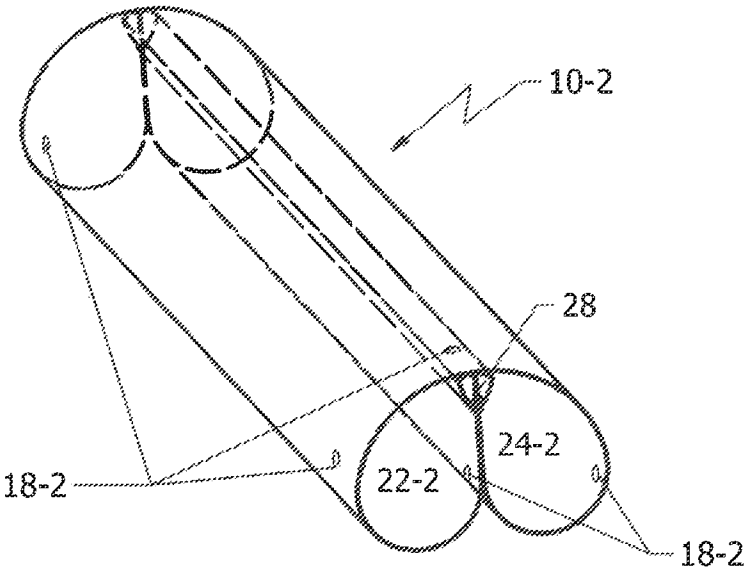
FIG. 10 is a top end perspective view in partial phantom of a straight dual-track segment assembled with the assembly sheet shown in FIG. 9.
Figure 9:
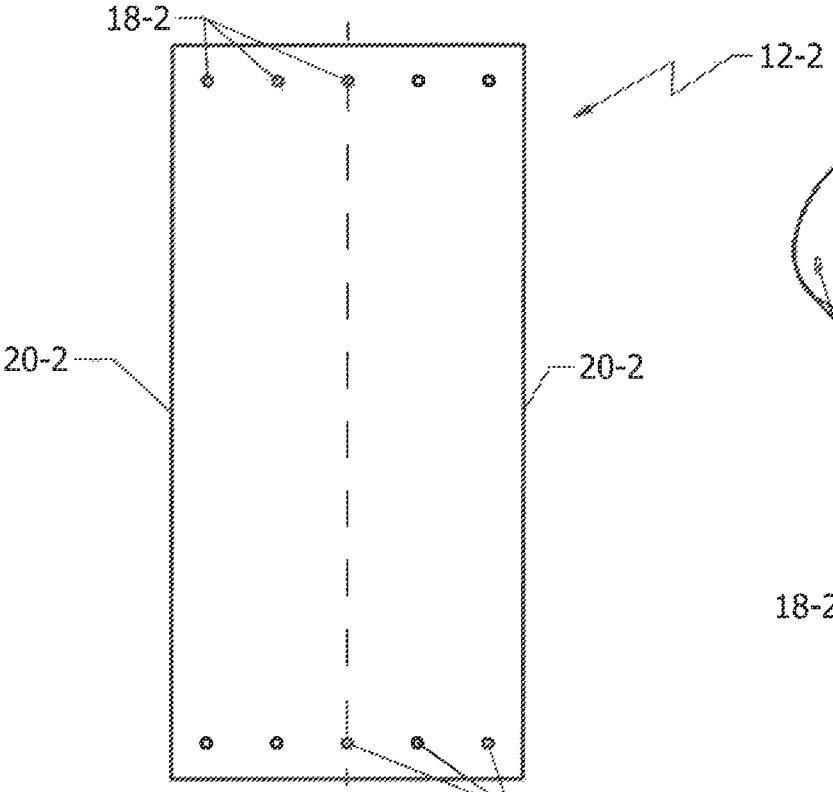
FIG. 9 is a top perspective view of a track segment assembly sheet according to still another embodiment of the disclosure
Figures 94, 95:
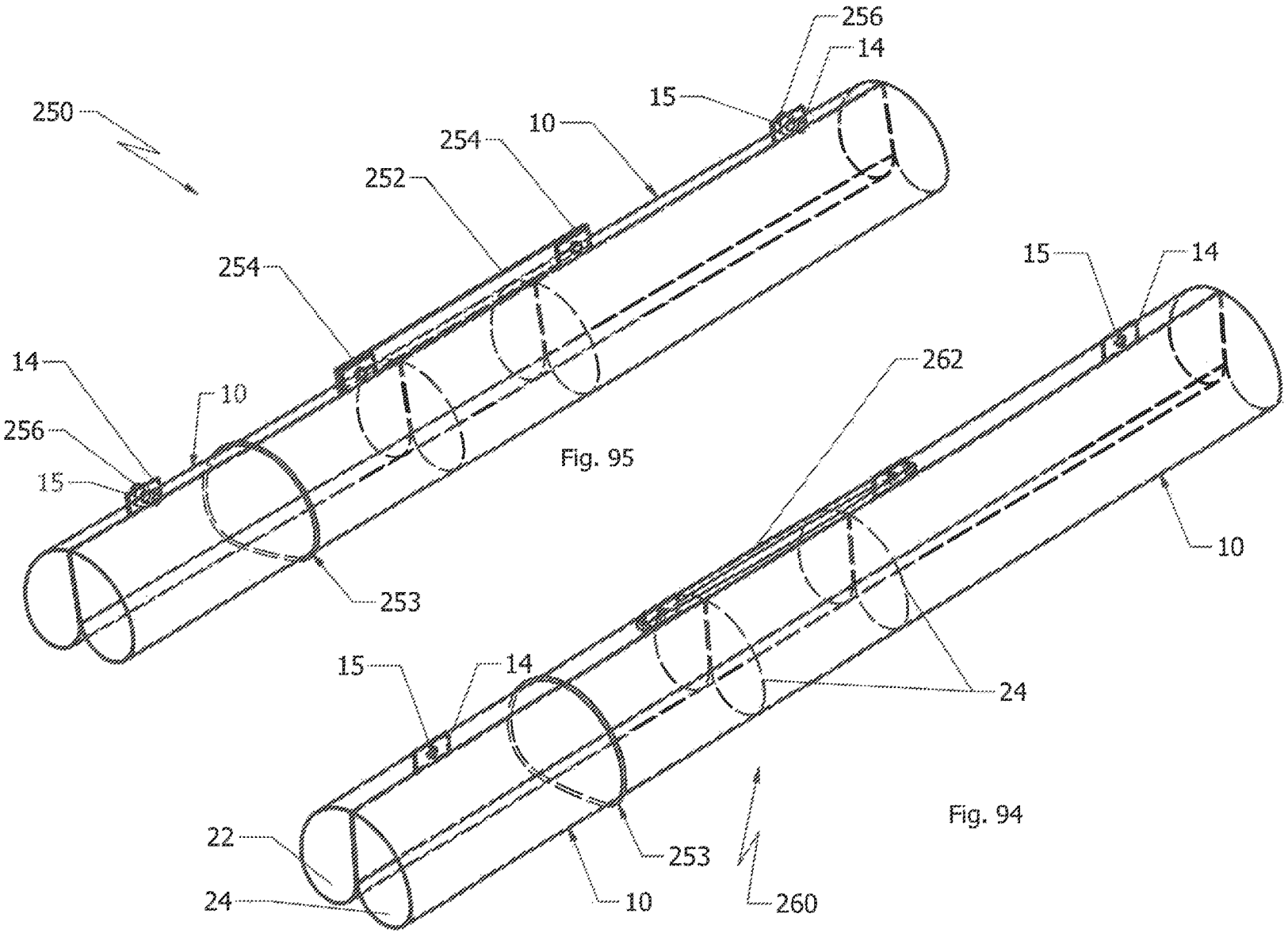
FIG. 94 is a top side perspective view of two straight dual-track segments secured with an elastomeric component-retaining member according to yet another embodiment of the disclosure.
FIG. 95 is a top side perspective view of two straight dual-track segments secured with a locking bar according to still another embodiment of the disclosure.
Figure 96:
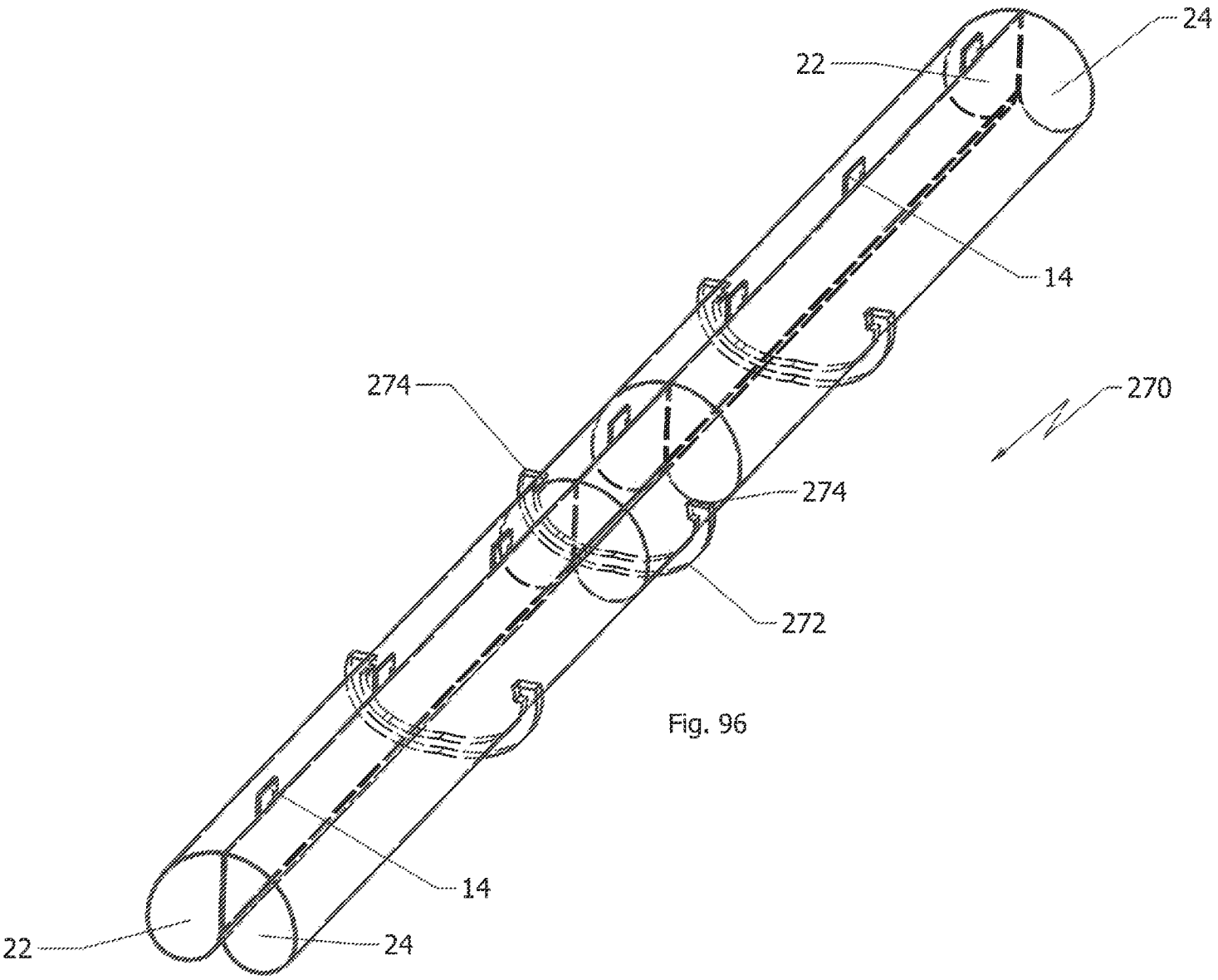
FIG. 96 is a top side perspective view of two straight dual-track segments secured with a track-assembly clamp according to a further embodiment of the disclosure.

To maintain tabs 14 in slots 16, a number of structural embodiments are available as more particularly described herein and shown in FIGS. 94-96. In one embodiment, tabs 14 can be adhered to the portions of sheet 12 that define slots 16 with adhesives, epoxies and the like. This creates a permanent connection between the tabs and slots. In a second embodiment, a clip, e.g., a paper clip or a deformable polymeric securing clip or retaining clip 28 with a spine 29 and deformable opposing tines 30 (as shown in FIGS. 11 and 12), engages sides 20 in a friction-fit subassembly. The body of securing clip 28 is dimensioned to be larger than slot 16 so that the combination of sides 20 and securing clip 28 cannot slip out of the slot. Securing clip 28 essentially creates a mechanical restriction due to registration against the portions of sheet 12 inserted into securing clip 28.

Figure 65:
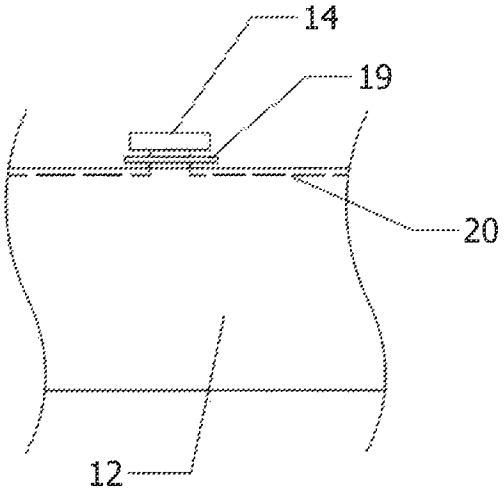
FIG. 65 is side view in elevation and partial phantom of a modified T-tab with a retaining clip according to another embodiment of the disclosure.
Figure 66:
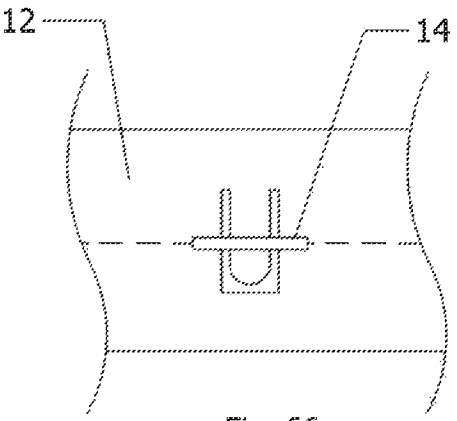
FIG. 66 is a top view of the T-tab/retaining clip combination shown in FIG. 65.
Figure 64:
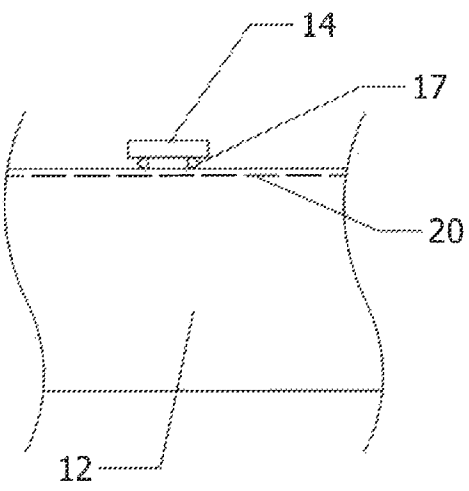
FIG. 64 is side view in elevation and partial phantom of a modified T-tab with an elastomeric component-retaining member according to one embodiment of the disclosure.

In a further embodiment, tab 14 is formed with an enlarged distal end 15 that gives tab 14 a "T" shape with the top cross element of the "T" being dimensionally larger than slot 16. With this embodiment, the T-shaped tab is urged into slot 16 with the top cross element inserted at an angle with one end inserted first. Due to the flexible nature of the sheet material, the cross element can be distorted to fit through slot 16 and then reform into its original shape due to material memory. The "T" tab and slot configuration essentially creates an interference fit to releasably lock the tab to the slot. To further secure the tab/slot combination, an elastomeric member such as a rubber band 17 or clip 19 can be used to engage the vertical element of the "T" to lock in the connection as shown in FIGS. 64-66. It should be understood that these described tab and slot assembly embodiments apply to any of the dual-track segments disclosed herein.

Referring specifically to FIGS. 1-3, sheet 12 is formed with a plurality of segment-connection through-bores 18 arranged proximal leading end 21 and trailing end 23. In one embodiment, through-bores 18 are evenly spaced along ends 21 and 23. The through-bores, as shown, are substantially rectangular or round in shape. It should be understood that the through-bores can be structured as any regular or irregular shape. The ultimate shape selected is driven by a need for the through-bore shape and size to correspond to the shape and size of connecting elements of track connectors disclosed in more detail herein.

Figure 6:
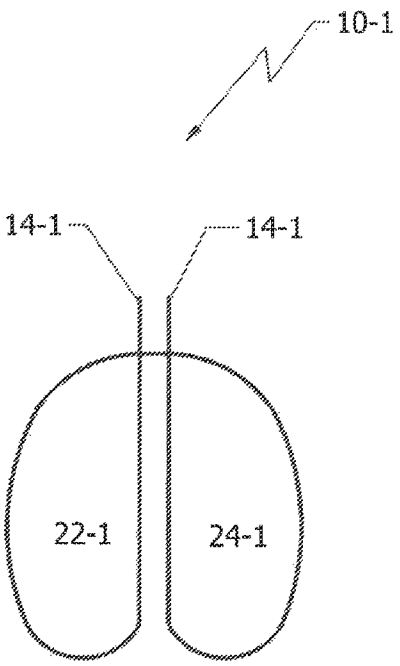
FIG. 6 is a top end perspective view in partial phantom of a straight dual-track segment assembled from the assembly sheet shown in FIG. 5.
Figure 5:
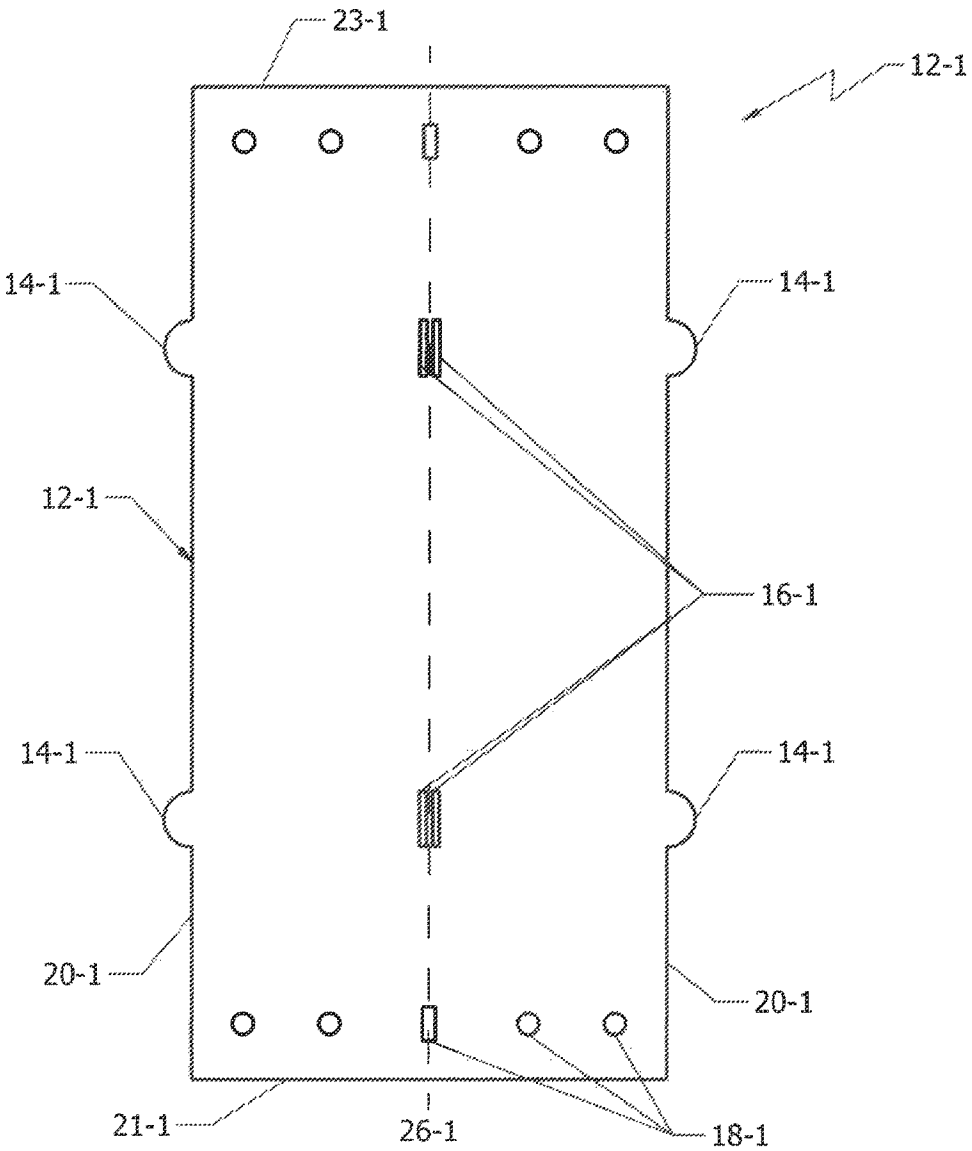
FIG. 5 is a top perspective view of a track segment assembly sheet according to another embodiment of the disclosure.

Referring now to FIGS. 5 and 6, in another embodiment of the disclosure, a straight dual-track segment, designated generally as 10', includes most of the features of straight dual-track segment 10 with a different tab/slot connection. As used herein, identical reference characters having differently primed or unprimed variations and assigned to features of the disclosure are intended to identify different embodiments of the same feature. It also should be understood that any reference character designations in the drawings using an "X-X" configuration is intended to represent a prime number with the "X" before the hyphen being the reference character and the second "X" or multiple "X's" after the hyphen representing the prime number equivalent. Unlike segment 10, the tab and slot arrangement of segment 10' includes dedicated slots 16' that each correspond to a single tab 14'. Like segment 10, dual-track segment 10' is formed from a single sheet of material, designated generally as 12', as shown in FIG. 5.

Sheet 12' has substantially parallel sides 20' and parallel ends, leading end 21' and trailing end 23'. A plurality of tabs 14' extend laterally from sheet 12' and occupy substantially the same plane as sheet 12'. A plurality of corresponding slots 16' are formed on either side of a centerline 26' of sheet 12'. Each slot 16' is laterally aligned with its corresponding tab 14'. Slots 16' are dimensioned to receive tabs 14' in a mechanical interlocking arrangement, the same as disclosed for the tab and slot combinations of dual-track segment 10. The means for assembling dual-track segment 10' are the same as used for dual-track segment 10 with the exception that opposing tabs 14' do not share slots 16'. Because of the spacing of the slots about centerline 26', the inner walls of tunnels 22' and 24' are spaced apart as shown in FIG. 6. This tab/slot configuration also permits a further modification from the structure of dual-track segment 10. The alignment of the tabs and slots across sheet 12' do not require lateral alignment. The only lateral alignment necessary is between mating tabs and slots. For this reason, the arrangement of tabs and slots for both sides of sheet 12' can be staggered if such an arrangement is required to, for example, provide additional support to receive an elevation support as disclosed in more detail herein.

Figure 8:
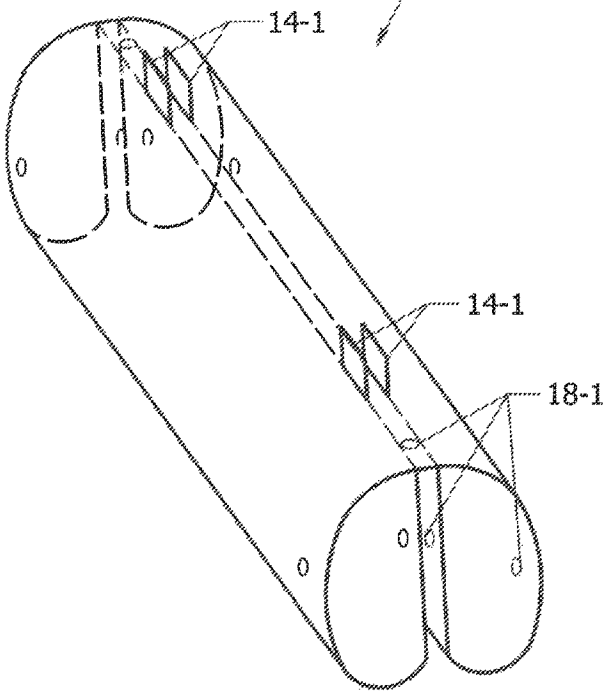
FIG. 8 is a top end perspective view in partial phantom of a straight dual-track segment assembled from the assembly sheet shown in FIG. 7.
Figure 7:
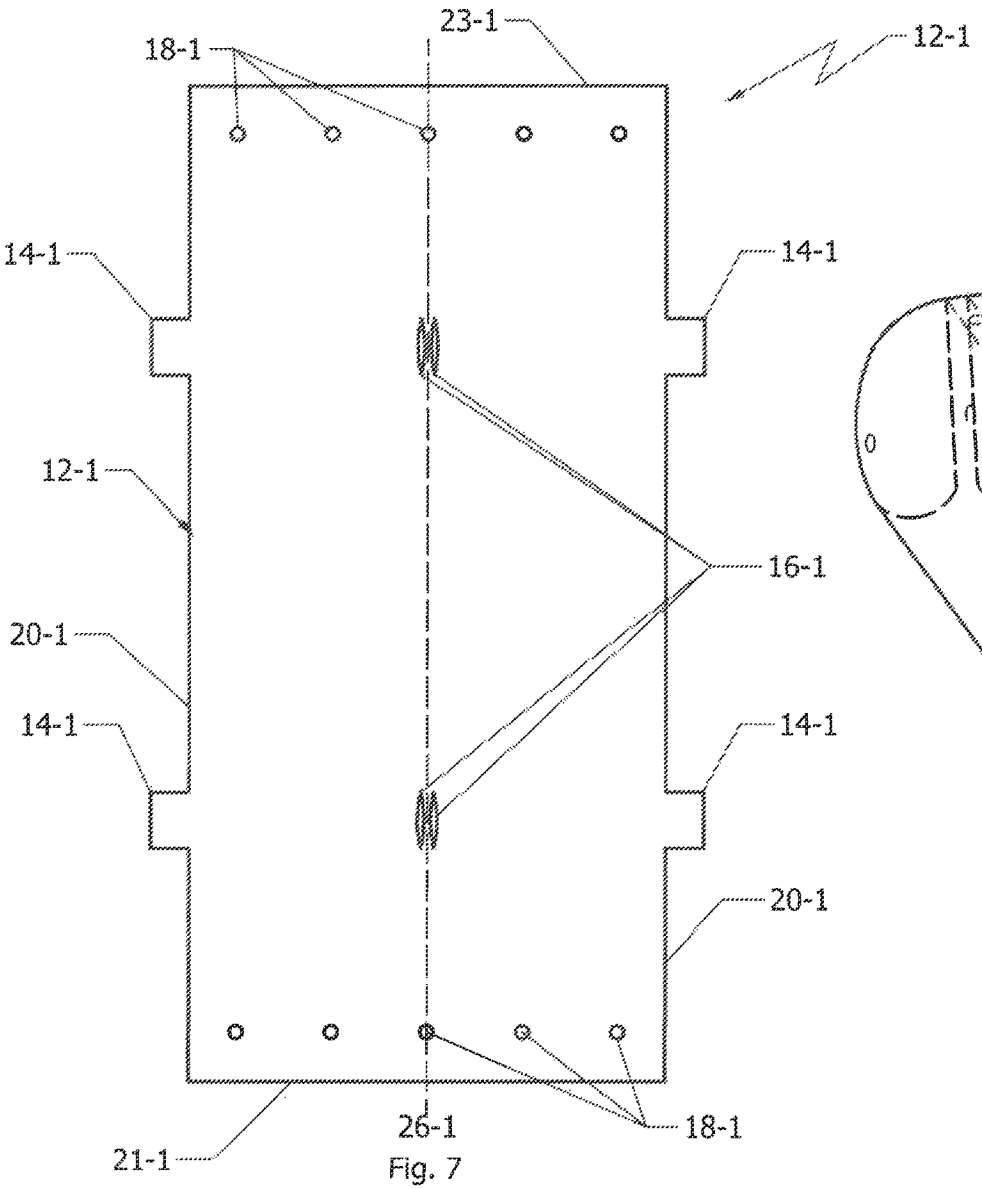
FIG. 7 is a top perspective view of a track segment assembly sheet according to yet another embodiment of the disclosure with modified through-bores.

Referring now to FIGS. 7 and 8, the straight dual-track segment 10' shown in FIGS. 5 and 6 is shown with modified segment-connection through-bores 18' having circular rather than rectangular or square shapes. The circular shape and pattern of through-bore placement on sheet 12' corresponds with the spatial orientation of the connecting elements of segment connectors disclosed in further detail herein. The remainder of the features shown in FIGS. 7 and 8 are identical to the features shown in FIGS. 5 and 6.

Figure 13:
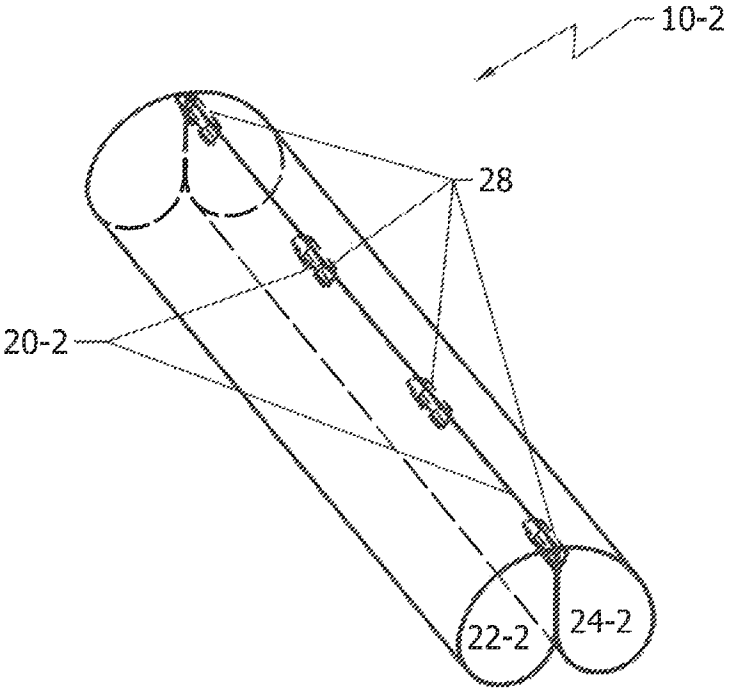
FIG. 13 is a top, end perspective view of a dual-track module assembled with a plurality of short retaining clips according to a further embodiment of the disclosure.

Referring now to FIGS. 9-12, in another embodiment of the straight dual-track segment, designated generally as 10", a plain sheet without any tabs or slots is used to form the dual-track segment. The segment does have segment-connection through-bores to permit connection to other segments with segment connectors disclosed in more detail herein. In this embodiment, a sheet 12" has its two sides 20" rolled toward a centerline 26". A longitudinal retaining clip or binding bar 28 having a "C" shape in cross section as shown in FIG. 12 is used to receive and retain sheet sides 20". Retaining clip 28 is formed from a plastic or metal material that permits the sides or tines 30 to flex outwardly from a preformed position in which the sides are in close proximity or in registration. By urging sides 20" between sides 30, sides 30 are urged to flex outwardly to receive the sides. Once the sides have passed a distal edge 32 of sides 30, through material memory, the sides flex back to their predetermined positions. This creates frictional engagement with sides 20" to retain them within retaining clip 28. It should be understood that retaining clip 28 may extend the entire length of sheet 12" or may extend only partially along the sheet's length. Moreover, a plurality of retaining clips 28 may be used, each of which is shorter than the sheet length to create a chain of retention points as shown in FIG. 13.

Figure 15:
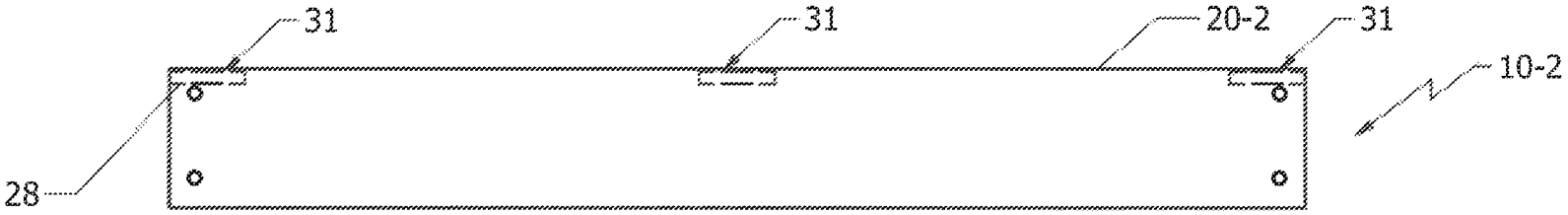
FIG. 15 is a side view in elevation and partial phantom of the dual-track module shown in FIG. 14.
Figure 14:
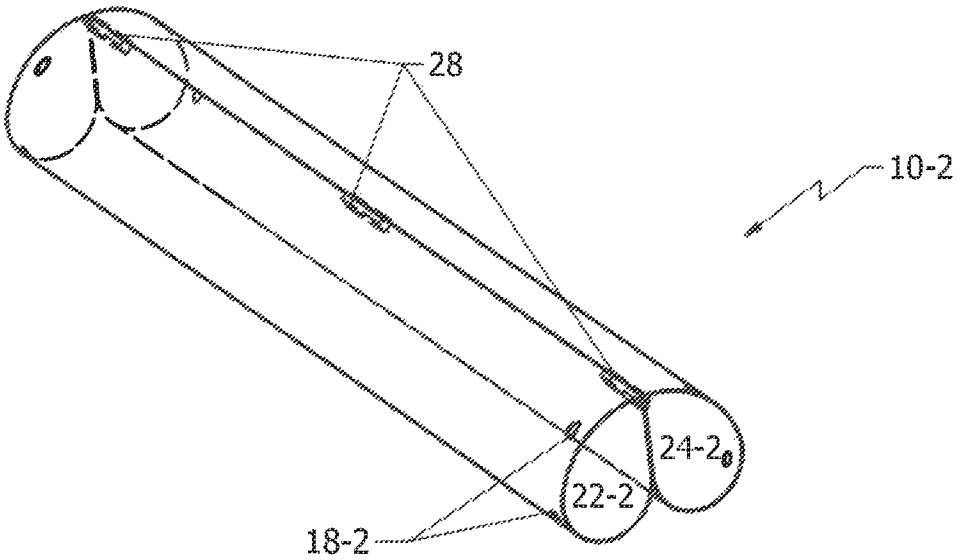
FIG. 14 is a top, end perspective view of a dual-track module secured with a combination of mechanical fasteners and retaining clip assemblies according to a yet further embodiment of the disclosure.

In a related embodiment, a plurality of short retaining clips 28 can be secured to a bottom surface of sheet 12" with mechanical fasteners 33 or adhesives as shown in FIGS. 14 and 15. Sides 20" are rolled under and into retaining clips 28 to form straight dual-track segment 10". Referring again to FIGS. 9 and 10, in an alternative embodiment, a dual track segment 10" is formed without retaining clip 28. This configuration is maintained by clips, elastomers, or other methods as described in other sections herein.

Figure 17:
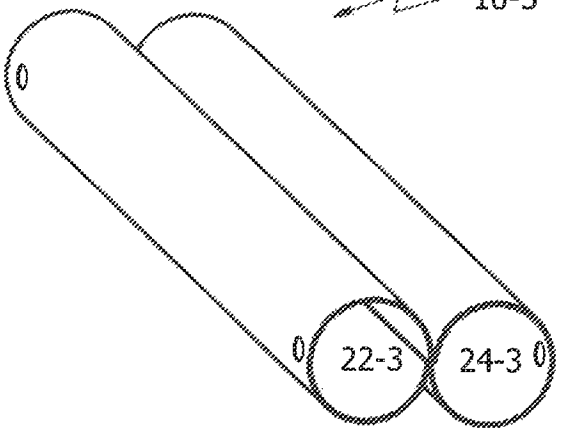
FIG. 17 is a top end perspective view of an assembled dual-track module using the assembly sheets shown in FIG. 16.
Figure 16:
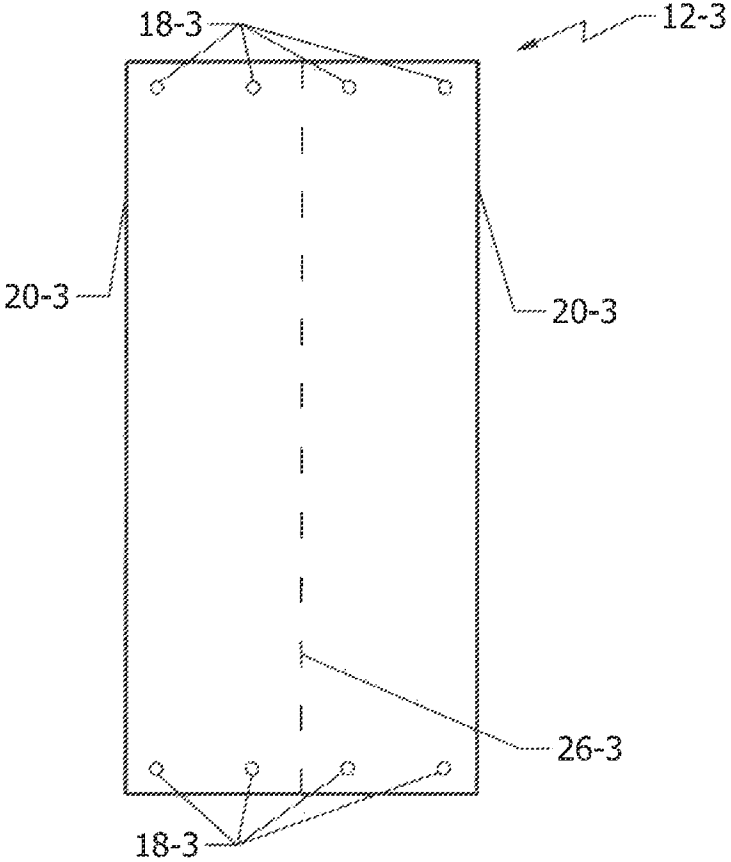
FIG. 16 is a top end perspective view of assembly sheets for a dual-track module according to a still further embodiment of the disclosure.

Referring now to FIGS. 16-17, in yet another embodiment of the straight dual-track segment, a straight dual-track segment, designated generally as 10''', is formed from a single sheet 12''' having sides 20'''. No tabs or slots are formed on sheet 12''' for this embodiment. To create the dual-track segment, sides 20''' are rolled toward and past a centerline 26''' of sheet 12''' and back on themselves to creates to two substantially parallel tunnels, a left track tunnel 22''' and a right track tunnel 24'''. Sides 20''' are adhered to sheet 12''' to form uniform, substantially circular (in cross-section) and substantially parallel tunnels: a left track tunnel 22''' and a right track tunnel 24'''. Adhesion may be achieved with liquid adhesives, double-stick tape and the like. Mechanical fasteners also may be used as well as two retaining clips secured to each end of sheet 12''' rolled and registered against the sheet equidistantly from centerline 26'''.

Figure 18:
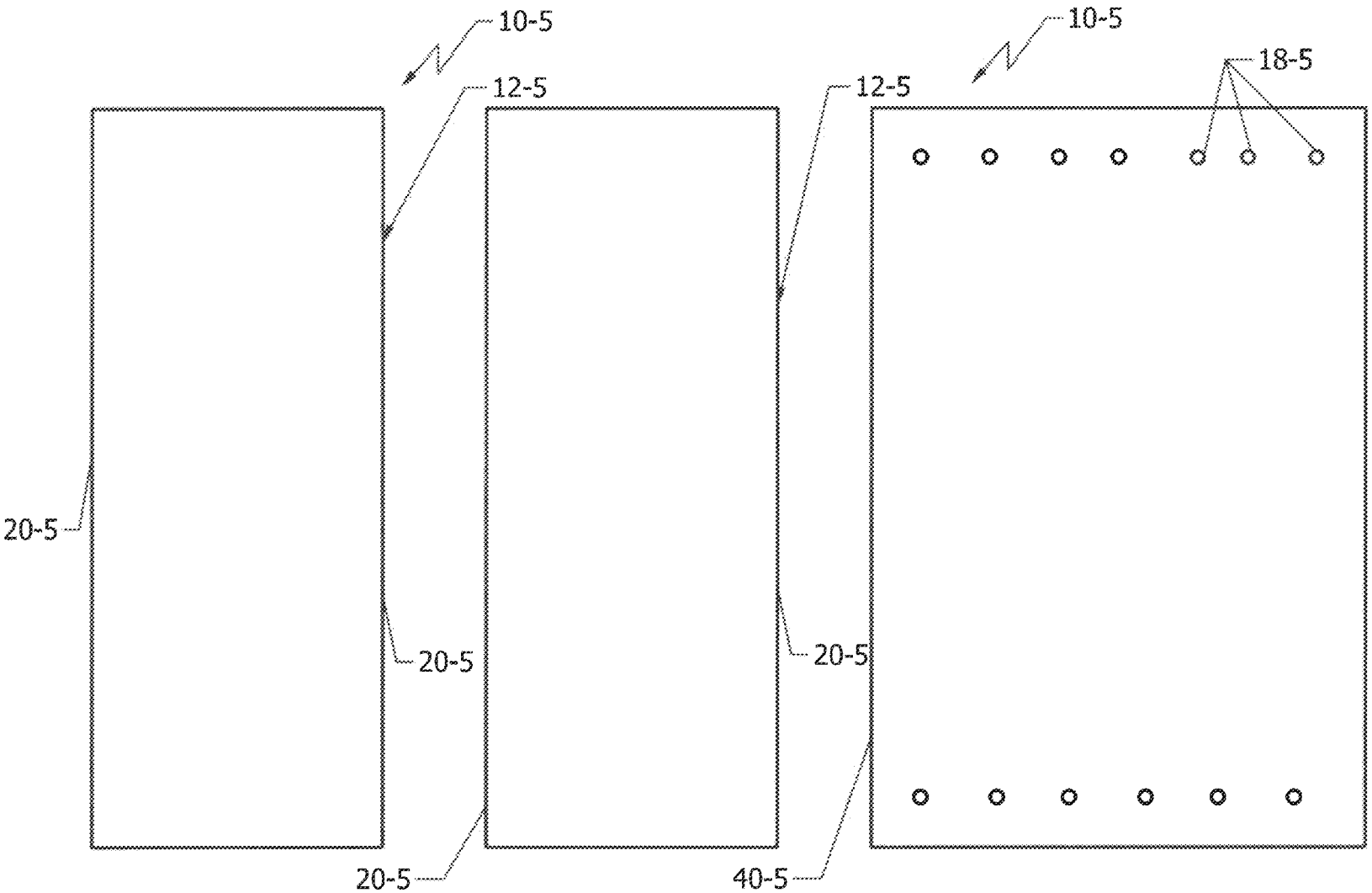
FIG. 18 is a top end perspective view of assembly sheets for a dual-track module according to another embodiment of the disclosure.
Figure 20:
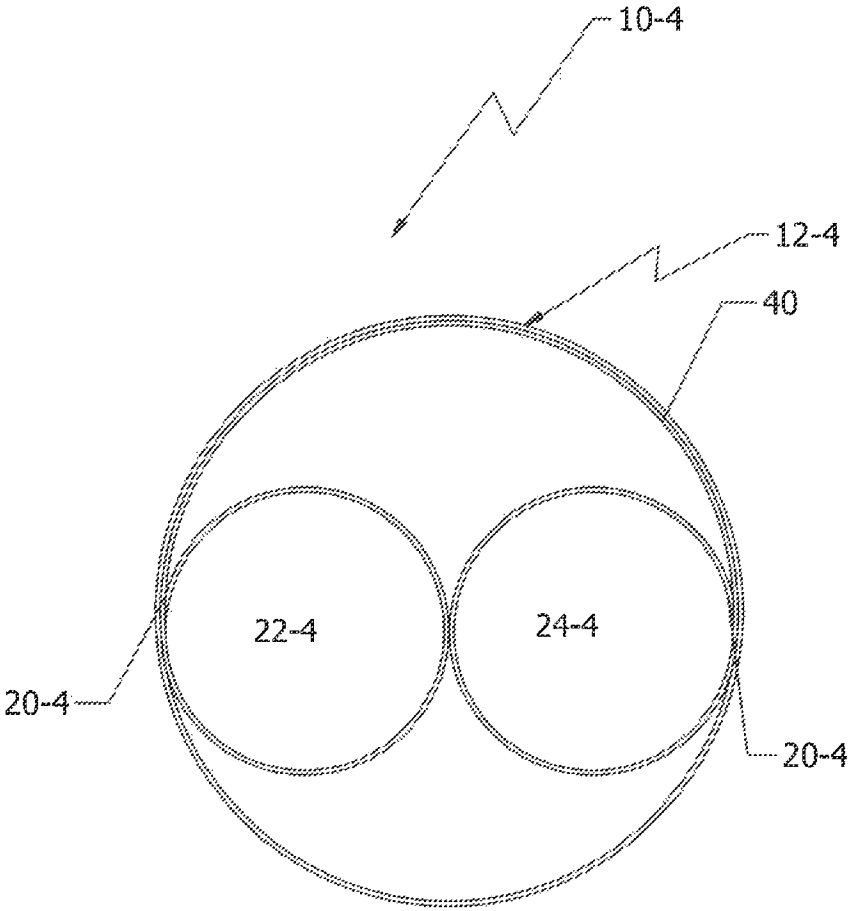
FIG. 20 is an end view of a fully assembled dual-track module using the assembly sheets shown in FIG. 18.
Figure 19:
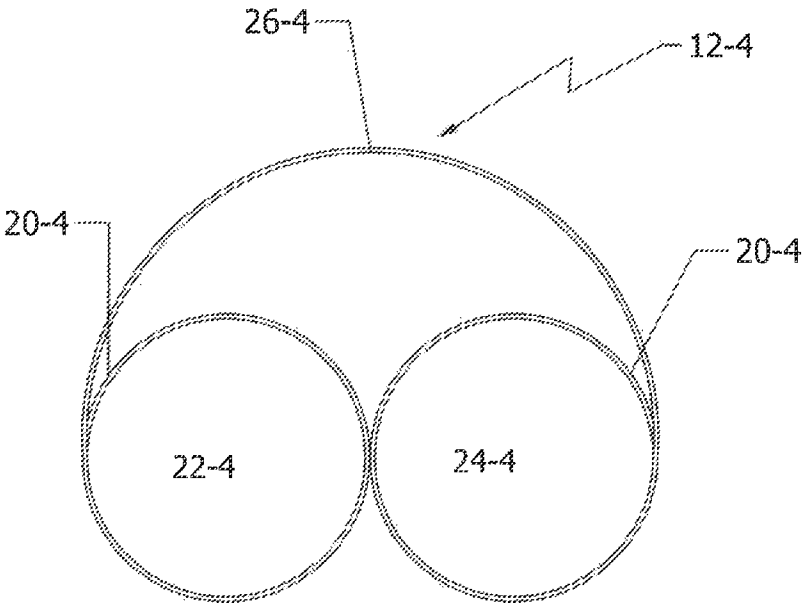
FIG. 19 is an end view of a partially assembled dual-track module using the assembly sheets shown in FIG. 18.

Referring now to FIGS. 18-20, in a still further embodiment of the straight, dual-track segment, the segment is formed with one, two or three sheets of material. As shown in FIG. 19, a straight dual-track segment $\mathbf{12}^{IV}$, may be formed with a single sheet by rolling the side edges $\mathbf{20}^{IV}$ around onto themselves to form the dual tracks. As shown in FIG. 18, straight dual-track segment, designated generally as $\mathbf{10}^{IV}$, is formed, in one embodiment, with two sheets, a first sheet $\mathbf{12}^{IV}$ and a second sheet 40. If two sheets are used, first sheet $\mathbf{12}^{IV}$ is prepared in the same manner described for sheet 12''', each side $\mathbf{20}^{IV}$ is rolled past a centerline $\mathbf{26}^{IV}$ and registered against the sheet to form two substantially uniform and parallel tunnels. Second sheet 40 is next rolled about formed sheet $\mathbf{12}^{IV}$ to lock sheet $\mathbf{12}^{IV}$ in its formed shape in which two uniform, substantially circular (in cross-section) and substantially parallel tunnels: a left track tunnel $\mathbf{22}^{IV}$ and a right track tunnel $\mathbf{24}^{IV}$. If three sheets are used, two sheets $\mathbf{12}^{IV}$ are used with each forming a single tunnel. Third sheet 40 is rolled around the adjacent tunnels. Adhesives, mechanical fasteners or retaining clips may be used to secure second sheet 40 about formed first sheet $\mathbf{12}^{IV}$ (or about the two sheets $\mathbf{12}^{IV}$).

Figure 21:
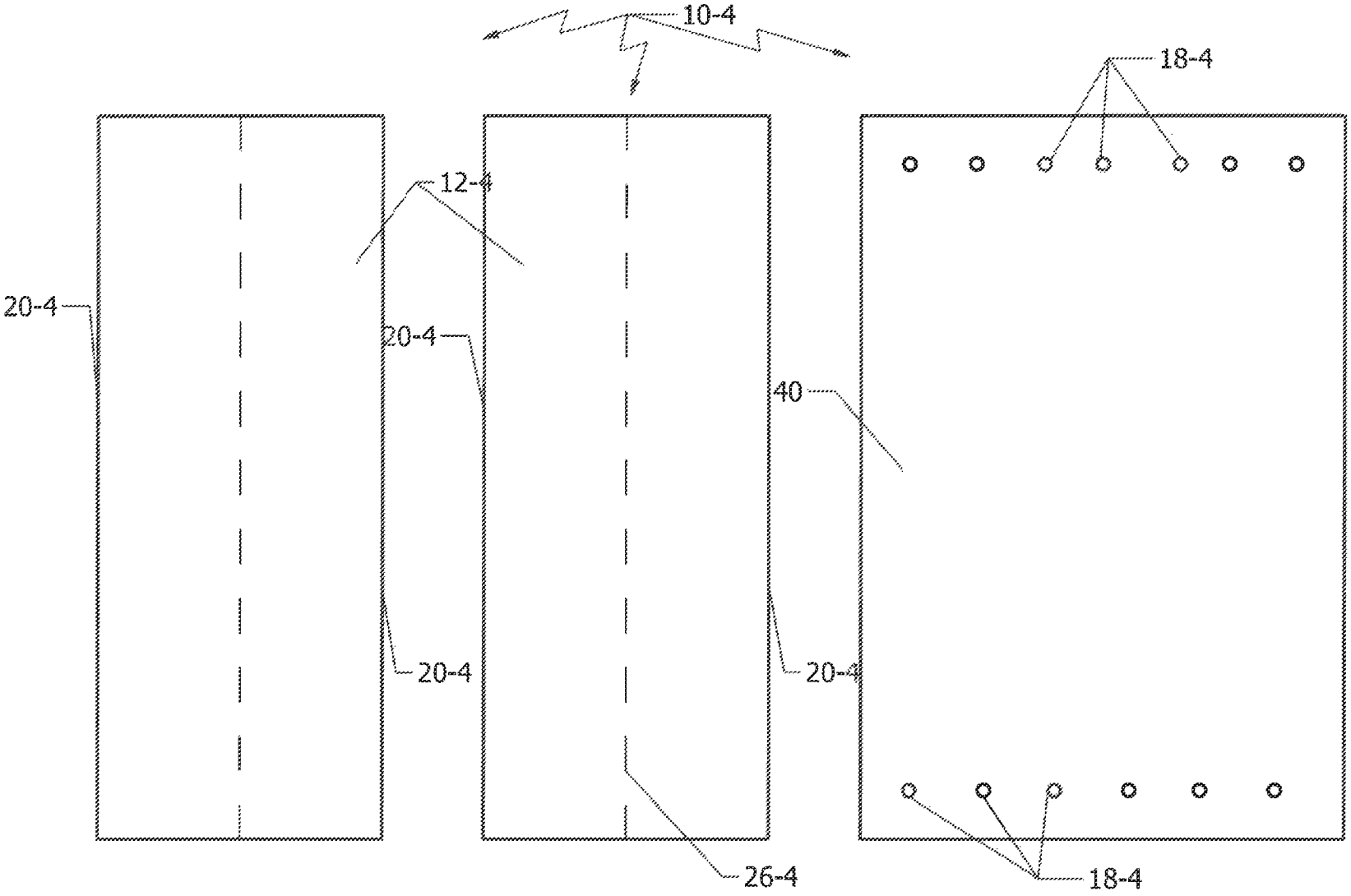
FIG. 21 is a top end perspective view of assembly sheets for a dual-track module according to yet another embodiment of the disclosure.
Figure 23:
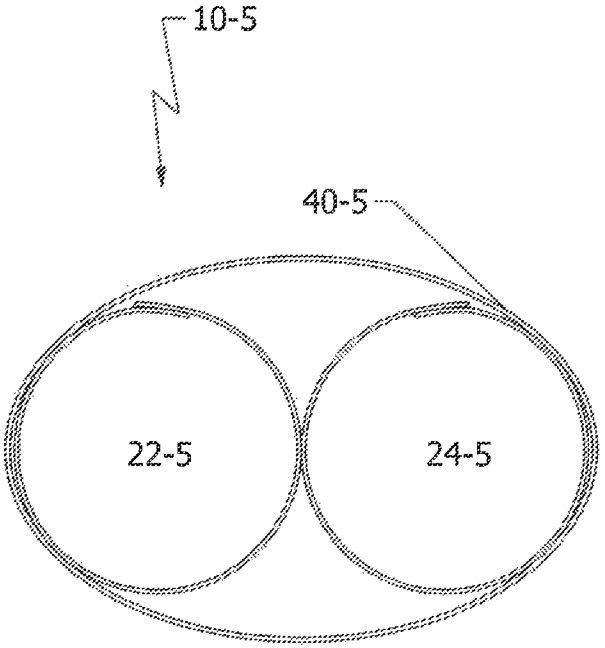
FIG. 23 is an end view of a fully assembled dual-track module using the assembly sheets shown in FIG. 21.
Figure 22:
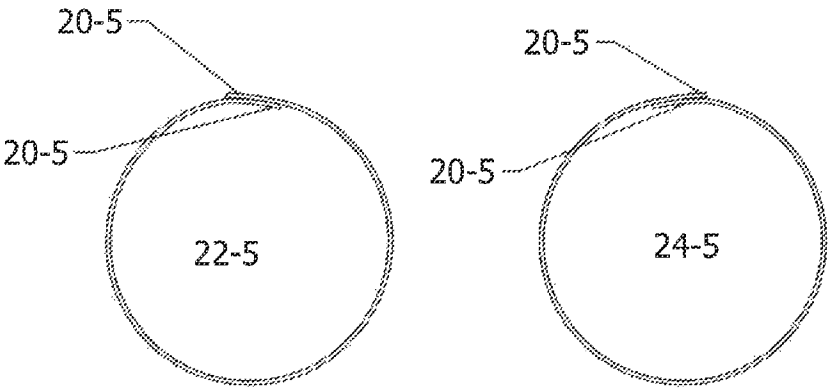
FIG. 22 is an end view of a partially assembled dual-track module using the assembly sheets shown in FIG. 21.
Figure 52:
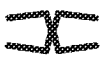
FIG. 52 is an end view of a modified two-segment retaining clip used to assemble the dual-track module shown in FIG. 51.

Referring now to FIGS. 21-23, a three-sheet straight dual-track segment is formed substantially the same as the two-sheet embodiment shown in FIGS. 18-20 except each tunnel is formed by a dedicated sheet before a third sheet is superposed about the two formed tunnels. As shown in FIGS. 21 and 22, a straight dual-track segment, designated generally as $\mathbf{10}^{V}$, is formed by taking two identical sheets $\mathbf{12}^{V}$ and rolling them into substantially identical tunnels circular in cross-section. As shown in FIG. 23, the tunnels are aligned, side-by-side, and can be adhered or affixed together with adhesives, mechanical fasteners and the like. A third flat sheet $\mathbf{40}^{V}$ is superposed about the aligned and/or affixed tunnels by urging the sides of third sheet $\mathbf{40}^{V}$ about the aligned tunnels. The sides of sheet $\mathbf{40}^{V}$ are either butted or overlapped to secure the sheet about the aligned tunnels. If overlapped, adhesives or mechanical fasteners can be used to secure the sheet sides together. If butted, a two-sided retaining clip 42, such as shown in FIG. 52, can be used to secure the sheet sides by inserting each side into a dedicated side of two-sided retaining clip 42. In one embodiment, formed sheet $\mathbf{40}^{V}$ is secured to the aligned tunnels with a friction fit. Formed sheet $\mathbf{40}^{V}$ may be further secured to the aligned tunnels with adhesive or mechanical fasteners.

Figures 24, 25:
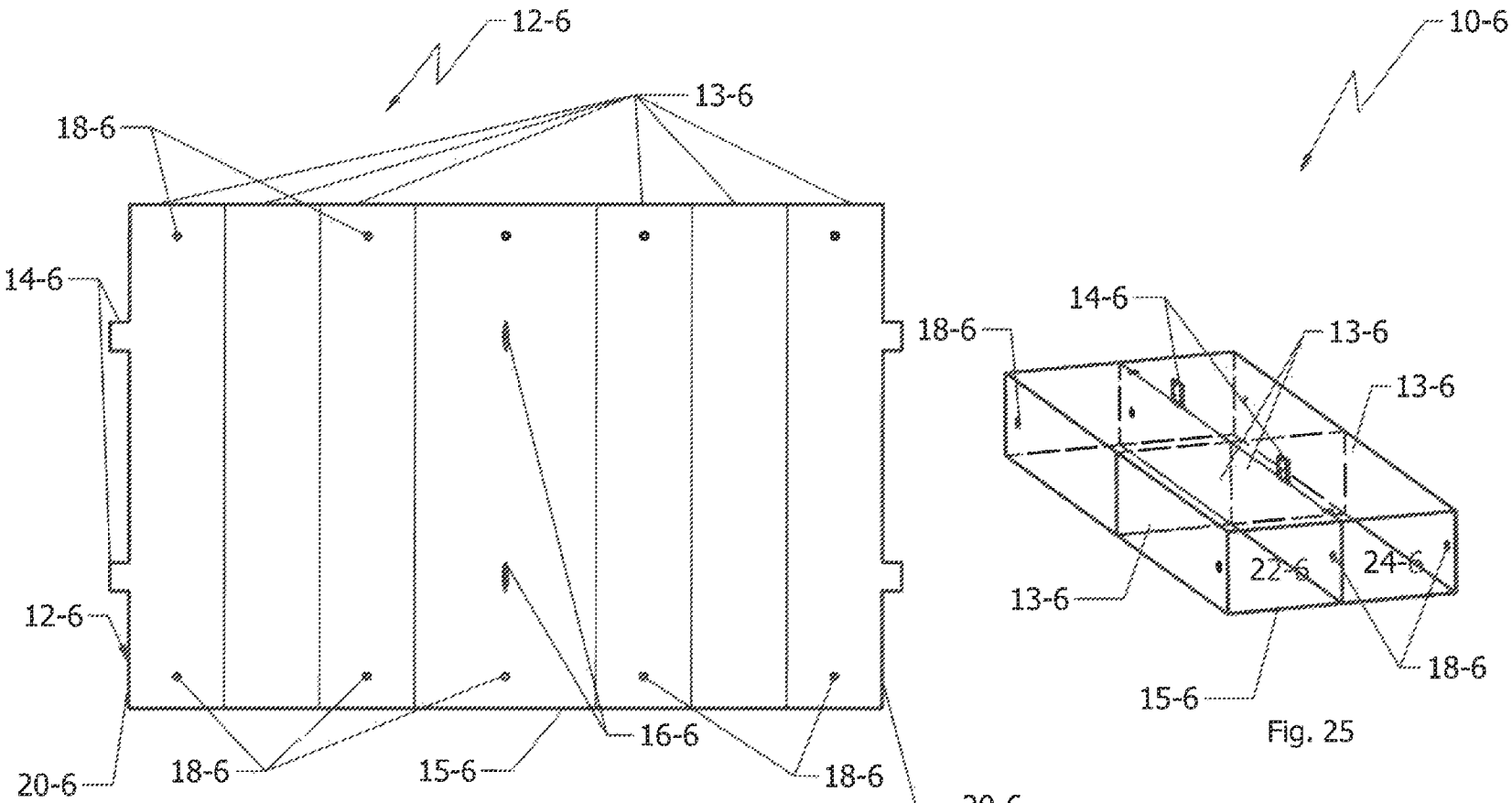
FIG. 24 is a top end perspective view of an assembly sheet for a square dual-track module according to still another embodiment of the disclosure.
FIG. 25 is a top end perspective view of an assembled square dual-track module using the assembly sheet shown in FIG. 24.

Referring now to FIGS. 24 and 25, a still further embodiment of the straight dual-track segment is shown designated generally as $\mathbf{10}^{VI}$ in which the cross-sectional shapes of the tunnels conform substantially to a square or rectangle. To form this segment, each tunnel is formed by a single or a separate sheet $\mathbf{12}^{VI}$. For the single-sheet embodiment shown in FIG. 24, sheet $\mathbf{12}^{VI}$ is creased along its length to form seven sections—six sections of identical width and a $7^{th}$ top center section $\mathbf{15}^{VI}$ dimensioned to be twice as wide as sections $\mathbf{13}^{VI}$. Once sheet $\mathbf{12}^{VI}$ has been creased, sides $\mathbf{20}^{VI}$ should be rotated downwardly and toward each other until the distal-most sections $\mathbf{13}^{VI}$ are folded in an upward direction and registered against each other. Tabs $\mathbf{14}^{VI}$ formed along sides $\mathbf{20}^{VI}$ are inserted into corresponding slots $\mathbf{16}^{VI}$ formed in top center section $\mathbf{15}^{VI}$ as shown in FIG. 25.

In a related embodiment (not shown), a retaining clip 28 is used to secure the registered sections $\mathbf{13}^{VI}$ together by sliding the registered sections $\mathbf{13}^{VI}$ in between the tines of clip 28. This creates two uniform, substantially square (in cross-section) and substantially parallel tunnels: a left tunnel track $\mathbf{22}^{VI}$ and a right tunnel track $\mathbf{24}^{VI}$. It should be understood that other cross-sectional shapes are possible by changing the number of creases formed in sheet $\mathbf{12}^{VI}$ without departing from the scope of the disclosure.

Figure 27:
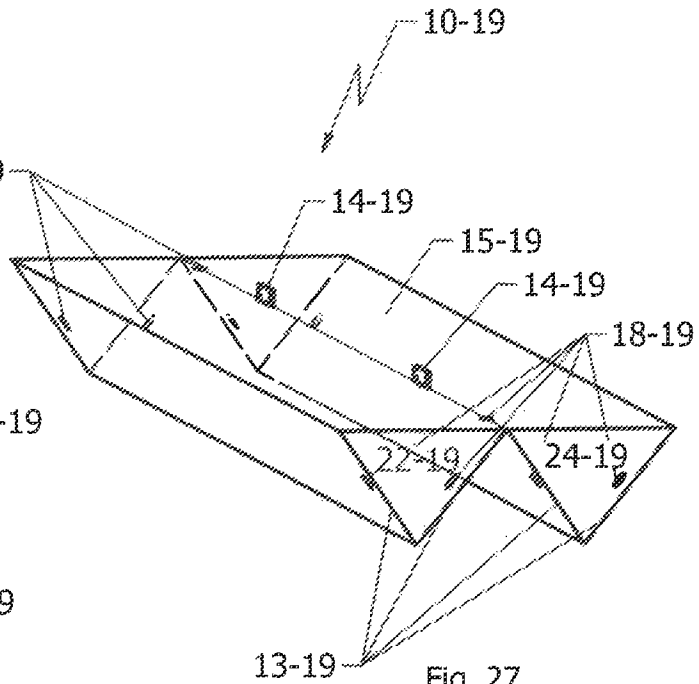
FIG. 27 is a top end perspective view of an assembled triangular dual-track module using the assembly sheet shown in FIG. 26.
Figure 26:
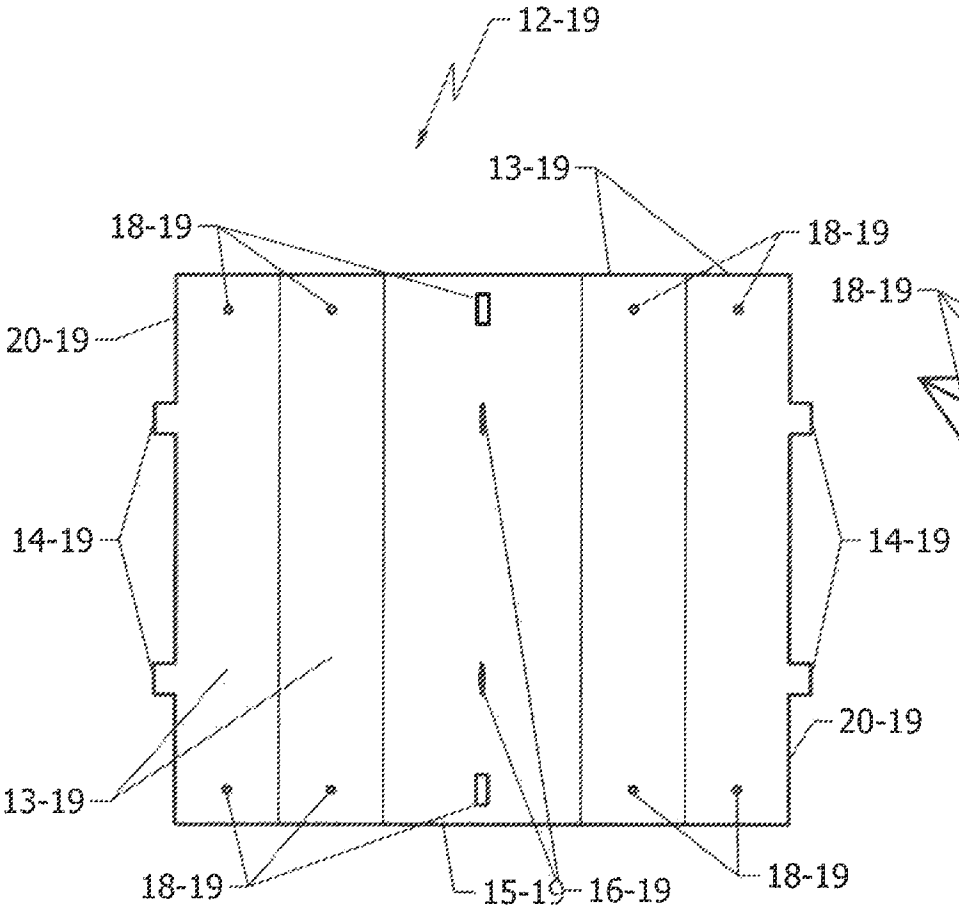
FIG. 26 is a top end perspective view of an assembly sheet for a triangular dual-track module according to a further embodiment of the disclosure.

Referring now to FIGS. 26 and 27, in a further embodiment of the disclosure, a straight, dual-track module designated generally as $\mathbf{10}^{XIX}$, has tunnels with cross-sectional shapes that conform substantially to the shape of a triangle. To form this segment, each tunnel is formed by a single or a separate sheet $\mathbf{12}^{XIX}$. For the single-sheet embodiment shown in FIG. 24, sheet $\mathbf{12}^{XIX}$ is creased along its length to form five sections—four sections of identical width and a $5^{th}$ top center section $\mathbf{15}^{XIX}$ dimensioned to be twice as wide as sections $\mathbf{13}^{XIX}$. Once sheet $\mathbf{12}^{XIX}$ has been creased, sides $\mathbf{20}^{XIX}$ should be rotated downwardly and toward each other until the distal-most sections $\mathbf{13}^{XIX}$ are folded in an upward direction and registered against each other. Tabs $\mathbf{14}^{XIX}$ formed along sides $\mathbf{20}^{XIX}$ are inserted into corresponding slots $\mathbf{16}^{XIX}$ formed in top center section $\mathbf{15}^{XIX}$ as shown in FIG. 27.

Figure 30:
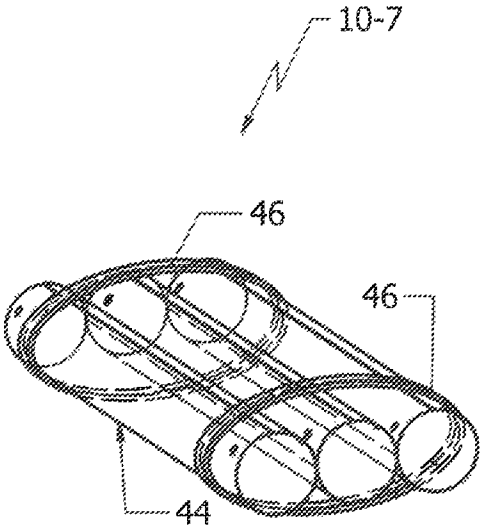
FIG. 30 is a top, end perspective view of a multi-tunnel track module assembled from the assembly sheet shown in FIG. 28 according to another embodiment of the disclosure.
Figure 29:
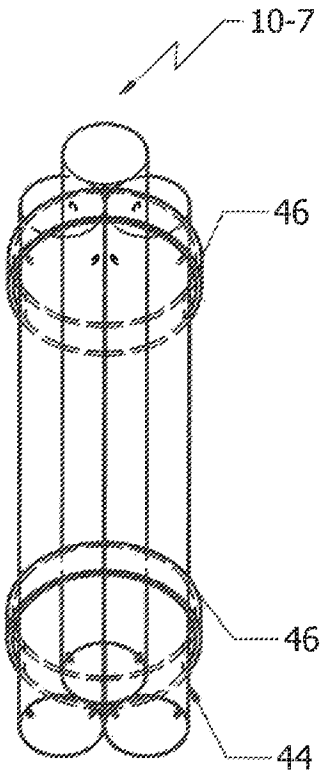
FIG. 29 is a top, end perspective view of a multi-tunnel track module assembled from the assembly sheet shown in FIG. 28 according to one embodiment of the disclosure.
Figure 28:
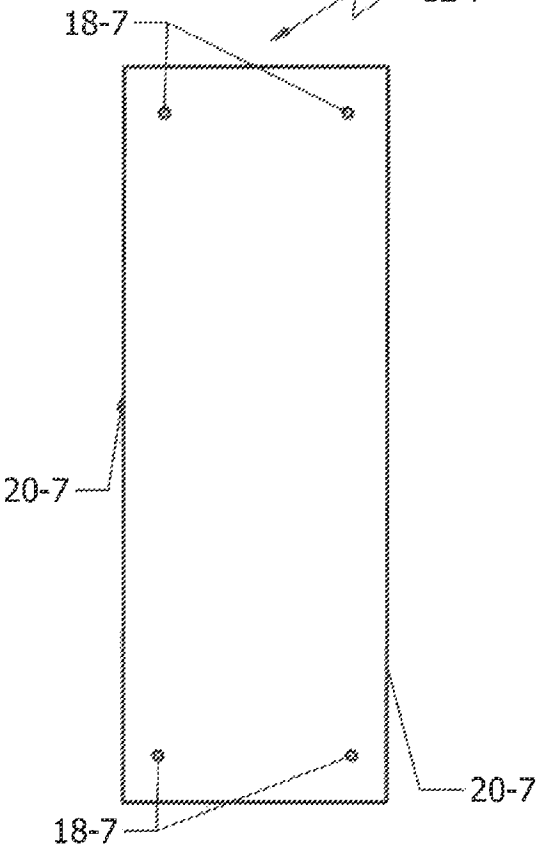
FIG. 28 is a top end perspective view of an assembly sheet for a multi-tunnel track module according to a yet further embodiment of the disclosure.

Referring now to FIGS. 28-30, in yet another embodiment of the straight track segment, a plurality of tubular tracks are registered together with one or more retention rings and generally designated as $\mathbf{10}^{VII}$. Each tunnel is formed from a single sheet $\mathbf{12}^{VII}$ by rolling each sheet into a tube with a circular cross-section. The sheets are maintained in their rolled form via adhesive, mechanical fastener and the like. Once formed, the tunnels are registered against one another to form a bundle 44. The tunnels of a bundle of are maintained in registration with one or more retainer rings 46. Retainer ring 46 may be rigid or elastic and may be constructed from metal, polymers and/or rubber.

Figure 32:
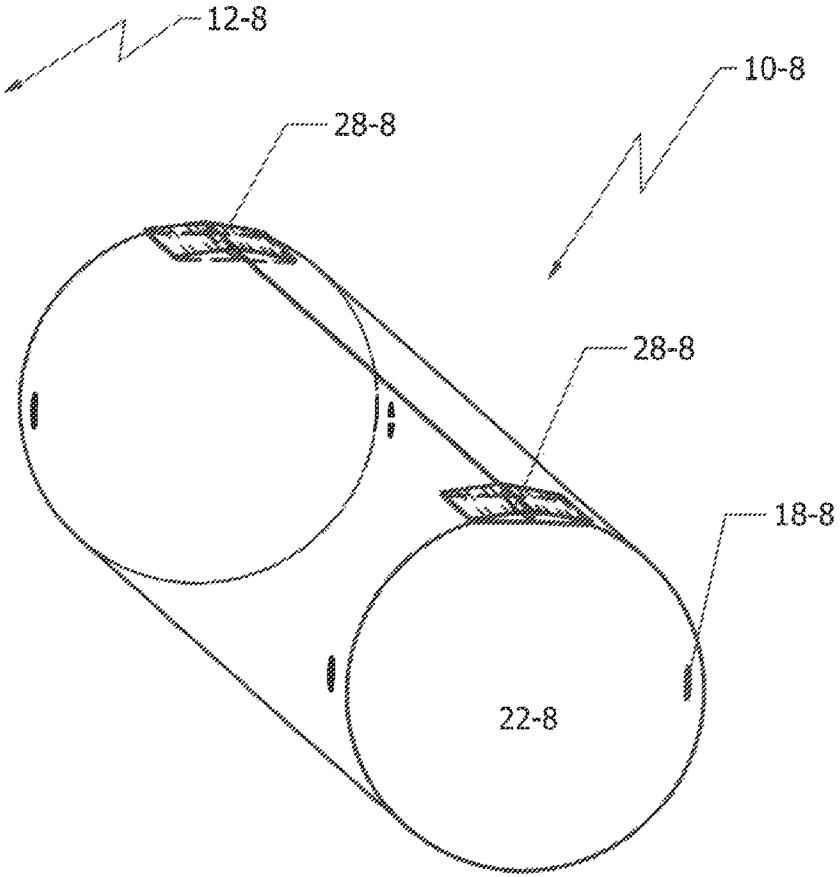
FIG. 32 is a top, end perspective view of a single-tunnel track module assembled from the assembly sheet shown in FIG. 31 and the two-segment retaining clip shown in FIG. 52.
Figure 31:
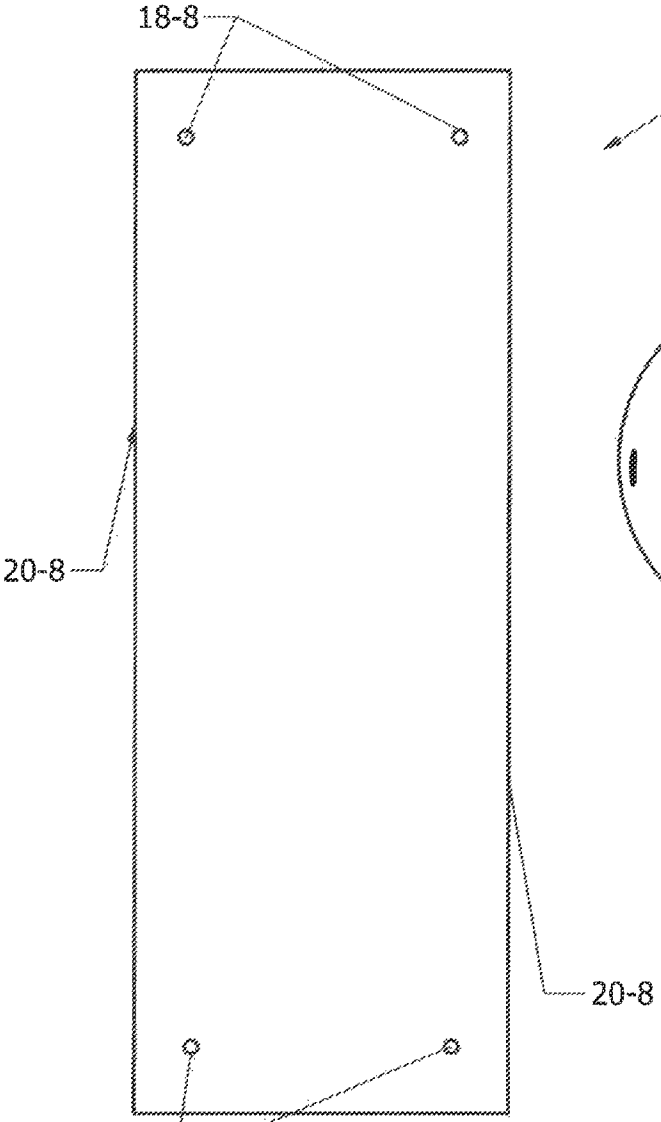
FIG. 31 is a top end perspective view of an assembly sheet for a single-tunnel track module according to yet another embodiment of the disclosure.

Referring now to FIGS. 31 and 32, in still another embodiment of a straight single-track segment, a track segment, designated generally as $\mathbf{10}^{VIII}$ is formed as a single tunnel $\mathbf{22}^{VIII}$ formed from a single sheet $\mathbf{12}^{VIII}$. To form the tunnel, sheet $\mathbf{12}^{VIII}$ is rolled so sides $\mathbf{20}^{VIII}$ are aligned and facing each other. A dual retaining clip or dual binding bar $\mathbf{28}^{VIII}$ is used to secure the sides together. Binding bar $\mathbf{28}^{VIII}$ is formed by affixing two retaining clips together along their spines 29. The spines may be fused together with heat, adhesive or mechanical fasteners. In an alternative embodiment, binding bar $\mathbf{28}^{VIII}$ may be formed via an extrusion or mold process as is well known in the art. The tines of the combined retaining clips face outwardly on a horizontal plane at an approximately 180° angle. To assemble the single-track tunnel, after the sheet has been rolled, each side 20$^{VIII}$ is inserted between the tines of one side of the dual binding bar 28$^{VIII}$ to fix the orientation of the sides and complete the tunnel. Single tunnel 22$^{VIII}$ provides certain advantages as it permits what would otherwise be dual tracks to be separated and allow the tracks to be directed into different directions and potentially different travel schema.

Figure 34:
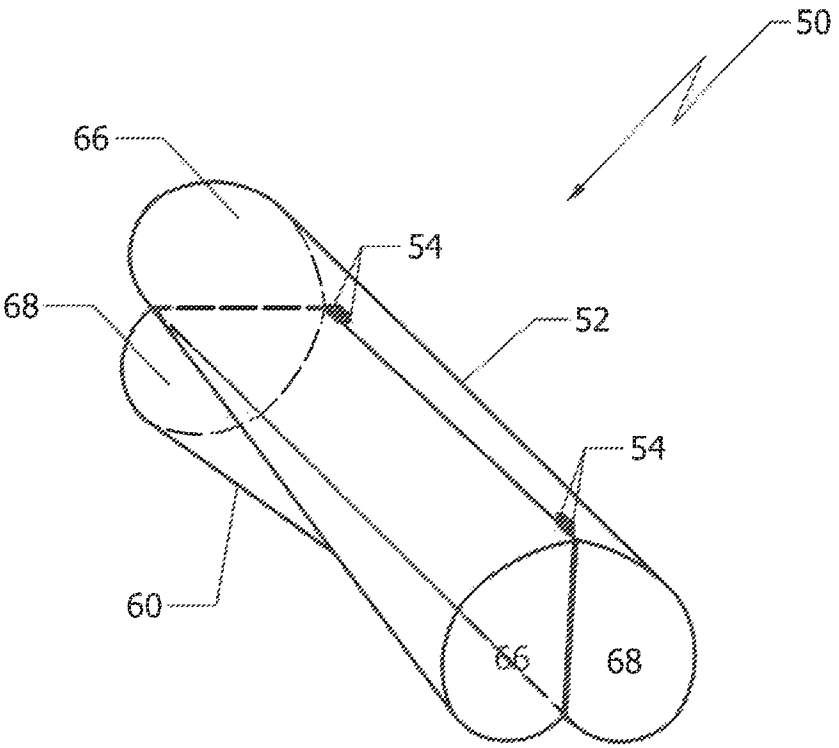
FIG. 34 is a top, end perspective view of a dual-track twist module assembled from the assembly sheet shown in FIG. 33.
Figure 33:
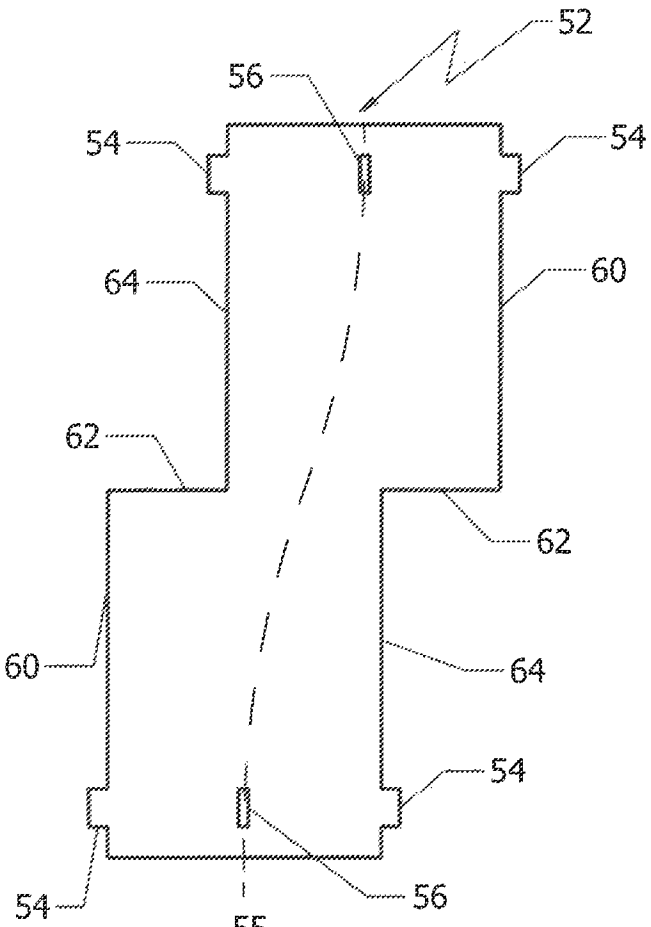
FIG. 33 is a top end perspective view of an assembly sheet for a dual-track twist module according to still another embodiment of the disclosure.
Figure 35:
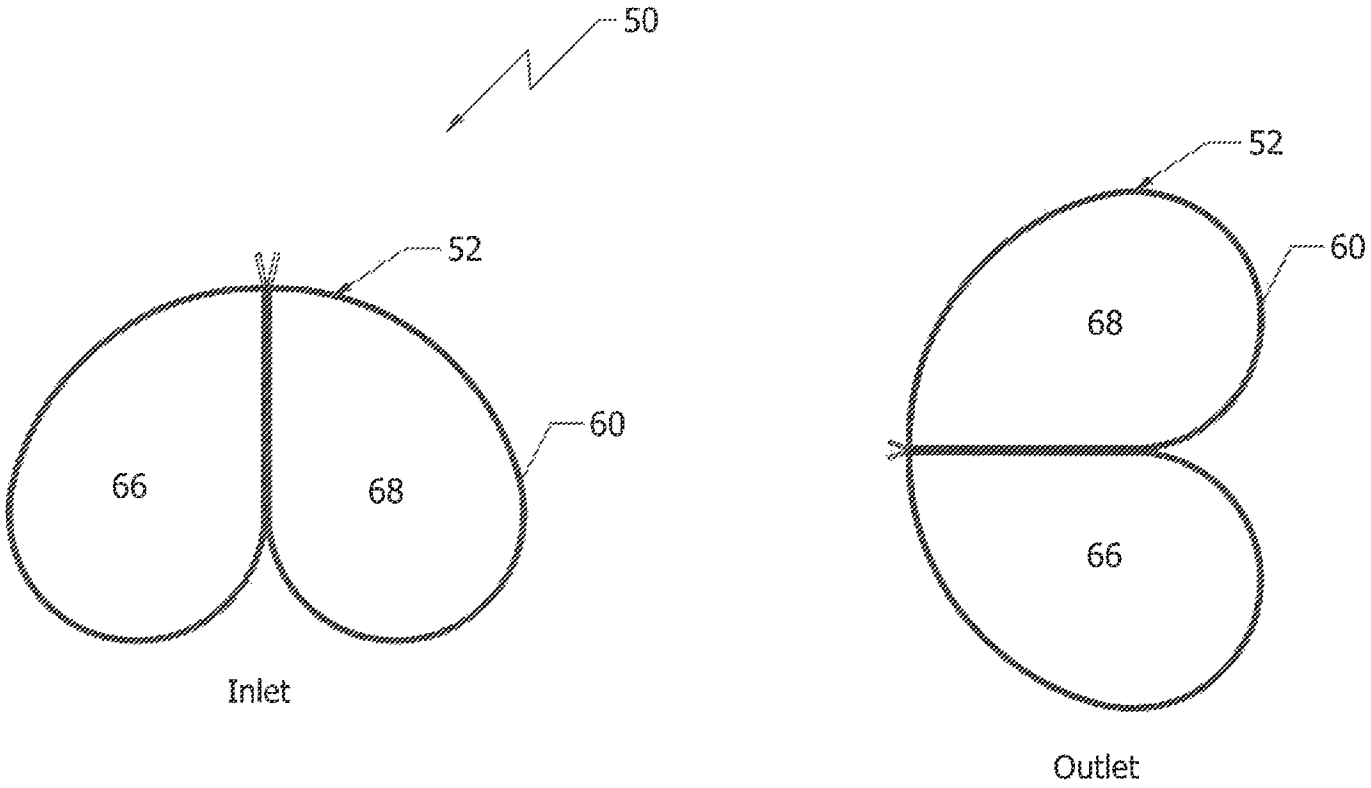
FIG. 35 are end views of inlet and outlet ends of the dual-track twist module shown in FIG. 34.

Referring now to FIGS. 33-35, in a further embodiment of the straight dual-track segment, a straight twist dual-track segment, designated generally as 50, is formed with a modified sheet 52 as shown in FIG. 33. To prepare sheet 52, sections are removed from diametrically opposed corners to create a staggered configuration. Sides 60 are formed with stepped surfaces with a recessed side surface 64 and a shoulder 62. The recessed side surfaces are on diametrically opposed sections of sheet 52. Tabs 54 extend from sides 60 proximal the corners of sheet 52. Additional tabs 54 extend from recessed side surfaces 64 in lateral alignment with the tabs extending from the not-recessed side surfaces. Slots 56 are positioned along a centerline 55 of sheet 52 and in lateral alignment with the laterally-aligned tabs 54.

To assemble twist dual-track segment 50, sides 60 are rolled to centerline 55 and tabs 54 are inserted into their laterally-aligned, corresponding slots 56. In this manner, laterally-aligned opposing tabs 54 come into registration inside slots 56. The tabs are secured in the slots with any of the methods disclosed herein. Due to the unique geometry of the starting sheet 52, the inlet of the twist dual-track segment is oriented via a 90° shift relative to the segment's outlet as shown in FIG. 35. This permits marbles or other spherical objects travelling in the dual-tracks to go from a horizontal orientation to a vertical orientation. This allows several possibilities for other track segments to be joined to the twist dual track segment 50.

Figure 38A:
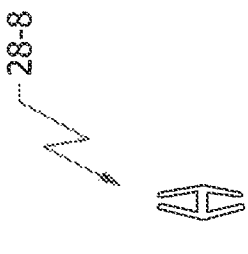
FIG. 38 is an end view of a four-segment retaining clip used to assemble the dual-track module shown in FIG. 37.
Figure 38:
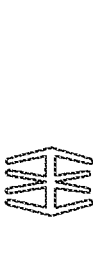
Figure 37:
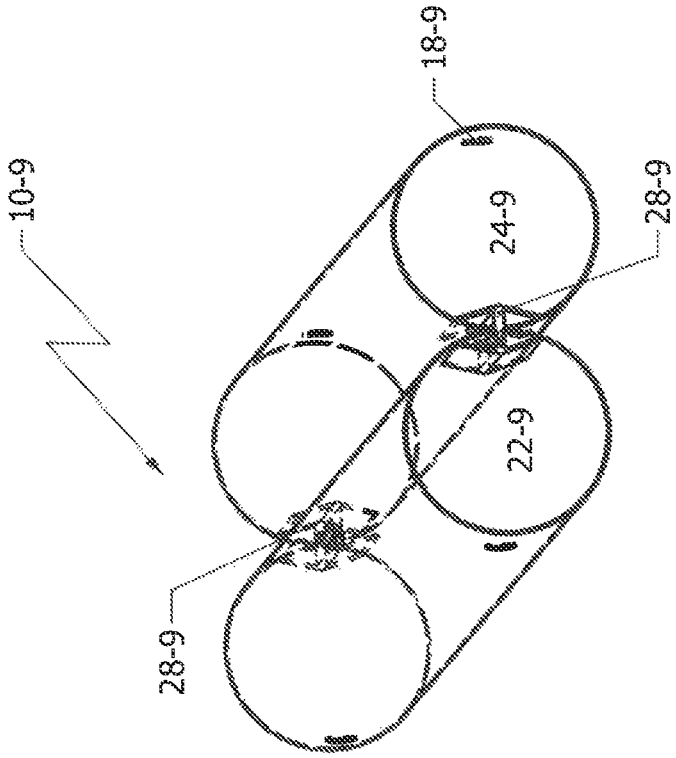
FIG. 37 is a top, end perspective view of a dual-track module assembled from the assembly sheet shown in FIG. 36.
Figure 36:
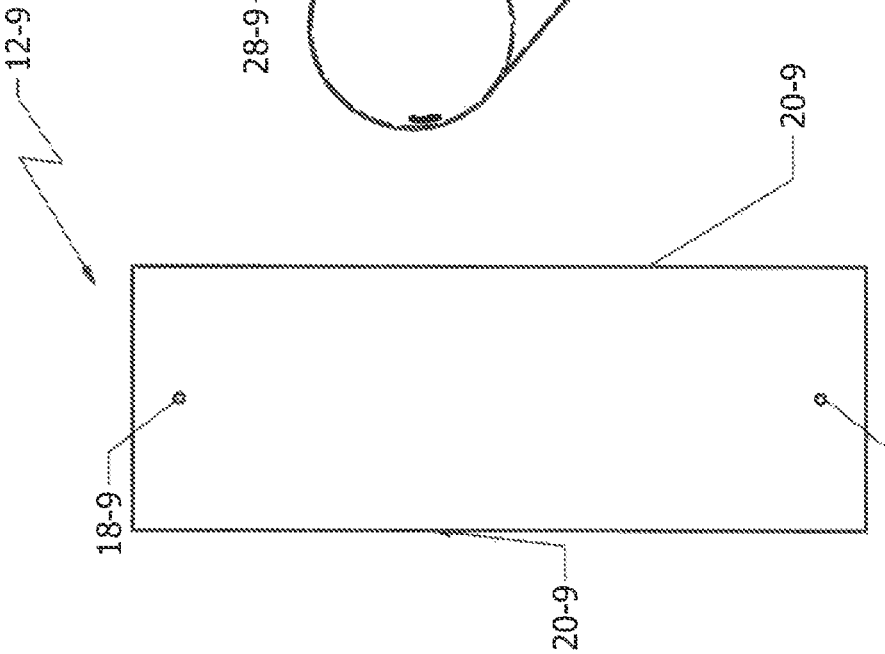
FIG. 36 is a top end perspective view of an assembly sheet for a dual-track module according to a further embodiment of the disclosure.

Referring now to FIGS. 36-38, in a further embodiment of the straight dual-track segment, a modified four-part or two-part retaining clip is used to assemble the dual-track segment. As shown in FIG. 37, a straight dual-track segment, designated generally as 10$^{IX}$, uses two sheets 12$^{IX}$ to form the dual-track segment. No tabs or slots are used for this embodiment and no modifications are made to the sheets. As shown in FIG. 38, a four-sided retaining clip or binding bar 28$^{IX}$ incorporates four retaining clips with fixed spines so the tines of each retaining clip are arranged in two vertically-oriented, parallel sets with each set comprised of two retainer clips with their spines affixed together. This orients the tines of the affixed retainer clips to be 180° apart. By joining the two sets together in parallel, the tine sets are oriented vertically with two sets of tines facing downwardly and the other two sets of tines facing upwardly 180° opposite the downwardly-facing set.

To assemble straight dual-track segment 10$^{IX}$, sides 20$^{IX}$ of one of the sheets 12$^{IX}$ are rolled until the opposing sides are aligned vertically with the tines of one set of the fixed binder clips. The opposing sides are inserted into the vertically-oriented tines to secure the sheet and form a track tunnel as shown in FIG. 37. The second sheet is rolled in similar fashion to the first sheet and the opposing sides are inserted into the vertically-oriented second set of fixed binder clip tines to secure the second sheet and form a second track tunnel adjacent the first tunnel. In this configuration, the adjacent track tunnels do not share a common wall, but have part of their inner walls formed by the four-part retaining clip 28$^{IX}$. As shown in FIG. 38, the same configuration can be achieved by securing all sides 20$^{IX}$ into a two-sided binder clip 28$^{viii}$.

Figure 41:
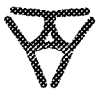
FIG. 41 is an end view of a three-segment retaining clip used to assemble the multi-tunnel track module shown in FIG. 40.
Figure 40:
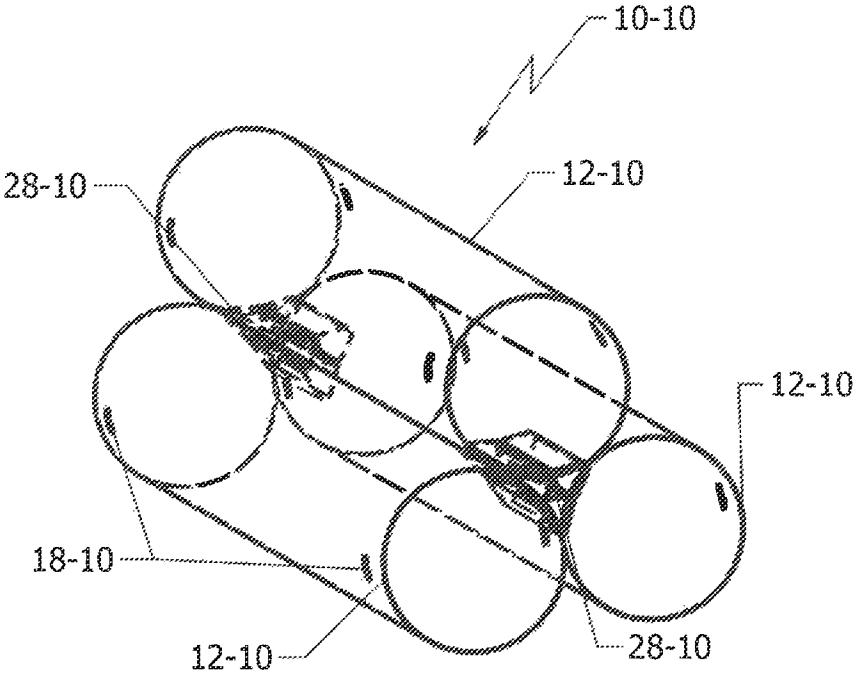
FIG. 40 is a top, end perspective view of a multi-tunnel track module assembled from the assembly sheet shown in FIG. 39.
Figure 39:
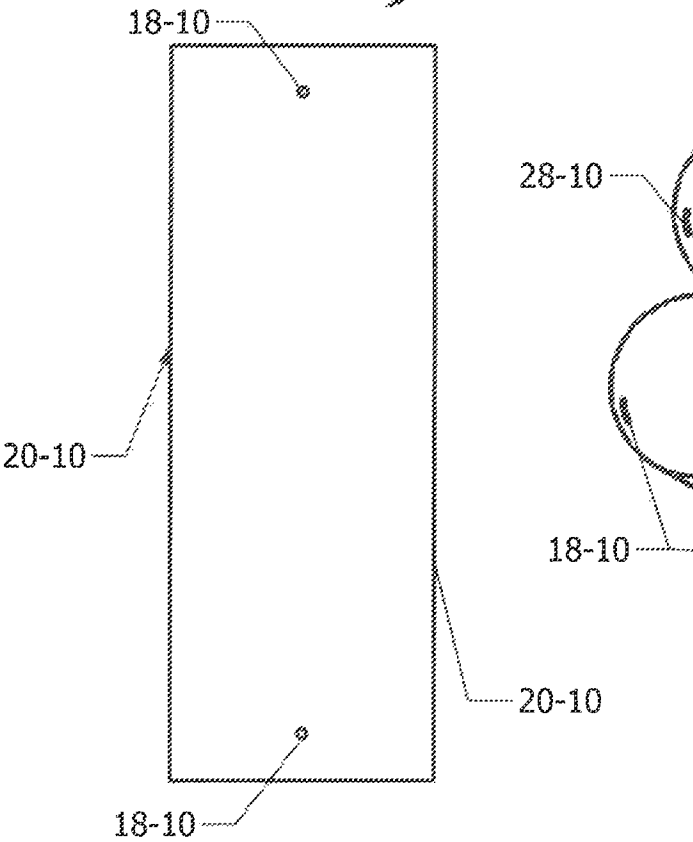
FIG. 39 is a top end perspective view of an assembly sheet for a multi-tunnel track module according to a further embodiment of the disclosure.

Referring now to FIGS. 39-41, in a yet further embodiment of the straight tunnel segment, a straight triple-track segment, designated generally as 10$^{X}$, includes features to construct a triple-track segment or run. This embodiment is constructed from three sheets of material and a modified three-part retaining clip or binding bar 28$^{X}$. Retaining clip 28$^{X}$ is formed by fusing or affixing the spines of three retaining clips oriented at 120° from each other, or by being extruded in this shape. This formation creates three sets of tines oriented 120° apart as shown in FIG. 41.

To assemble straight triple-track segment 10$^{X}$, a first sheet 12$^{X}$ is rolled until sides 20$^{X}$ are aligned with two adjacent sets of tines. Each side is inserted into a dedicated single tine set to lock sheet 12$^{X}$ in a tunnel formation. A second sheet 12$^{X}$ is rolled until sides 20$^{X}$ are aligned with two adjacent sets of tines, one of which will be occupied by one of the sides of the first sheet. Each side of the second sheet is inserted into a dedicated single tine set to lock second sheet 12$^{X}$ in a tunnel formation. A third sheet 12$^{X}$ is rolled until sides 20$^{X}$ are aligned with two adjacent sets of tines, each of which will be occupied by one of the sides of either the first sheet or the second sheet. Each side of the third sheet is inserted into a dedicated single tine set to lock third sheet 12$^{X}$ in a tunnel formation. Once all the sheets are properly secured in the three-part retaining clip 28$^{X}$, each tine set will be occupied or will retain two sides of adjacent sheets 12$^{X}$. The tunnels will be tear-shaped or circular in cross-section as shown in FIG. 40.

Figures 42, 43, 44:
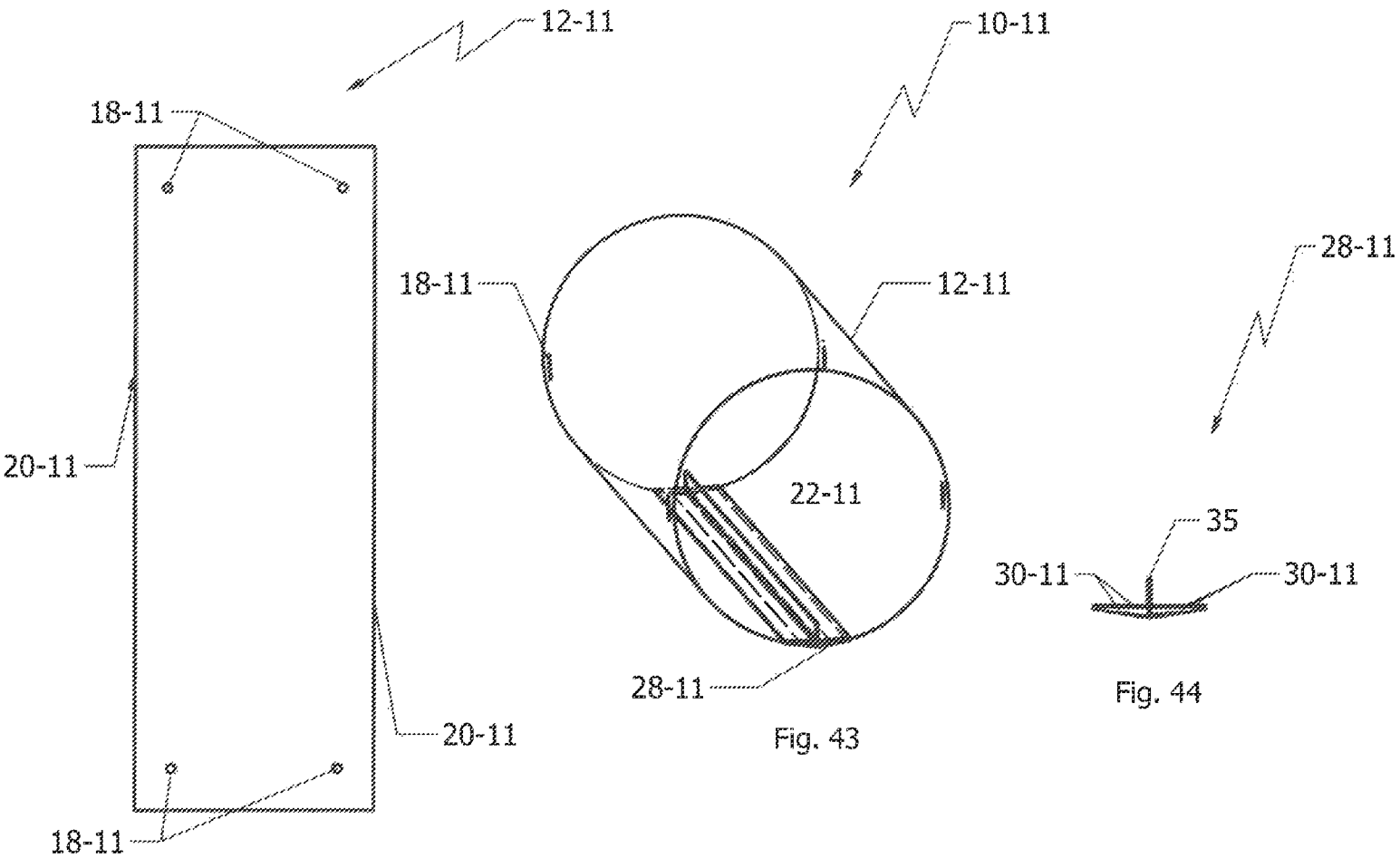
FIG. 42 is a top end perspective view of an assembly sheet for a single-tunnel track module according to a yet further embodiment of the disclosure.
FIG. 43 is a top, end perspective view of a single-tunnel track module assembled from the assembly sheet shown in FIG. 42.
FIG. 44 is an end view of a modified two-segment retaining clip with a center track divider wall used to assemble the multi-tunnel track module shown in FIG. 43.

Referring now to FIGS. 42-44, in a still further embodiment of the disclosure, a single-tunnel, dual-track segment, designated generally as 10$^{XI}$, is formed from a single sheet and a two-sided retaining clip 28$^{XI}$ having a vertically-oriented divider wall 35. As shown in FIG. 44, retaining clip 28$^{XI}$ is formed by bonding or affixing two single retaining clips along their spines to the vertically-oriented divider wall. Alternatively, retaining clip 28$^{XI}$ is formed via molding or extrusion. The tines of each are oriented 180° apart. Divider wall 35 functions to partially define two parallel tracks in the single tunnel and to maintain any marbles or spherical objects travelling in the tracks separated. To form the dual-track segment, sides 20$^{XI}$ of a sheet 12$^{XI}$ are rolled and each side is aligned with one of the opposing sets of tines. Each side is inserted into a dedicated tine set to secure the side and form a single track in combination with divider wall 35. Each track can carry marbles separated from marbles carried in the other track due to divider wall 35.

Figure 46:
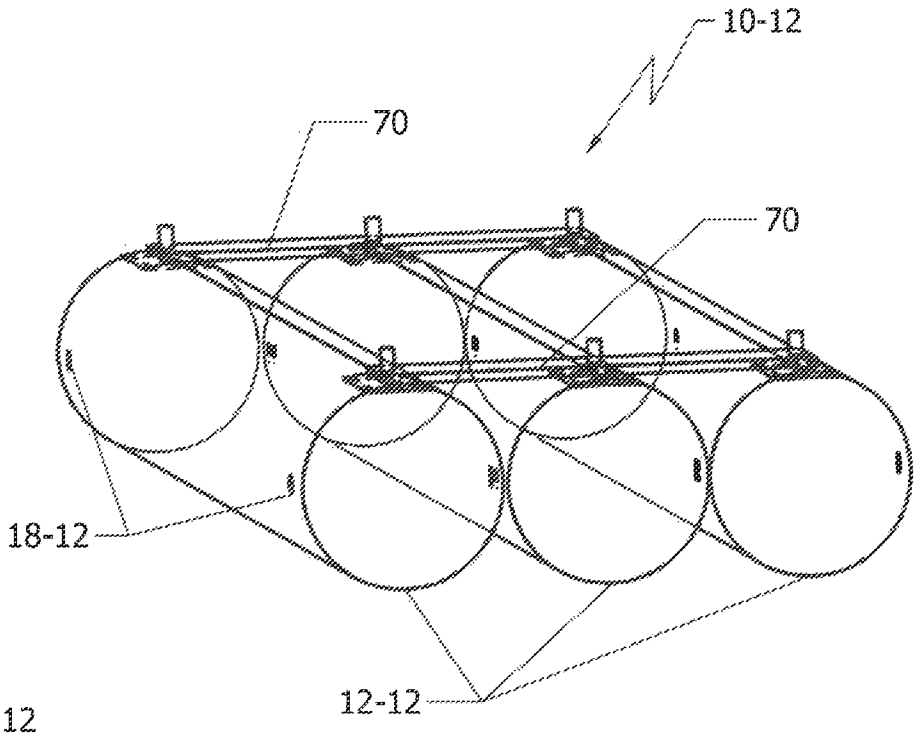
FIG. 46 is a top, end perspective view of a multi-tunnel track module assembled from the assembly sheet shown in FIG. 45 with a binder strip.
Figure 45:
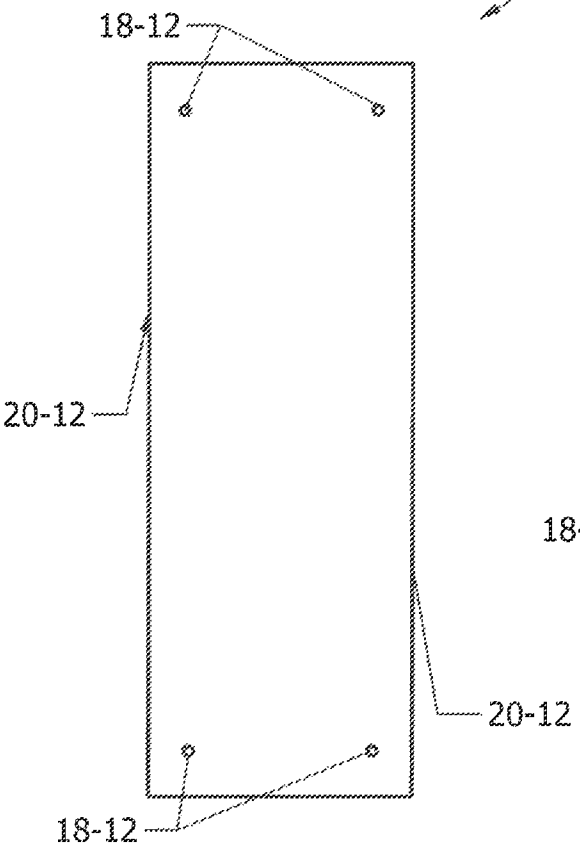
FIG. 45 is a top end perspective view of an assembly sheet for a multi-tunnel track module according to a still further embodiment of the disclosure.

Referring now to FIGS. 45 and 46, in a further embodiment of the disclosure, single-track segments 10$^{XII}$ are joined together with a binding mechanism to permit a plurality of tracks to be assembled in parallel. For this embodiment a binding strip 70 is secured to a plurality of single-track segments 10$^{XII}$ via adhesives, mechanical fasteners and the like with binding strip 70 secured to two-sided retaining clips 28$^{XII}$. It should be understood that more than one binding strip 70 may be used to secure the plurality of single-track segments 10$^{XII}$ together. By joining the track segments via the binding clips, the track segments can be oriented with the smoothly curved sections of the tunnels positioned vertically below the binding clip sections as shown in FIG. 46. This configuration permits several marbles or spherical objects to be involved in a race.

Figure 49:
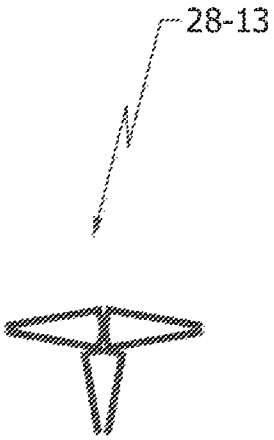
FIG. 49 is an end view of a modified three-segment retaining clip used to assemble the dual-track module shown in FIG. 48.
Figure 48:
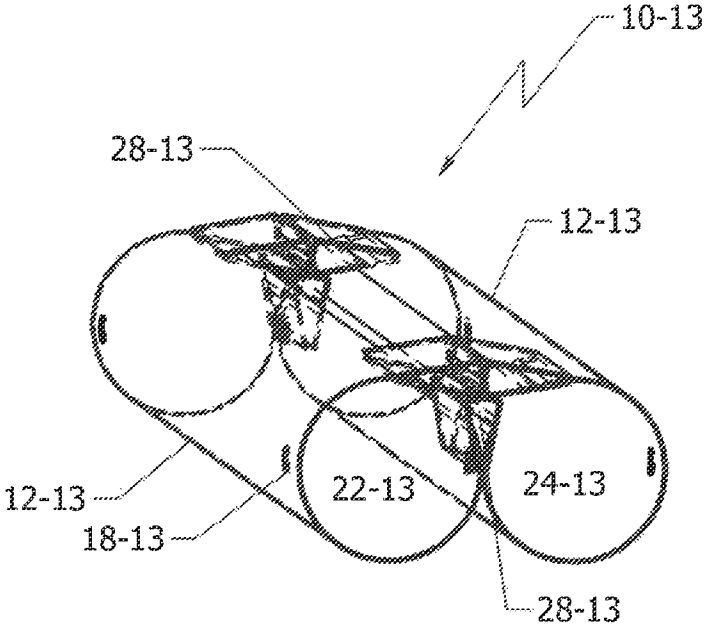
FIG. 48 is a top, end perspective view of a dual-track module assembled from the assembly sheet shown in FIG. 47.
Figure 47:
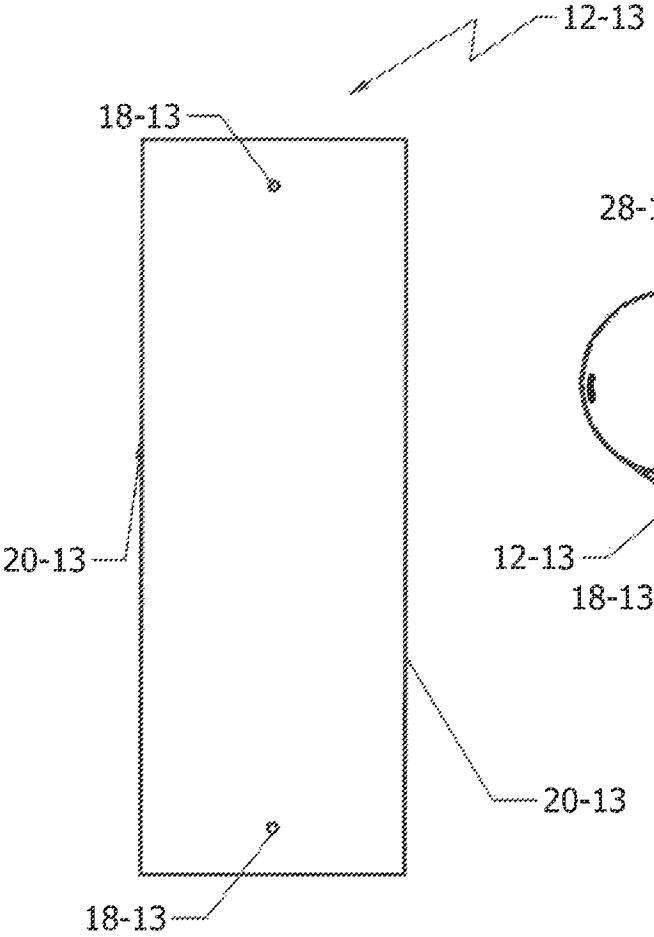
FIG. 47 is a top end perspective view of an assembly sheet for a dual-track module according to another embodiment of the disclosure.

Referring now to FIGS. 47-49, in a yet further embodiment of the straight tunnel segment, a straight double-track segment, designated generally as 10$^{XIII}$, includes features to construct a double-track segment or run with two sheets of material and a modified three-part retaining clip or binding bar $28^{XIII}$. As shown in FIG. 49, retaining clip $28^{XIII}$ is formed by fusing or affixing the spines of three retaining clips, two oriented at 180° from each other and the third oriented 90° from the other two. This formation creates three sets of tines as shown in FIG. 49.

To assemble straight double-track segment $10^{XIII}$, a first sheet $12^{XIII}$ is rolled until sides $20^{XIII}$ are aligned with two adjacent sets of tines where the tine set is oriented 90° apart. Each side of the first sheet is inserted into a dedicated single tine set to lock sheet $12^{XIII}$ in a tunnel formation. A second sheet $12^{XIII}$ is rolled until sides $20^{XIII}$ are aligned with two adjacent sets of tines, one unoccupied and one occupied by one of the sides of the first sheet. Each side of the second sheet $12^{XIII}$ is inserted into a dedicated single tine set to lock second sheet $12^{XIII}$ in a tunnel formation. Once the two sheets are properly secured in the three-part retaining clip $28^{XIII}$ each tine set 180° apart will be occupied or will retain only one side of one sheet $12^{XIII}$. The tine set oriented 90° from the other two sets will be occupied by two sheet sides, one from each sheet. The tunnels will be tear-shaped or circular in cross-section as shown in FIG. 48.

Figure 51:
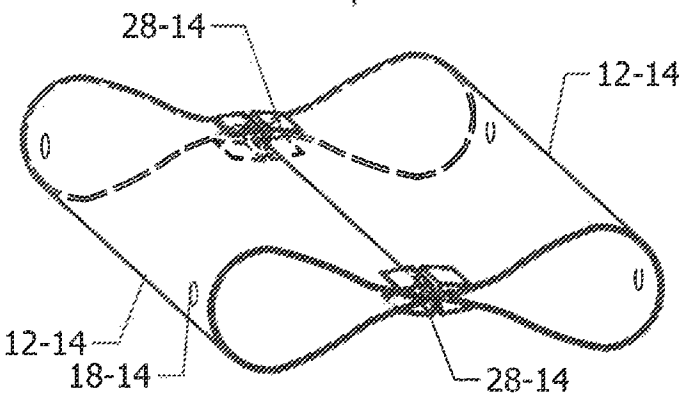
FIG. 51 is a top, end perspective view of a dual-track module assembled from the assembly sheet shown in FIG. 50.
Figure 50:
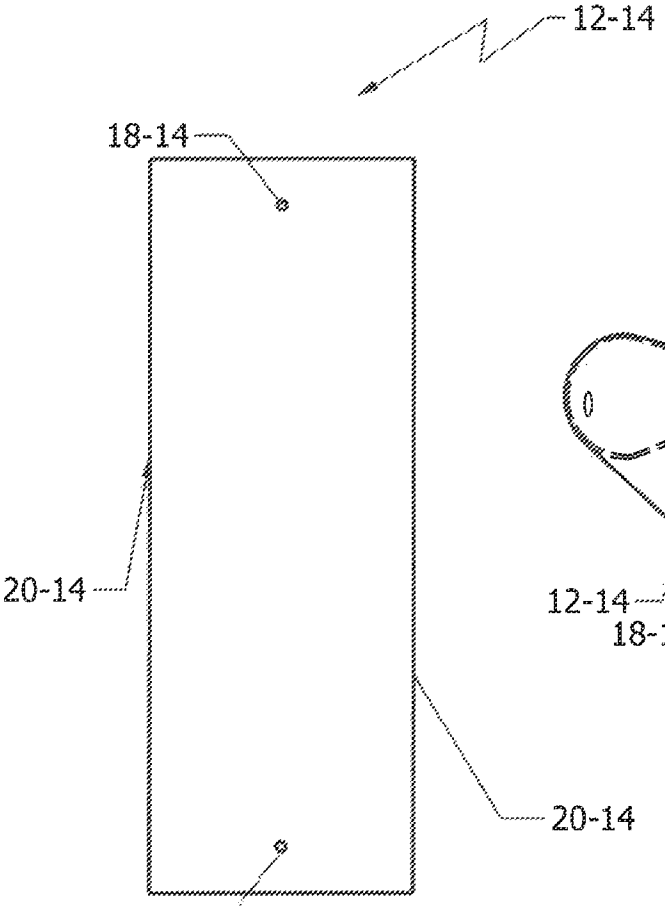
FIG. 50 is a top end perspective view of an assembly sheet for a dual-track module according to yet another embodiment of the disclosure.

Referring now to FIGS. 50-52, in a still further embodiment of the disclosure, a straight dual-track segment, designated generally as $10^{XIV}$, is formed from two sheets and a two-sided retaining clip $28^{XIV}$. As shown in FIG. 52, retaining clip $28^{XIV}$ is formed in similar fashion to retaining clip $10^{XI}$ by bonding or affixing two single retaining clips along their spines. The tine sets of each retaining clip are oriented 180° apart. To form the dual-track segment, sides $20^{XIV}$ of a first sheet $12^{XIV}$ are rolled until the opposing sides are in registration and aligned. The aligned sides are inserted into a dedicated first tine set to secure the sheet and form a first tear-shaped tunnel in cross section. To form the other tunnel, sides $20^{XIV}$ of a second sheet $12^{XIV}$ are rolled until the opposing sides are in registration and aligned. The aligned sides are inserted into the second tine set to secure the sheet and form a second tear-shaped tunnel in cross section. The track tunnels, left track tunnel $22^{XIV}$ and right track tunnel $24^{XIV}$ are uniform in relative dimensions and substantially parallel to provide equal tracks for marbles or other spherical objects to traverse.

Figures 53, 54, 55:
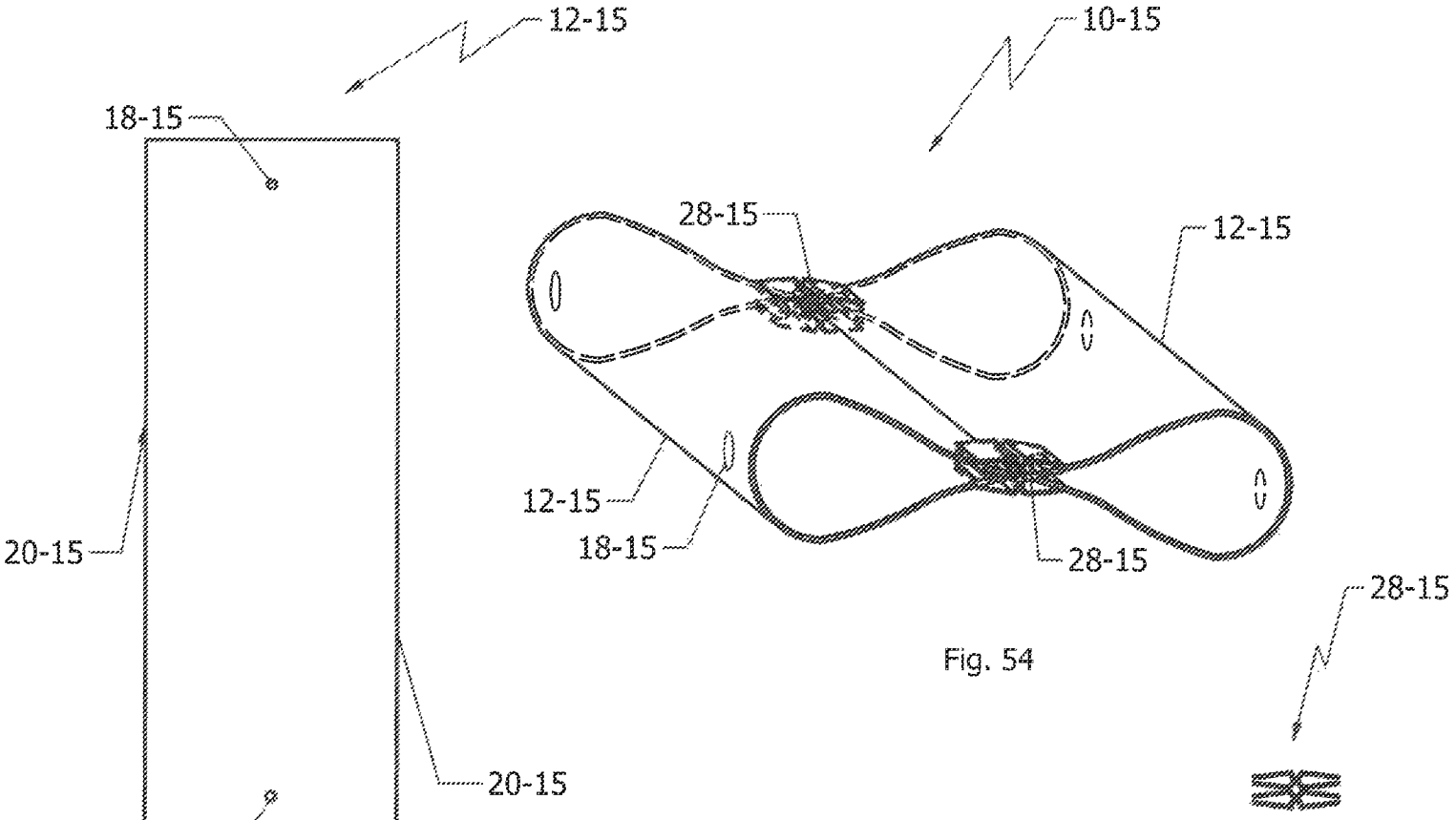
FIG. 53 is a top end perspective view of an assembly sheet for a dual-track module according to still another embodiment of the disclosure.
FIG. 54 is a top, end perspective view of a dual-track module assembled from the assembly sheet shown in FIG. 53.
FIG. 55 is an end view of a modified four-segment retaining clip used to assemble the dual-track module shown in FIG. 54.

Referring now to FIGS. 53-55, in another embodiment of the straight dual-track segment, a modified four-part retaining clip is used to assemble the dual-track segment. As shown in FIG. 54, a straight dual-track segment, designated generally as $10^{XV}$, uses two sheets $12^{XV}$ to form the dual-track segment. No tabs or slots are used for this embodiment and no modifications are made to the sheets. As shown in FIG. 55, a four-sided retaining clip or binding bar $28^{XV}$ incorporates four retaining clips with fixed spines so the tines of each retaining clip are arranged in two horizontally-oriented, parallel sets with each set comprised of two retainer clips with their spines affixed together. This orients the tines of the affixed retainer clips to be 180° apart. By joining the two sets together in parallel, the tine sets are oriented horizontally with two sets of tines facing left and the other two sets of tines facing right 180° opposite the left-facing set.

To assemble straight dual-track segment $10^{XV}$, sides $20^{V}$ of one of the sheets $12^{V}$ are rolled until the opposing sides are aligned horizontally with the tines of one set of the fixed binder clips. The opposing sides are inserted into the left-facing, horizontally-oriented tines, each side inserted into a dedicated tine set to secure each side separately and form the sheet into a track tunnel as shown in FIG. 54. The second sheet is rolled in similar fashion to the first sheet and the opposing sides are aligned horizontally with each side inserted separately into one of the right-facing tine sets to secure the second sheet and form a second track tunnel adjacent the first track tunnel. In this configuration, the adjacent track tunnels do not share a common wall, but have part of their inner walls formed by the four-part retaining clip $28^{XV}$.

Figure 58:
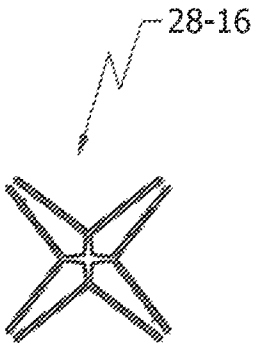
FIG. 58 is an end view of a modified four-segment retaining clip used to assemble the dual-track module shown in FIG. 57.
Figure 57:
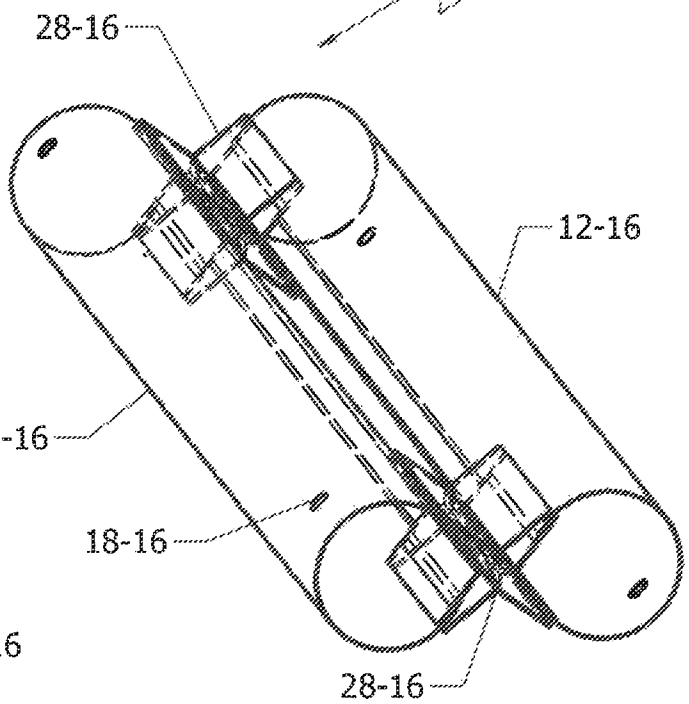
FIG. 57 is a top, end perspective view of a dual-track module assembled from the assembly sheet shown in FIG. 56.
Figure 56:
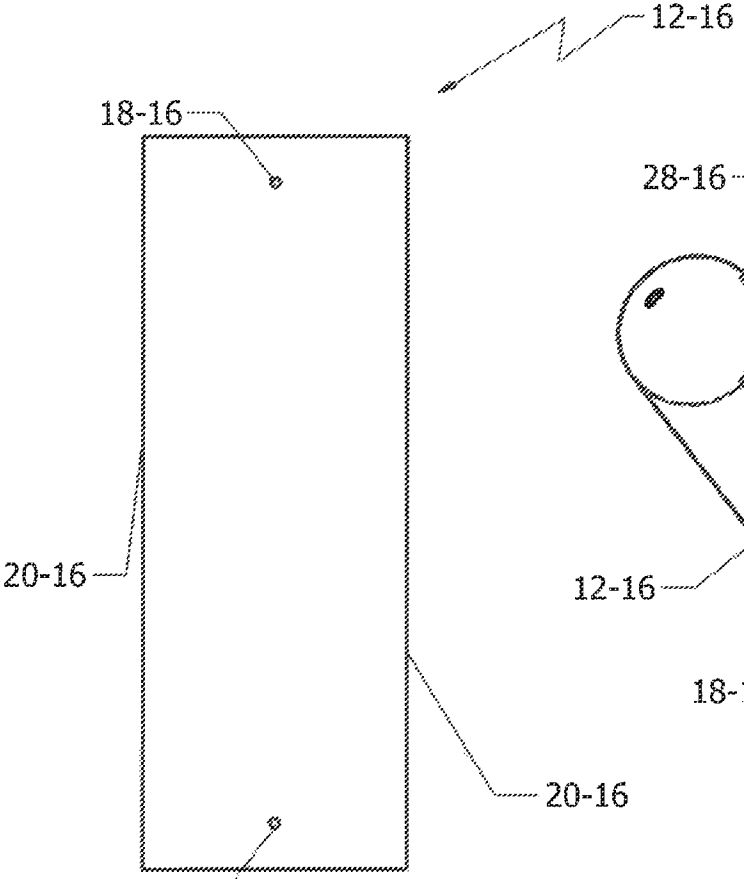
FIG. 56 is a top end perspective view of an assembly sheet for a dual-track module according to a further embodiment of the disclosure.

Referring now to FIGS. 56-58, in a yet further embodiment of the straight dual-track segment, a segment, designated generally as $10^{XVI}$, includes a modified four-part retaining clip used to assemble the dual-track segment. As shown in FIG. 57, segment $10^{XVI}$ uses two sheets $12^{XVI}$ to form the dual-track segment. No tabs or slots are used for this embodiment and no modifications are made to the sheets. As shown in FIG. 58, a four-sided retaining clip or binding bar $28^{XVI}$ incorporates four retaining clips with fixed spines in a butterfly pattern so the tines of each retaining clip are arranged with two horizontally-oriented, parallel sets with each set comprised of two retainer clips with their spines affixed together. A left-facing set has the two retaining clips oriented about 45° apart. One retaining clip is biased upwardly and a second retaining clip is biased downwardly. A right-facing set has two retaining clips oriented about 45° apart. One retaining clip of the right-facing set is biased upwardly and a second right-facing retaining clip is biased downwardly. This orients the tines of the two upwardly-biased retaining clips about 120° apart. The two downwardly-biased retaining clips also are spaced about 120° apart. The combination of retaining-clip spacing forms a butterfly pattern in cross-section.

To assemble straight dual-track segment $10^{XVI}$, sides $20^{XVI}$ of one of the sheets $12^{XVI}$ are rolled until the opposing sides are each aligned relatively horizontally with the tines of one set of the left-facing fixed binder clips. The opposing sides are inserted into the left-facing tine sets, each side inserted into a dedicated tine set to secure each side separately and form the sheet into a track tunnel as shown in FIG. 57. The second sheet is rolled in similar fashion to the first sheet and the opposing sides are aligned relatively horizontally with each side inserted separately into one of the right-facing tine sets to secure the second sheet and form a second track tunnel adjacent the first track tunnel. In this configuration, the adjacent track tunnels do not share a common wall, but have part of their inner walls formed by the four-part, butterfly-shaped retaining clip $28^{XVI}$.

Figure 61:
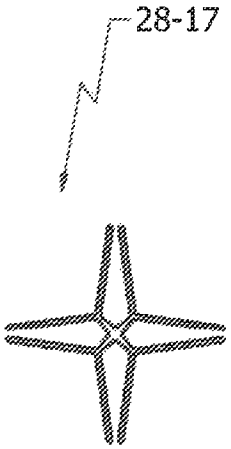
FIG. 61 is an end view of a modified four-segment retaining clip used to assemble the quad-track module shown in FIG. 60.
Figure 60:
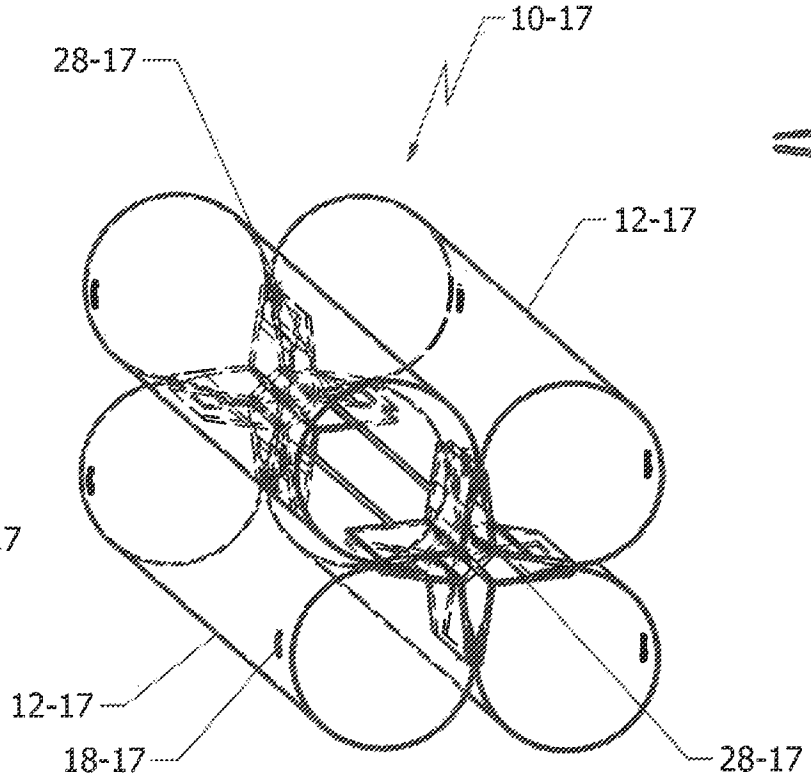
FIG. 60 is a top, end perspective view of a quad-track module assembled from the assembly sheet shown in FIG. 59.
Figure 59:
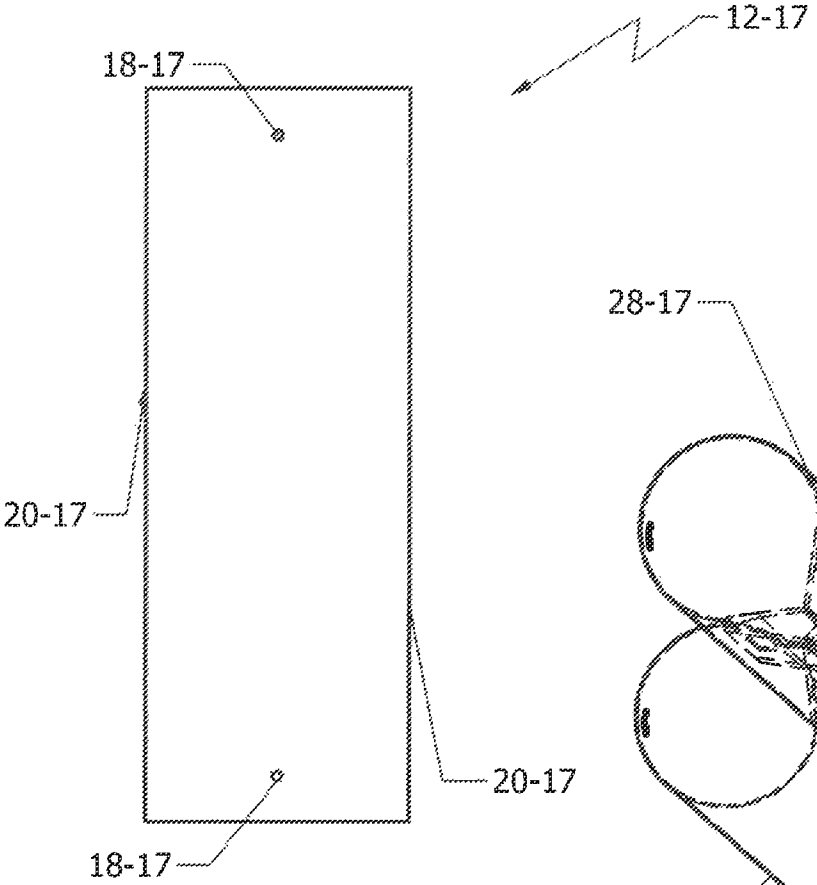
FIG. 59 is a top end perspective view of an assembly sheet for a quad-track module according to a yet further embodiment of the disclosure.

Referring now to FIGS. 59-61, in a yet further embodiment of disclosure, a straight quadra-track segment, designated generally as $10^{XVII}$, includes a modified four-part retaining clip used to assemble the quadra-track segment. As shown in FIG. 60, segment $10^{XVII}$ uses four sheets $12^{XVII}$ to form the quadra-track segment. No tabs or slots are used for this embodiment and no modifications are made to the sheets. As shown in FIG. 61, a four-sided retaining clip or binding bar $28^{XVII}$ incorporates four retaining clips with fixed spines in a cross pattern so the tines of each retaining clip are arranged with two horizontally-oriented—one left-facing and one right-facing—retaining clips and two vertically-oriented—one upwardly-facing and one downwardly-facing—retaining clips all affixed together via their spines. Each retaining clip is oriented to be spaced about 90° from its two adjacent retaining clips. This configuration orients the tines of the four retaining clips to be spaced 90° apart. The combination of retaining-clip spacing forms a cross pattern in cross-section.

To assemble straight dual-track segment $10^{XVII}$, sides $20^{XVII}$ of one of the sheets $12^{XVII}$ are rolled until the opposing sides are each aligned and in registration. The opposing sides are inserted together in registration or separately into the same first set of tines to secure the first sheet into a track tunnel formation. Sides 20$^{XVII}$ of a second 12$^{XVII}$ are rolled until the opposing sides are each aligned and in registration. The opposing sides are inserted together in registration or separately into the same second set of tines to secure the second sheet into a track tunnel formation. The same procedure is followed for a third sheet and a fourth sheet to form track tunnels. The third sheet is secured by a third tine set and the fourth sheet is secured by a fourth tine set as shown in FIG. 60. In this configuration, the adjacent track tunnels do not share a common wall, but have part of their inner walls formed by the four-part, cross-shaped retaining clip 2$^{XVII}$.

Figure 63:
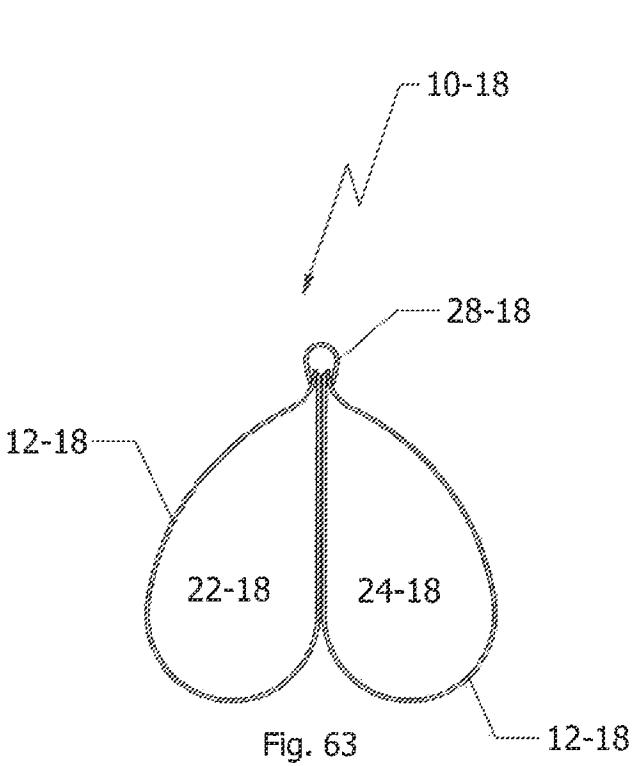
FIG. 63 is a top, end perspective view of a dual-track module assembled from the assembly sheet shown in FIG. 62.
Figure 62:
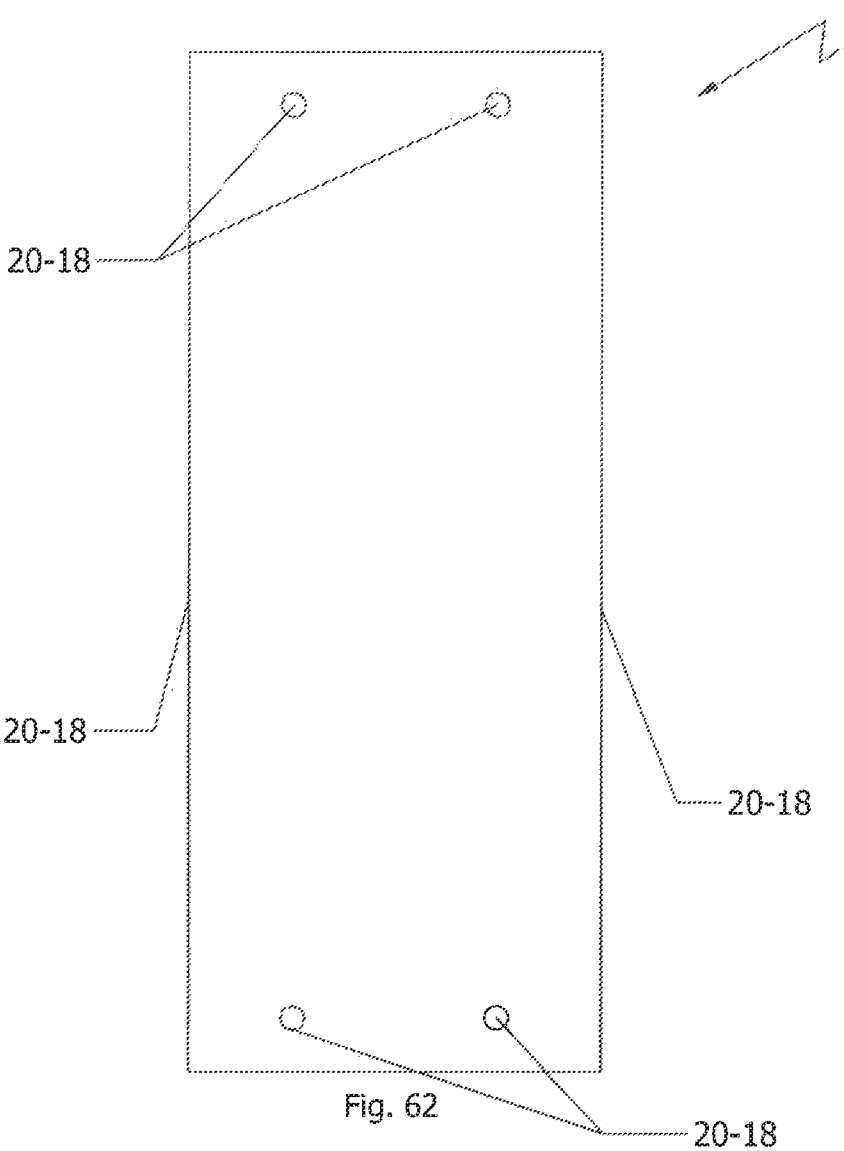
FIG. 62 is a top end perspective view of an assembly sheet for a dual-track module according to a still further embodiment of the disclosure.

Referring now to FIGS. 62 and 63, in a further embodiment of the straight dual-track segment, designated generally as 10$^{XVIII}$, two sheets and a single retaining clip are used to form the dual-track segment. In this embodiment, a first sheet 12$^{XVIII}$ has its two sides 20$^{XVIII}$ rolled toward a centerline 26$^{XVIII}$ until the sides are aligned and in registration. A longitudinal retaining clip or binding bar 28$^{XVIII}$ having a "C" shape in cross section as shown in FIG. 12 is used to receive and retain sheet sides 20$^{XVIII}$. Together or separately, the sides of first sheet 12$^{XVIII}$ are inserted into the tines of retaining clip 28$^{XVIII}$ to secure the sheet and form a first track tunnel. A second sheet 12$^{VIII}$ has its two sides 20$^{XVIII}$ rolled toward a centerline 26$^{XVIII}$ until the sides are aligned and in registration. Together or separately, the sides of second sheet 12$^{XVIII}$ are inserted into the tines of retaining clip 28$^{XVIII}$ to secure the sheet and form a second track tunnel. Both tunnels are tear-shaped in cross-section and substantially uniform in overall dimensions. In this configuration all four sides of the two sheets are retained by the single retaining clip 28$^{XVIII}$. It should be understood that retaining clip 28$^{XVIII}$ may extend the entire length of sheets 12$^{XVIII}$ or may extend only partially along the sheets' length. Moreover, a plurality of retaining clips 28$^{XVIII}$ may be used, each of which is shorter than the sheet length to create a chain of retention points as shown in FIG. 63.

Figure 102:
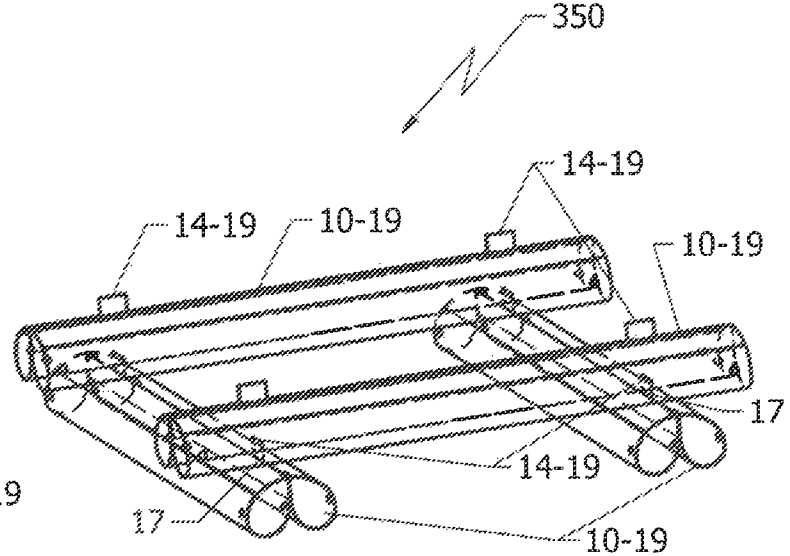
FIG. 102 is a top, end perspective view of an overlapping track subassembly using the straight, dual-track segment shown in FIG. 101.
Figure 101:
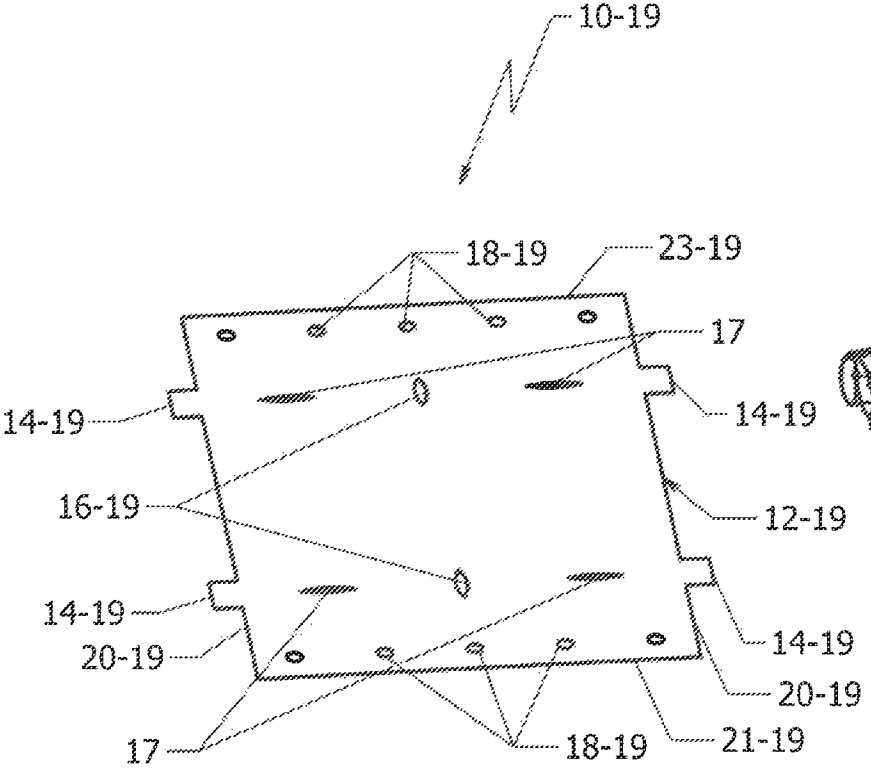
FIG. 101 is a top, end perspective view of a straight, dual-track segment according to a still further embodiment of the disclosure.

Referring now to FIGS. 101 and 102, in a yet further embodiment of the straight, dual-track segment, designated generally as 10$^{XIX}$, the track segment is formed from a single sheet of material, designated generally as 12$^{XIX}$, as shown in FIG. 101. Sheet 12$^{XIX}$ has substantially parallel sides 20$^{XIX}$ and parallel ends, leading end 21$^{XIX}$ and trailing end 23$^{XIX}$. A plurality of tabs 14$^{XIX}$ extend laterally from sheet 12$^{XIX}$ and occupy substantially the same plane as sheet 12$^{XIX}$. A plurality of corresponding slots 16$^{XIX}$ are formed at an approximate centerline 26$^{XIX}$ of sheet 12$^{XIX}$ and laterally aligned with tabs 14$^{XIX}$. Slots 16$^{XIX}$ are dimensioned to receive tabs 14$^{XIX}$ in a mechanical interlocking arrangement as disclosed in more detail herein. A set of perpendicular slots 17 are formed perpendicular to slots 16$^{XIX}$ and are spaced the same distance as slots 16$^{XIX}$. The addition of perpendicular slots 17 permits a unique assembly option as shown in FIG. 102 and as described in more detail hereinbelow.

Due to the manner in which the dual-track segment is assembled, the number of slots 16$^{XIX}$ is equal to the largest number of tabs 14$^{XIX}$ on either side of sheet 12$^{XIX}$. This ensures there is a slot for every tab. For dual-track segments such as dual-track segment 10$^{XIX}$, each slot 16$^{XIX}$ is dimensioned to receive two tabs 14$^{XIX}$, one from each side 20$^{XIX}$ of sheet 12$^{XIX}$. By aligning opposing tabs 14$^{XIX}$ and slots 16$^{XIX}$ along the same lateral axes, a uniform, symmetrical dual-track segment can be assembled from sheet 12$^{XIX}$. To assemble straight, dual-track segment 10$^{XIX}$ is assembled in the same manner as described and shown for straight, dual-track segment 10.

Referring now to FIG. 102, with the addition of perpendicular slots 17, straight dual-track segments 10$^{XIX}$ can be assembled in perpendicular overlapping rows in a manner such as is done with well-known Lincoln Logs®. To achieve this assembly arrangement, the perpendicular slots 17 of two dual-track segments 10$^{XIX}$ are aligned with the protruding tabs 14$^{XIX}$ of two underlying dual-track segments 10$^{XIX}$ spaced apart the same distance as the spacing between the tabs and/or slots as shown in FIG. 102. This pattern of assembly is repeated for each successive row until the desired height of the assembly is achieved. Structures also can be constructed with dual-track segments 10$^{XIX}$ beneath, which will support marble racing tracks.

II. Track Segment Connectors

Figure 67:
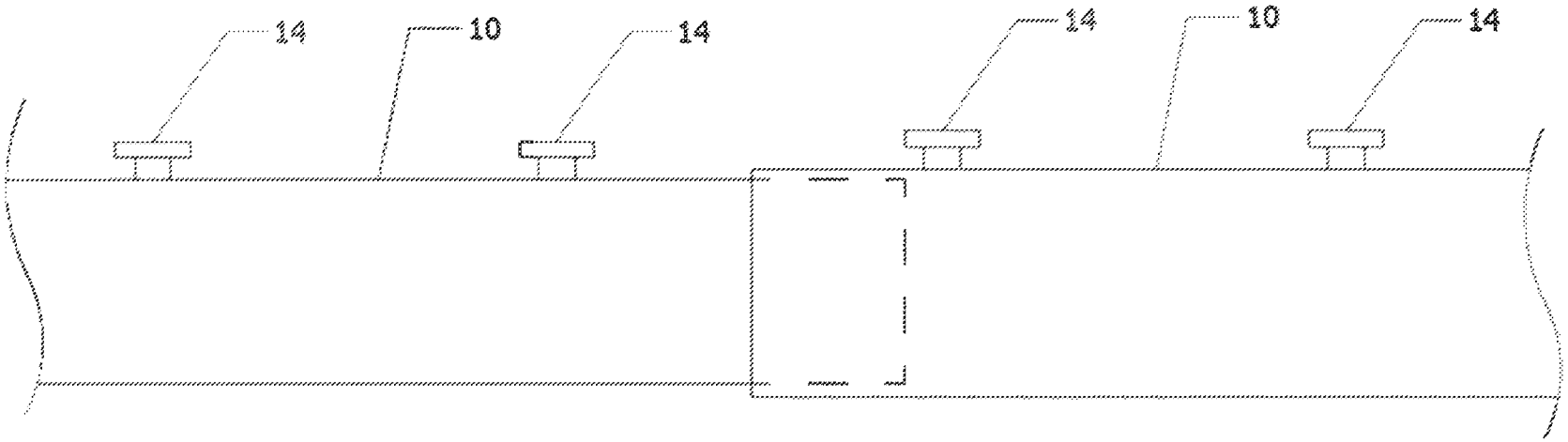
FIG. 67 is a side view in elevation and partial phantom of two single-tunnel track modules with modified T-tabs according to yet another embodiment of the disclosure.

Referring now to FIG. 67, in another aspect of the disclosure, a track-segment-joining means is shown in which two single-track segments 10 are joined together by inserting an end of one segment 10 into an end of a second segment 10. This joinder method is possible due to the pliability of the sheet material used and the partial slippage or translation of the inner wall and tabs of the segment down from the slots towards the bottom surface of the segment. This movement of the sheet side increases the diameter of the formed tunnels. The inserted track segment end flexes inwardly to reduce its overall cross-sectional diameter and permits its insertion into the unmodified end of the second single-track segment 10. The sheet material is sufficiently lubricious to permit the insertion. Once the axial pressure is released, the portion of the first track segment in the second track segment expands to create a frictional fit between the joined track segments.

As should be understood, this joinder method is applicable to any of the dual-track segments and specialty segments disclosed herein that have an inner double wall and which include a center tab/slot configuration or include a central binding bar configuration or include a central binding bar configuration with the absence of the binding bar. For track segments formed with binding bars, the amount of insertion of a sheet's sides into the tines of the binding bars can be varied to vary the overall diameter of the tunnels formed. For smaller diameter tunnels, the sheet sides are inserted into the binding bars until they register against the binding bar spines. For larger diameter tunnels, the sides can be backed off the spines but retained between the tines to create the larger diameter tunnels.

Figure 69:
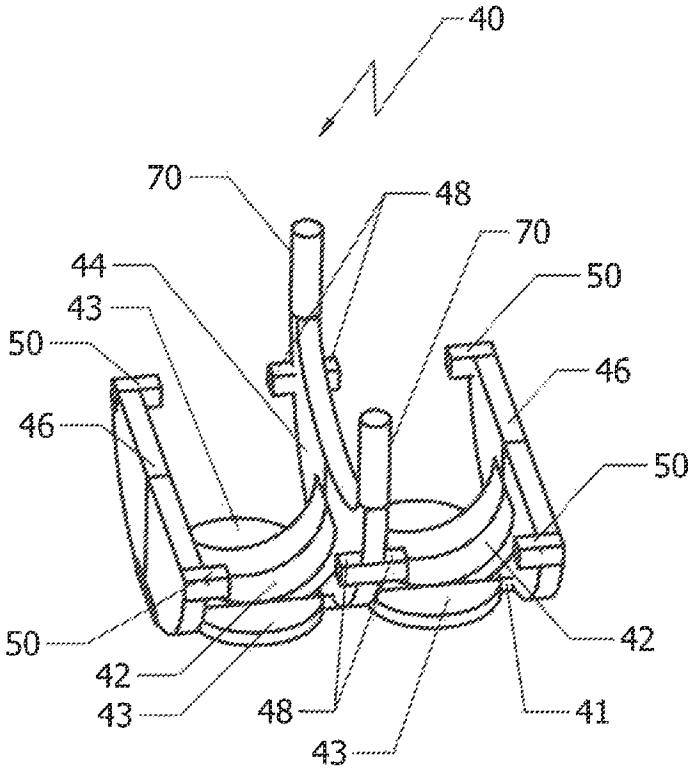
FIG. 69 is a top, end perspective view of the straight dual-track connector shown in FIG. 68.
Figure 68:
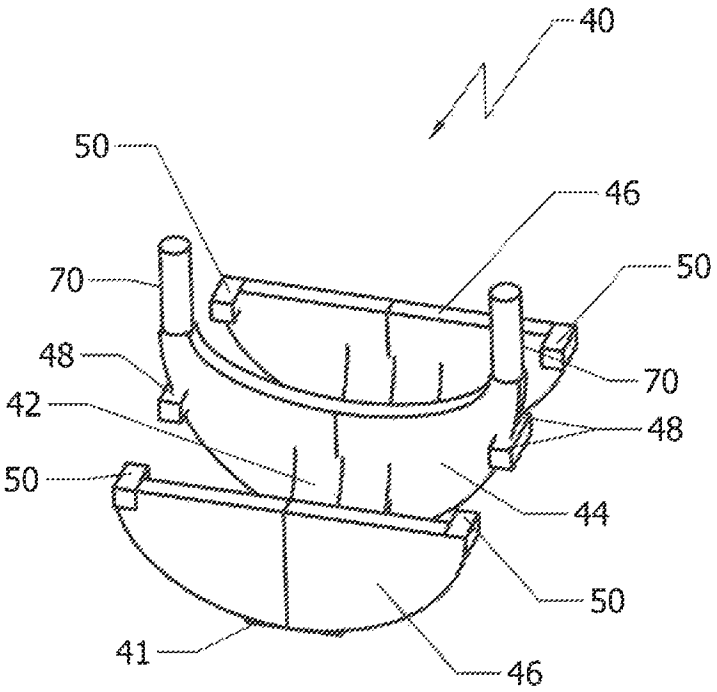
FIG. 68 is a top side perspective view of a straight dual-track connector according to one embodiment of the disclosure.

Referring now to FIGS. 68 and 69, in a further aspect of the disclosure, a straight dual-track connector, designated generally as 40, includes a series of features to affix dual-track segments in a serial configuration to form a track. Connector 40 includes two semi-circular or rounded base sections 42 that conform to the shape of the dual-track segment tunnels to provide a smooth transition between joined track segments. Each base section 42 has a track-receiving tab 43 extending axially from each end and coplanar with the antapex or lowest section of the rounded base sections. Track-receiving tabs 43 provide structural support for the bottom ends of dual-track segments secured to connector 40. Base sections 42 provide structural support for the ends of the segments inserted into the base as the bottom of the track segment ends register against base 42. It should be understood that the cross-sectional shape of base 42 may be semi-circular, parabolic or any other shape having smooth-transitional surfaces.

Connector 40 further includes a center support wall 44 extending vertically from the junction of base sections 42. Two connection segment side walls 46 extend vertically from opposite lateral edges of base sections 42 and are substantially parallel with center support wall 44. Side walls 46 rigidify the ends of attached dual-track segments in combination with base sections 42. As shown, center support wall 44 is higher than side walls 46. It should be understood that the heights of the walls can be equal or offset with the center wall or one or both of the side walls set at different relative heights.

Extending upwardly from support wall 44 is a track support post 70. Post 70 is shown to have a cylindrical shape. It should be understood that the shape of the post can conform to any regular or irregular geometric shape and remain within the scope of the disclosure.

To lock dual-track segments to connector 40, a series of locking tabs positioned on center support wall 44 and side walls 46 releasably secure the dual-track segments to the connector. Two pairs of center support wall locking tabs 48 extend inwardly toward each track tunnel from the support wall 44. The tabs may or may not occupy the same plane with each tab pair extending from opposite sides of support wall 44 with each pair positioned at opposite ends of the support wall.

Extending inwardly from each top end of each side wall 46 is a side wall locking tab 50. Each side wall locking tab 50 faces one of the support wall-locking tabs 48. This orientation of the locking tabs is set to correspond to the location of through-bores 18. To secure dual-track segments to connector 40, an end of a first dual-track segment is urged onto a first end of base sections 42 by placing the corresponding through-bore 18 over the track support post 70. At the same time, the sides of the dual-track segment are pinched inwardly to allow the leading edge of the track segment to pass over locking tabs 48 and 50. Once the locking tabs are aligned with the corresponding through-bores 18, the pinching pressure is released to allow the dual-track segment side walls expand. This results in the locking tabs entering into through-bores 18 to lock the dual-track segment to connector 40. By positioning locking tabs 48 and 50 opposite one another, the dual-track segment and connector 40 are locked into a three-dimensional orientation. A second dual-track segment is secured to a second end of connector 40 by using the same procedure used to secure the first dual-track segment to connector 40.

The locking of the dual-track segment to connector 40 does not require all of the five connections described above (post 70, locking tabs 48, and the two locking tabs 50). The post may be removed and/or some or all of the locking tabs may be removed. One illustrative combination is to remove the two locking tabs 48 and utilize only post 70 and two locking tabs 50, to provide a three-point stable connection to three separate through-bores. This illustrative locking configuration as well as other segment/connector locking combinations apply to all of the locking configurations for locking together track segments and other elements, e.g., curve connectors, switch connectors, etc., disclosed herein.

Figure 71:
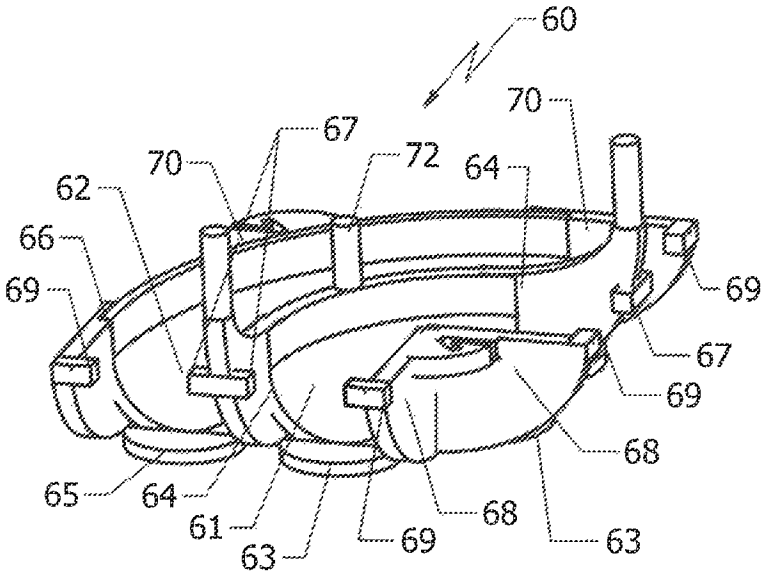
FIG. 71 is a top side perspective view of the turn connector shown in FIG. 70.
Figure 70:
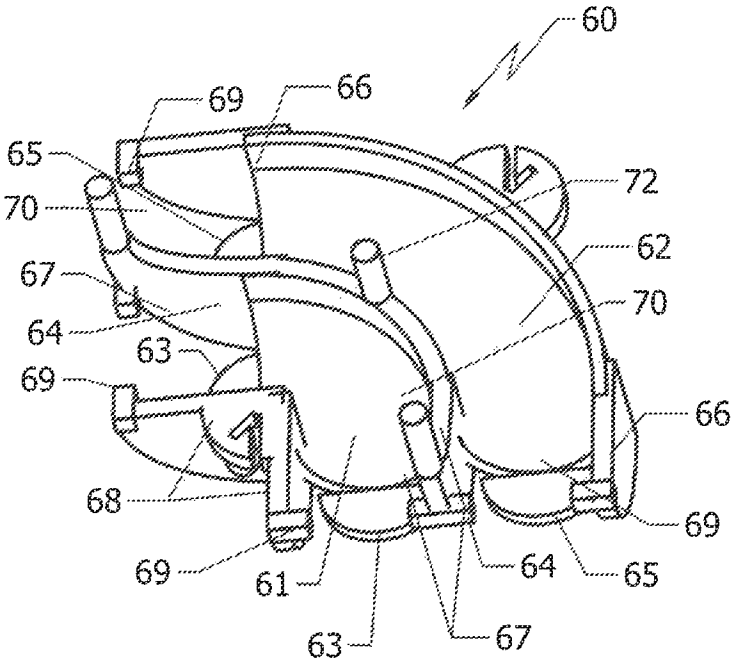
FIG. 70 is a top, end perspective view of a 90° curve or turn connector according to another embodiment of the disclosure.

Referring now to FIGS. 70 and 71, in another aspect of the disclosure, a curve connector, shown generally as 60, provides a means to change the direction of a race track between two dual-track segments. As shown, curve connector 60 is formed with an approximately 90° angle. It should be understood that connector 60 may be formed with any angle between 0° and 180°. Curve connector 60 has two radiused or rounded base sections with unequal lengths. A first inner base section 61 is shorter than a second outer base section 62. The unequal lengths of the base sections are required to maintain planar alignment of the leading and trailing edges of the base sections to receive trailing or leading ends of dual-track segments.

First inner base section 61 has a track-receiving tab 63 extending axially from each end and coplanar with the antapex or lowest point of the rounded base section. Second outer base section 62 has a track-receiving tab 65 extending axially from each end and coplanar with the antapex or lowest point of the rounded base section. Like tabs 43, track-receiving tabs 63 and 65 provide structural support for the bottom ends of dual-track segments secured to curved connector 60. A discontinuous, center support wall 64 extends upwardly from each end of the base, between base sections 61 and 62. Each discontinuous end of center support wall 64 is formed with laterally extending center wall locking tabs 67 dimensioned to be inserted into any variation of through-bores 18 to secure the inner walls defining each track tunnel.

Extending upwardly from each end of support wall 64 is a track support post 70. Post 70 is shown as having a cylindrical shape. It should be understood that the shape of the post can conform to any regular or irregular geometric shape and remain with the scope of the disclosure. Post 70 is dimensioned to fit within a corresponding through-bore 18 to further secure a track section to the connector. A track connection post 72 extends upwardly from center support wall 64 and is formed at the approximate center of the support wall. Connection post 72 provides a structural means to further secure track sections to curve connector 60 via elastomeric retaining members, locking bars (disclosed in more detail herein), and the like.

Extending upwardly from the lateral edges of base sections 61 and 62 are discontinuous, connection sidewalls 68 and 66, respectively. Extending laterally inwardly from the sidewalls are sidewall locking tabs 69. Locking tabs 69 perform the same function as center wall locking tabs 67. Each sidewall locking tab engages a dedicated through-bore 18 (and any variant) to secure a track tunnel to curve connector 60. Locking tabs 69 may be positioned on a different plane than the plane occupied by center wall locking tabs 67 in order to better secure the radial orientation of a dual-track segment relative to curve connector 60.

Figure 104:
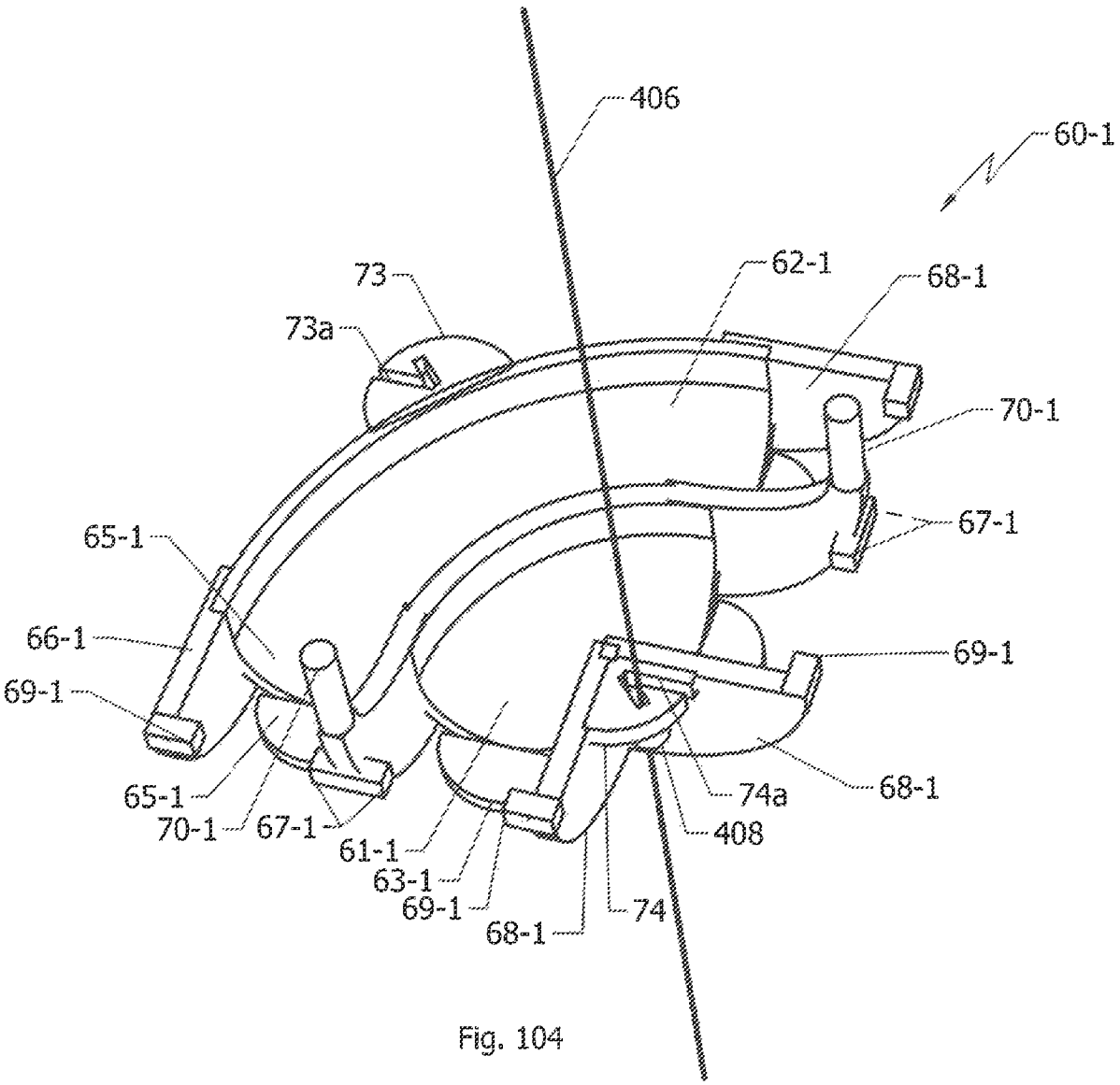
FIG. 104 is a top, end perspective view of dual-track turn-connector suspension elevation supports according to another embodiment of the disclosure.

Referring now to FIG. 104, in another aspect of the disclosure, curve connector 60 is modified to permit the connector to be suspended from a vertical surface. Suspended curve connector, designated generally as 60', is formed with an approximately 90° angle. It should be understood that connector 60' may be formed with any angle between 0° and 180°. Curve connector 60' has two radiused or rounded base sections with unequal lengths. A first inner base section 61' is shorter than a second outer base section 62'. The unequal lengths of the base sections are required to maintain planar alignment of the leading and trailing edges of the base sections to receive trailing or leading ends of dual-track segments.

First inner base section 61' has a track-receiving tab 63' extending axially from each end and coplanar with the antapex or lowest point of the rounded base section. Second outer base section 62' has a track-receiving tab 65' extending axially from each end and coplanar with the antapex or lowest point of the rounded base section. Like tabs 43, track-receiving tabs 63' and 65' provide structural support for the bottom ends of dual-track segments secured to suspended curved connector 60'. A center support wall 64' extends upwardly from each end of the base, between base sections 61' and 62'. Each end of center support wall 64' is formed with laterally extending center wall locking tabs 67' dimensioned to be inserted into any variation of through-bores 18 to secure the inner walls defining each track tunnel.

Extending upwardly from each end of support wall 64' is a track support post 70'. Post 70' is shown as having a cylindrical shape. It should be understood that the shape of the post can conform to any regular or irregular geometric shape and remain with the scope of the disclosure. Post 70' is dimensioned to fit within a corresponding through-bore 18 to further secure a track section to the connector.

Extending upwardly from the lateral edges of base sections 61' and 62' are connection sidewalls 68' and 66', respectively. Extending laterally inwardly from the top ends of the sidewalls are sidewall locking tabs 69'. Locking tabs 69' perform the same function as center wall locking tabs 67'. Each sidewall locking tab engages a dedicated through-bore 18 (and any variant) to secure a track tunnel to suspended curve connector 60'. Locking tabs 69' may be positioned on a different plane than the plane occupied by center wall locking tabs 67' in order to better secure the radial orientation of a dual-track segment relative to suspended curve connector 60'.

To enable suspended curve connector 60' to be suspended from a higher surface, an outer curve connector ring 73 is formed extending radially outwardly from the approximate apex of the curve at or near the top edge of exterior curved sidewall of suspended curve connector 60'. An inner curve connector ring 74 is formed in the angular junction of connection sidewalls 68' at or near the top edge of the sidewalls. Curve connector rings 73 and 74 may be slotted with vertically oriented slots, 73*a* and 74*a*, respectively, to receive a suspension elevation support 406. Suspension elevation support 406 may be a string, rope, chain or any similar product that can be used to vertically suspend track from a higher surface, such as a ceiling. Suspension elevation supports may be made from metal, natural fibers, such as hemp, or any synthetic material such as polypropylene. Returning to the description of the suspended curve connector, if the curve connectors are formed without a slot, a suspension elevation support 406 is inserted into each connector ring. A track-position setting ball 408, structured essentially as a sphere with an elevation-support-receiving through-bore, is used to set the height of the curve connector 60'. Setting ball 408 is moved along the suspension elevation support to the desired height on the elevation support and registered against curve connector rings 73 and 74 to set the height of suspended curve connector 60'.

Figure 73:
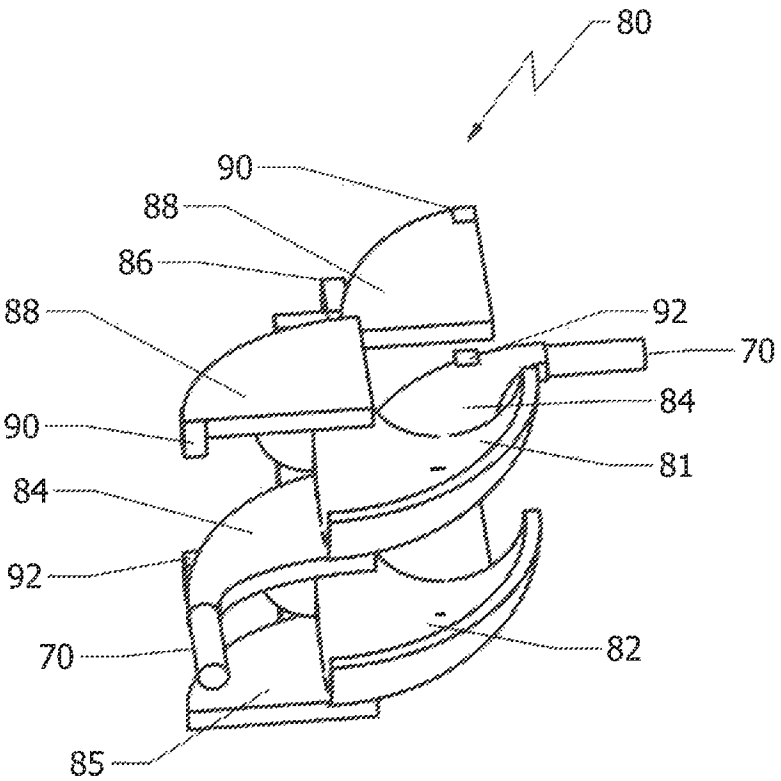
FIG. 73 is a top, side perspective view of the vertical 90° curve or turn connector shown in FIG. 72.
Figure 72:
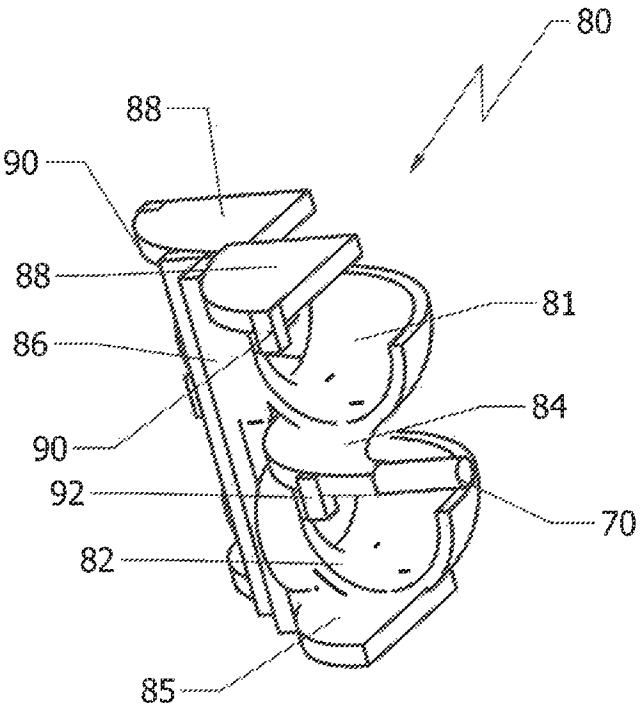
FIG. 72 is a top end perspective view of a vertical 90° curve or turn connector according to yet another embodiment of the disclosure.

Referring now to FIGS. 72 and 73, in a further aspect of the disclosure, a vertical curve connector, designated generally as 80, incorporates stacked rather than tandem tunnel connections to accommodate vertically-oriented dual-track sections. As shown, curve connector 80 is formed with an approximately 90° angle. It should be understood that connector 80 may be formed with any angle between 0° and 180°. Curve connector 80 has two vertically-stacked, radiused or rounded base sections with substantially identical lengths. A first top base section 81 and a bottom base section 82 have equal lengths to maintain a vertically planar alignment of the leading and trailing edges of the base sections to receive trailing or leading ends of vertically-oriented, dual-track segments, including illustratively, twist track sections disclosed herein.

First top base section 81 and second bottom base section 82 have track-receiving tabs 84 and 85, respectively, extending axially from each of their ends, each coplanar with the antapex or lowest point of the rounded base sections. Like tabs 43, track-receiving tabs 84 and 85 provide structural support for the bottom ends of vertically-oriented, dual-track segments secured to curved connector 80. A vertically-oriented support beam 86 secures the base sections in vertical alignment and provides a structural frame to orient the base sections. Beam 86 has two substantially identical sections joined in an orthogonal orientation to support and set the 90° angle of the turn. The turn angle can be altered by altering the angular orientation of the beam sections. An acute angle will provide for a tighter turn while an obtuse angle will provide for a longer turn/curve.

To support the shared inner wall of a vertically-aligned dual-track segment or section (functionally a base support for the upper or first base section and a ceiling for the lower base section), discontinuous, center support wall segments 84 each extend laterally from support beam 86 and axially from each end of each base section, between base sections 81 and 82. Each center support wall segments 84 is formed with downward-extending center support wall locking tabs 92 dimensioned to be inserted into any variation of through-bores 18 to secure the inner walls defining each vertically-oriented, track tunnel. To ensure smooth transitions between the vertical track segments and curve connector 80, center support wall segments 84 are offset in thickness so as to be below the antapex or lowest point of the base sections to accommodate the thickness of the track segments so the inner surfaces of the track segments are planar with the lowest point of base sections 81 and 82. Extending outwardly from center support wall segment 84 is post 70. Post 70 is dimensioned to fit within a corresponding through-bore 18 to further secure a track section to the connector.

Extending laterally from the ends of support beam 86 and axially from each end (leading and trailing ends) of each base section are triangular-shaped sidewall extensions, lower sidewall extensions 85 and upper sidewall extensions 88. Upper sidewall extension 88 are anchored to support beam 86 at one of its vertices, truncated to increase the thickness of the connection between the sidewall extension and the support beam. Lower sidewall extensions 85 are connected to the lower end of support beam 86 in the same manner as upper extensions 88. Lower extensions 85 are each further connected to one of the leading and trailing edges of base section 82 along one of their sides. To ensure smooth transitions between the vertical track segments and base section 82, lower sidewall extensions 85 are offset in thickness so as to be below the antapex or lowest point of base section 82 to accommodate the thickness of the track segments so the inner surfaces of the track segments are planar with the lowest point of base section 82.

Extending axially downwardly from distal ends of upper sidewall extensions 88 are upper sidewall locking tabs 90. Locking tabs 90 perform the same function as center support wall locking tabs 92. Each sidewall locking tab engages a dedicated through-bore 18 (and any variant) to secure a track tunnel to vertical curve connector 80. Locking tabs 90 and 92 are shown as being in vertical alignment. The locking tabs may be positioned on different axial planes in order to better secure the radial orientation of a vertical dual-track segment relative to vertical curve connector 80.

Figure 75:
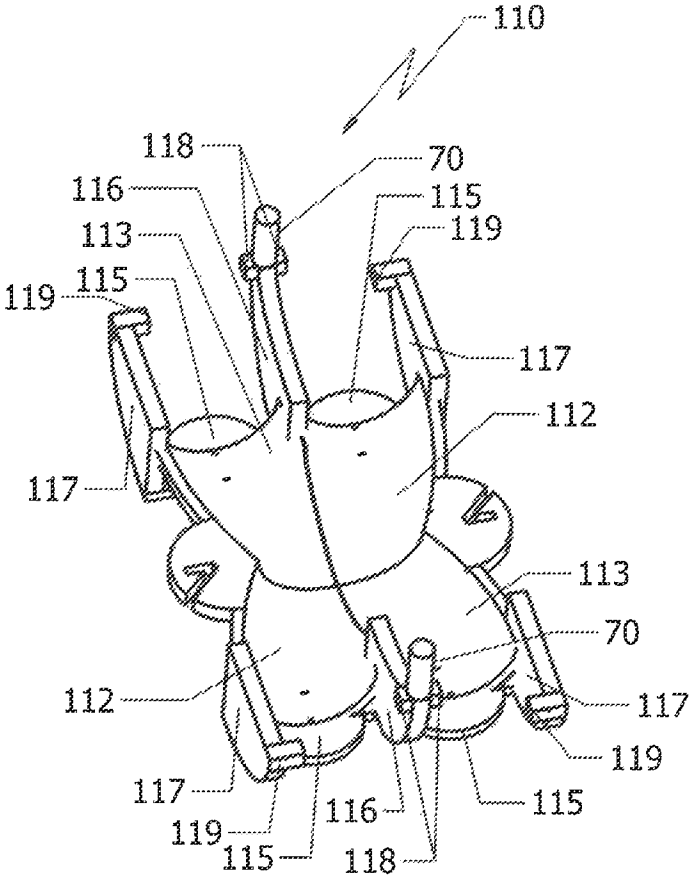
FIG. 75 is a top end perspective view of the straight lane-switch connector shown in FIG. 74.
Figure 74:
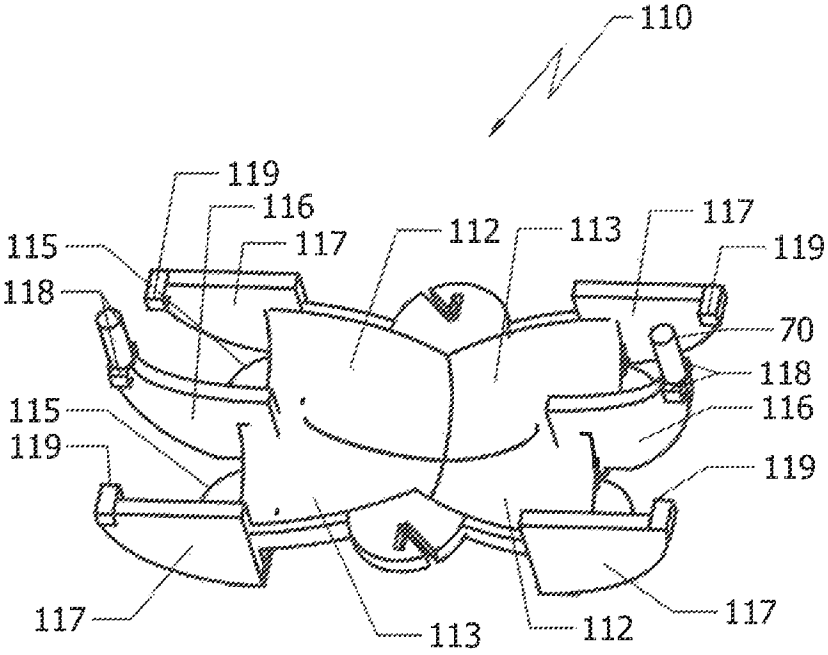
FIG. 74 is a top side perspective view of a straight lane-switch connector according to a further embodiment of the disclosure.

Referring now to FIGS. 74 and 75, in a yet further aspect of the disclosure, a straight switch connector, shown designated generally as 110, provides a connection means to change or cross over lanes to equalize any advantages provided by a particular lane. Switch connector 110 includes a first lane change base section 112 and a second lane change base section 113, each of which has counter-curving, opposed-radiused sections to first redirect a spherical object toward the opposite lane and then receive and transition the spherical object in the opposite lane.

Each base section, 112 and 113, has a track-receiving tab 115 extending axially from each end and coplanar with the antapex or lowest section of the rounded base sections. Track-receiving tabs 115 provide structural support for the bottom ends of dual-track segments secured to switch connector 110. Like the base section of straight connector 40, it should be understood that the cross-sectional shape of base sections 112 and 113 may be semi-circular, parabolic or any other shape having smooth-transitional surfaces.

Switch connector 110 further includes a discontinuous switch connector center support wall 116 extending vertically from the junction of the lane-change base sections at each end of the connector. Two switch connector side walls 117 extend vertically from opposite lateral edges of lane-change base sections 112 and 113 and are substantially parallel with center support wall 116. Side walls 117 rigidify the ends of attached dual-track segments in combination with the lane-change base sections. Extending upwardly from each center support wall 116 is a track support post 70. Post 70 is shown having a cylindrical shape. It should be understood that the shape of the post can conform to any regular or irregular geometric shape and remain with the scope of the disclosure. Post 70 is dimensioned to fit within a corresponding though-bore 18, to further secure a track section to the connector.

To lock dual-track segments to switch connector 110, a series of locking tabs positioned on center support wall 116 and side walls 117 releasably secure the dual-track segments to the switch connector. Two pairs of center support wall locking tabs 118 each extends inwardly toward one of the track tunnels from the top ends of center support wall 116. The tabs may occupy the same plane with each tab pair extending from opposite sides of center support wall 116 and each pair positioned at opposite ends of the center support wall.

Extending inwardly from each top end of each side wall 117 is a side wall locking tab 119. Each side wall locking tab 119 faces one of the support wall locking tabs 118. This orientation of the locking tabs is set to correspond to the location of through-bores 18 and any variations of the through-bores. To secure dual-track segments to switch connector 110, dual track segment 12 is placed over the track support post 70, engaging with the corresponding through-bore 18, and an end of a first dual-track segment is urged onto a first end of lane-change base sections 112 and 113. At the same time, the sides of the dual-track segment are pinched inwardly to allow the leading edge of the track segment to pass over locking tabs 118 and 119. Once the locking tabs are aligned with the corresponding through-bores 18, the pinching pressure is released to allow the dual-track segment side walls expand. This results in the locking tabs entering into through-bores 18 to lock the dual-track segment to switch connector 110. By positioning locking tabs 118 and 119 opposite one another, the dual-track segment and switch connector 110 are locked into a three-dimensional orientation. A second dual-track segment is secured to a second end of switch connector 110 by using the same procedure used to secure the first dual-track segment to the switch connector.

Figure 77:
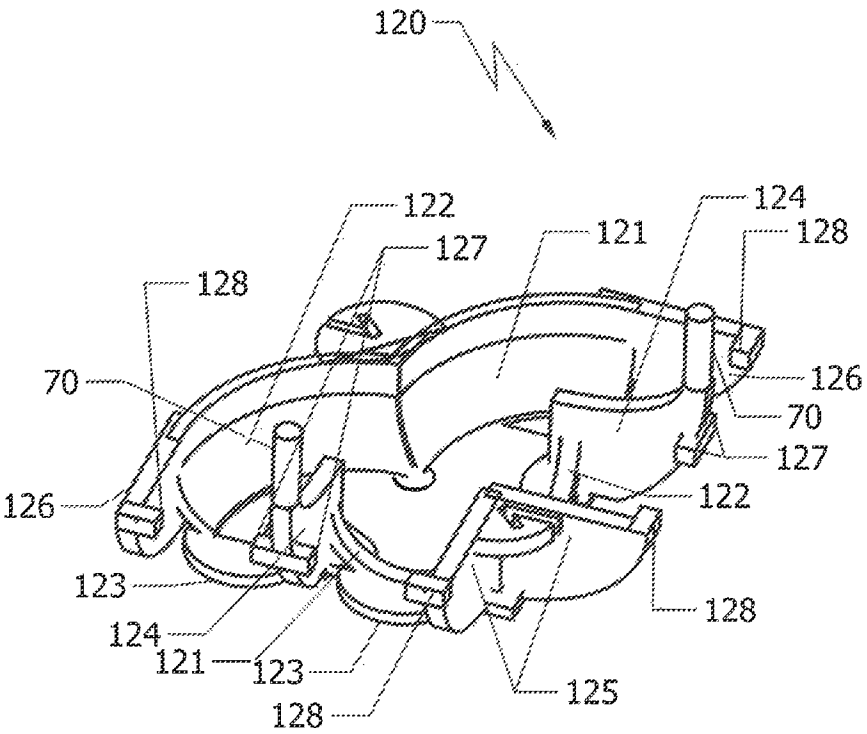
FIG. 77 is a top, side perspective view of the 90° lane-switch turn connector shown in FIG. 76.
Figure 76:
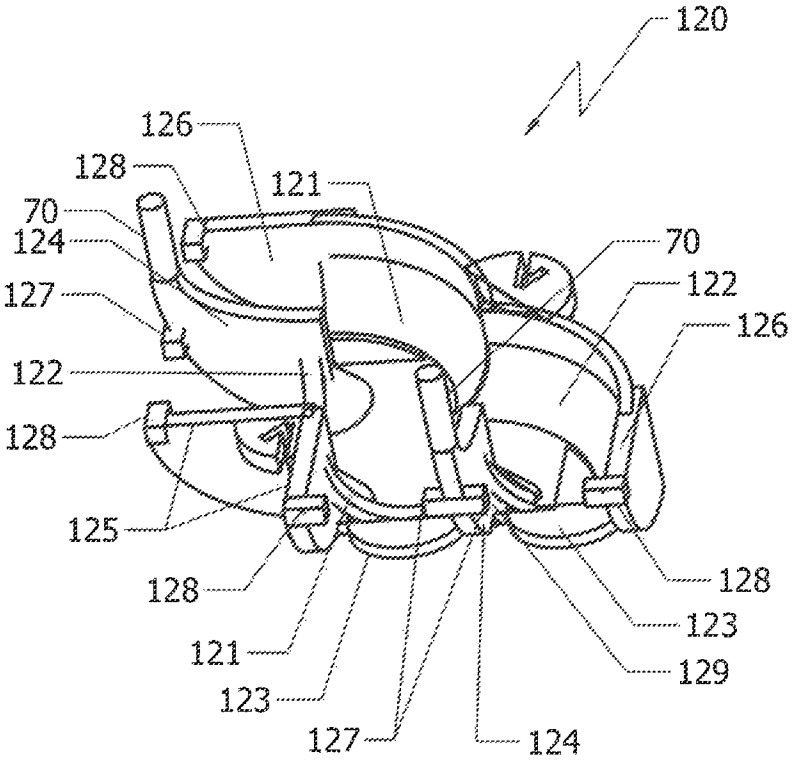
FIG. 76 is a top end perspective view of a 90° lane-switch turn connector according to a yet further embodiment of the disclosure.

Referring now to FIGS. 76 and 77, in a yet another aspect of the disclosure, a 90° curve switch connector, designated generally as 120, provides a connection means to change or cross over lanes while turning from one dual-track segment to another. Curve switch connector 120 includes a first lane-change curve base section 121 and a second lane-change curve base section 122, each of which has a first curve section to redirect a spherical object toward the opposite lane and a different direction and then a second straight section to receive and transition the spherical object in the opposite lane and the new direction. It should be understood that the angle of turn can be any angle greater than 0° and less than 180°.

Each curve base section, 121 and 122, has track-receiving tabs 123 extending axially from each end and coplanar with the antapex or lowest section of the rounded base sections. Track-receiving tabs 123 provide structural support for the bottom ends of dual-track segments secured to curve switch connector 120. Like the base section of straight connector 40, it should be understood that the cross-sectional shape of curve base sections 121 and 122 may be semi-circular, parabolic or any other shape having smooth-transitional surfaces.

Curve switch connector 120 further includes a discontinuous curve switch center support wall 124 extending vertically from the junction of the lane-change base sections at each end of the connector. Two curve switch connector sidewalls, inner curve switch sidewall 125 and outer curve switch sidewall 126 extend vertically from opposite lateral edges of lane-change curve base sections 121 and 122 and are substantially parallel with center support wall 124. Inner curve switch side wall 125 is continuous and formed with substantially identical sections that form an angle equivalent to the angle of the turn defined by curve switch connector 120. Outer curve switch sidewall 126 is discontinuous and comprises to sections, each of which is positioned at a lateral end of curve switch connector 120. The curve switch side walls rigidify the ends of attached dual-track segments in combination with the curve lane-change base sections.

Extending upwardly from center support wall 124 is a track support post 70. Post 70 is shown having a cylindrical shape. It should be understood that the shape of the post can conform to any regular or irregular geometric shape and remain with the scope of the disclosure. Post 70 is dimensioned to fit within a corresponding though-bore 18 to further secure a track section to the connector.

To lock dual-track segments to switch connector 120, a series of locking tabs positioned on curve switch center support wall 124 and curve switch side walls 125 and 126 releasably secure the dual-track segments to the curve switch connector. Two pairs of curve switch center support wall locking tabs 127 each extends inwardly toward one of the track tunnels from the top ends of center support wall 124. The tabs occupy the same plane with each tab pair extending from opposite sides of center support wall 124 and each pair positioned at opposite ends of the center support wall.

Extending inwardly from each top end of each curve switch side wall is a curve switch side wall locking tab 128. Each side wall locking tab 128 faces one of the curve switch support wall locking tabs 127. This orientation of the locking tabs is set to correspond to the location of through-bores 18 and any variations of the through-bores.

To secure dual-track segments to curve switch connector 120, the dual track segment is placed over track support post 70 and engages a corresponding through-bore 18, and an end of a first dual-track segment is urged onto a first end of curve lane-change base sections 121 and 122. At the same time, the sides of the dual-track segment are pinched inwardly to allow the leading edge of the track segment to pass over locking tabs 127 and 128. Once the locking tabs are aligned with the corresponding through-bores 18, the pinching pressure is released to allow the dual-track segment side walls expand. This results in the locking tabs entering into through-bores 18 to lock the dual-track segment to curve switch connector 120. By positioning locking tabs 127 and 128 opposite one another, the dual-track segment and curve switch connector 120 are locked into a three-dimensional orientation. A second dual-track segment is secured to a second end of curve switch connector 120 by using the same procedure used to secure the first dual-track segment.

III. Elevation Supports

Figure 98:
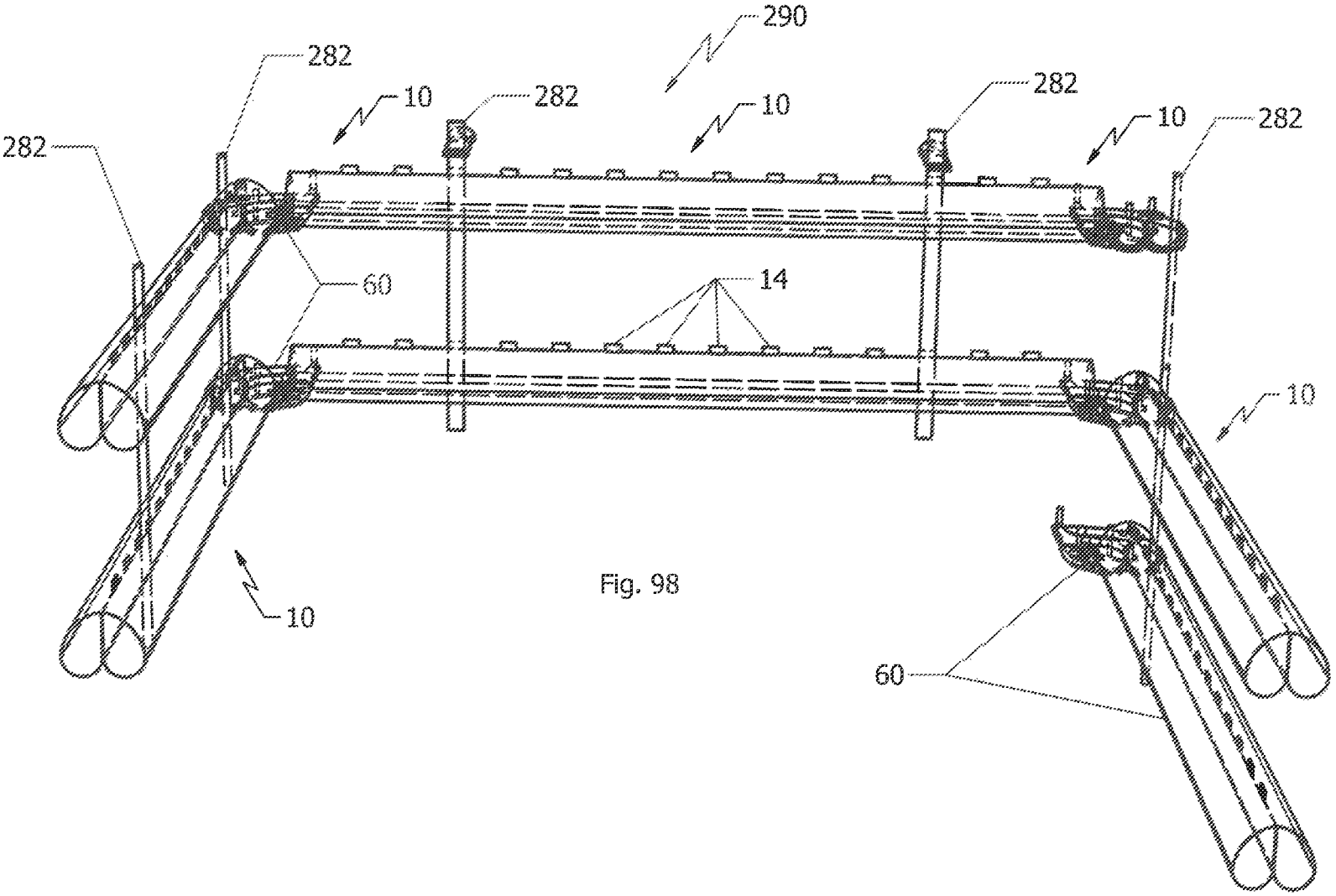
FIG. 98 is a spherical object race track assembly according to another embodiment of the disclosure.
Figure 100:
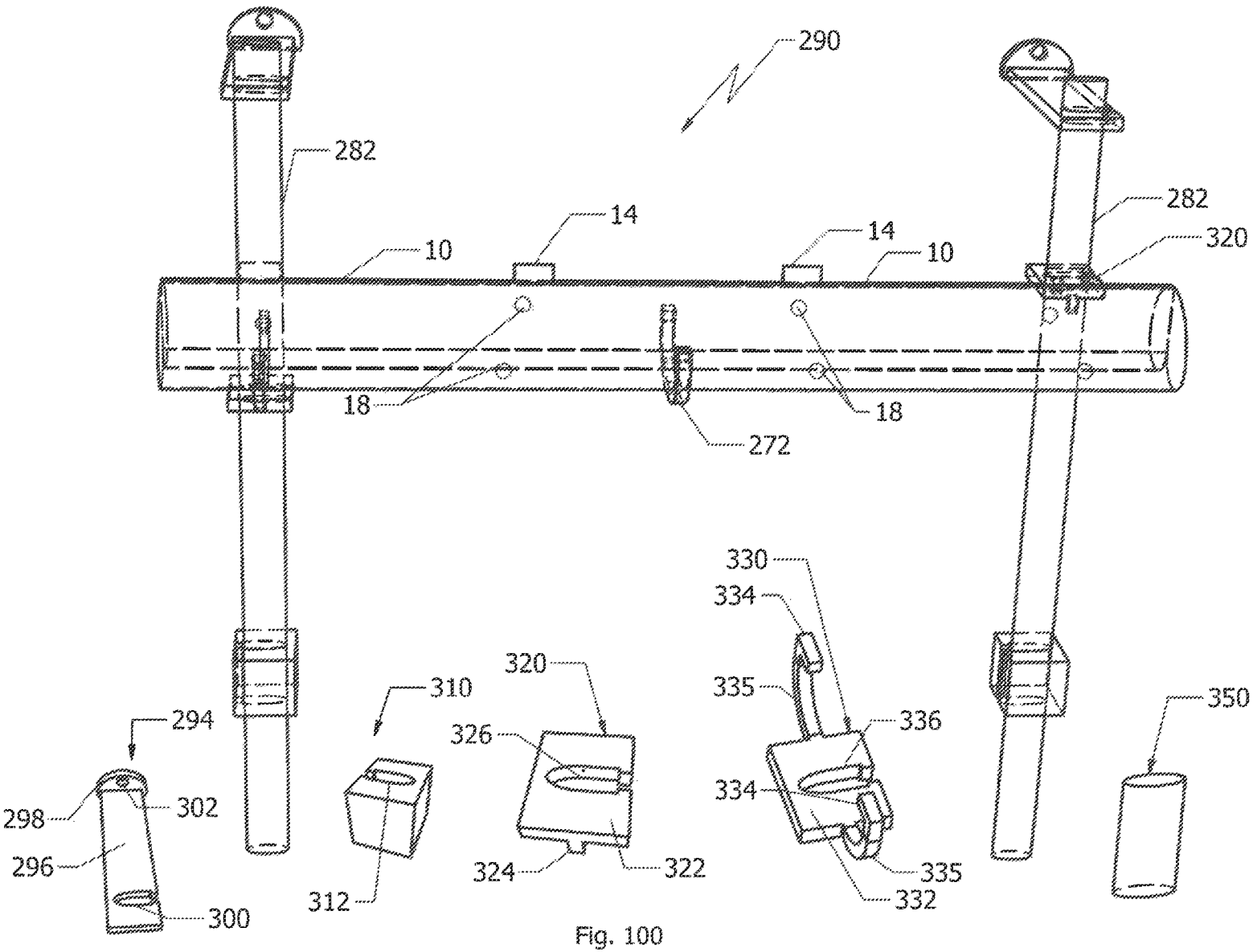
FIG. 100 is a top, side perspective view of a track elevation support system according to a yet further embodiment of the disclosure.

Referring now to FIGS. 98 and 100, in a further aspect of the disclosure, an elevation support, designated generally as 282, provides a means to elevate portions of a race track assembly in order to create elevational grades necessary to permit gravity-driven motion of spherical objects through the race track assembly. Elevation support 282 is essentially an elongated, flattened pole or tube. To secure an elevation support 282 to a track section, the support is inserted into a slot formed in the track segment or section, commonly in the center wall section of a dual-track segment. The same slot can be formed in the center walls of the track-segment connectors disclosed herein. The elevation support is urged along the track section, by sliding it in the track segment or section, until the desired height is achieved. Frictional engagement between the elevation support and the slot in the track section will restrict the track section from sliding down the elevation support.

To further secure a track segment or section at a specific height on an elevation support 282, an elevation support clamp, designated generally as 320, may be used. Elevation support clamp 320 includes a substantially flat elevation support clamp base 322 with one or more vertical support posts 324 extending downwardly from opposite edges of a bottom surface of clamp base 322. The spacing of the posts accommodates the top dimensions of a track section so the track section can allow posts 324 to penetrate through-bores 18 in the top of the track section. An elevation support clamp slot 326 is formed in clamp base 322 to receive an elevation support 282 and the tabs of the track section. Slot 326 may be formed with a side slot extension on one side (shown) to enable insertion of an elevation support from the open side of the slot. This enables an elevation support to be inserted from the side in a snap-fit configuration. To use elevation support clamp 320, the clamp is secured to the top of a track segment with slot 326 aligned with the slot in the track segment designated to receive an elevation support. Once the slots are aligned, an elevation support 282 is inserted into the slots. Alternatively, an elevation support 282 can be snap-fit into support clamp 320 via the side slot and then slid into the slot in the track segment. Elevation support clamp 320 enhances the friction-fit engagement of the track/elevation support assembly and enables the system to be more rigid and handle more weight, such as larger, heavier marbles or spherical objects travelling through an attached track segment.

Still referring to FIG. 100, in another embodiment, an elevation support C-clamp, designated generally as 330, provides an additional level of support for a track segment/elevation support assembly. Elevation support C-clamp 330 includes a substantially flat elevation support C-clamp base 332 with two opposing clamp arms 334 extending upwardly from opposite edges of a top surface of clamp base 332. The clamp arms are shaped to accommodate the contours of the bottom of a track segment or section so the track section nests between the clamp arms. Clamp arm pins 335 extend inwardly from distal ends of the clamp arms and are dimensioned to register in through-bores 18.

An elevation support C-clamp slot 336 is formed in C-clamp base 332 to receive an elevation support 282. Slot 336 may be formed with a side slot extension on one side (shown) to enable insertion of an elevation support from the open side of the slot. This enables an elevation support to be inserted from the side in a snap-fit configuration. To use elevation support clamp 330, the clamp is secured to the bottom of a track segment with slot 336 aligned with the slot in the track segment designated to receive an elevation support. Once the slots are aligned, an elevation support 282 is inserted into the slots until the desired height is reached. Alternatively, an elevation support 282 can be snap-fit into support C-clamp 330 via the side slot and then slid into the slot in the track segment until the bottom of the track segment registers against support C-clamp 330. Elevation support C-clamp 330 enhances the friction-fit engagement of the track/elevation support assembly and enables elevation supports to handle more weight, such as larger, heavier marbles or spherical objects travelling through an attached track segment.

Still referring to FIG. 100, in another aspect of the disclosure, an elevation support union, designated generally as 310, provides a means to secure two elevation supports 282 at their ends to create an extended elevation support assembly. Elevation support union 310 is essentially a square or rectangular block with a support union slot 312 formed in the body of the support union. Support union slot 312 is dimensioned to receive the bottom end of first elevation support 282 and the top end of a second elevation support 282 to create an extended elevation support. The elevation supports are butted together within the slot and held in position via friction fit. Mechanical fasteners and corresponding threaded bore holes can be used to create a mechanical lock between the union and the elevation supports. Support union slot 312 may be formed with an open side (shown) to permit side entry of the elevation supports in a snap-fit engagement means.

In a related aspect of the disclosure, an elevation support stub, designated generally as 350 can be used for multiple purposes. By adjusting the diameter of elevation support stub 350, it can be used as a reinforcing splint by inserting it into two adjoining elevation supports to rigidify the elevation support junction. If dimensioned to have the same cross-sectional shape and dimensions as a standardized elevation support, elevation support stub 350 can be inserted into a designated slot in a track section to provide additional support and/or rigidification of the track segment.

Still referring to FIG. 100, in a still further aspect of the disclosure, a wall mount, designated generally as 294, is structured to permit elevation supports and attached track segments to be secured to a wall. Wall mount 294 has a horizontally-oriented wall mount body 296 with a wall mount attachment base 298 formed or attached to one end of the wall mount body. A wall mount slot 300 is formed in wall mount body 296 to receive an elevation support 282. Wall mount slot 300 may be formed with an open side (shown) to permit side entry of an elevation support in a snap-fit engagement means. Mechanical fastener bores 302 may be formed in a face of wall mount attachment base 298 to permit the wall mount to be secured to a wall with mechanical fasteners. Other securement means such as double-stick tape or wall putty may be used to secure wall mount 294 to a wall.

To use wall mount 294, an elevation support 282 is inserted either from a bottom of wall mount slot 300 or inserted into the wall mount slot via the side slot. Once the elevation support has been secured to the wall mount, the wall mount is secured to a wall via double-stick tape, mechanical fasteners, suction cups and the like. The unique design of wall mount 294 enables tracks to be assembled at variable heights without compromising the playability of the race track.

IV. Specialized Track Segments and Accessories

Figure 111:
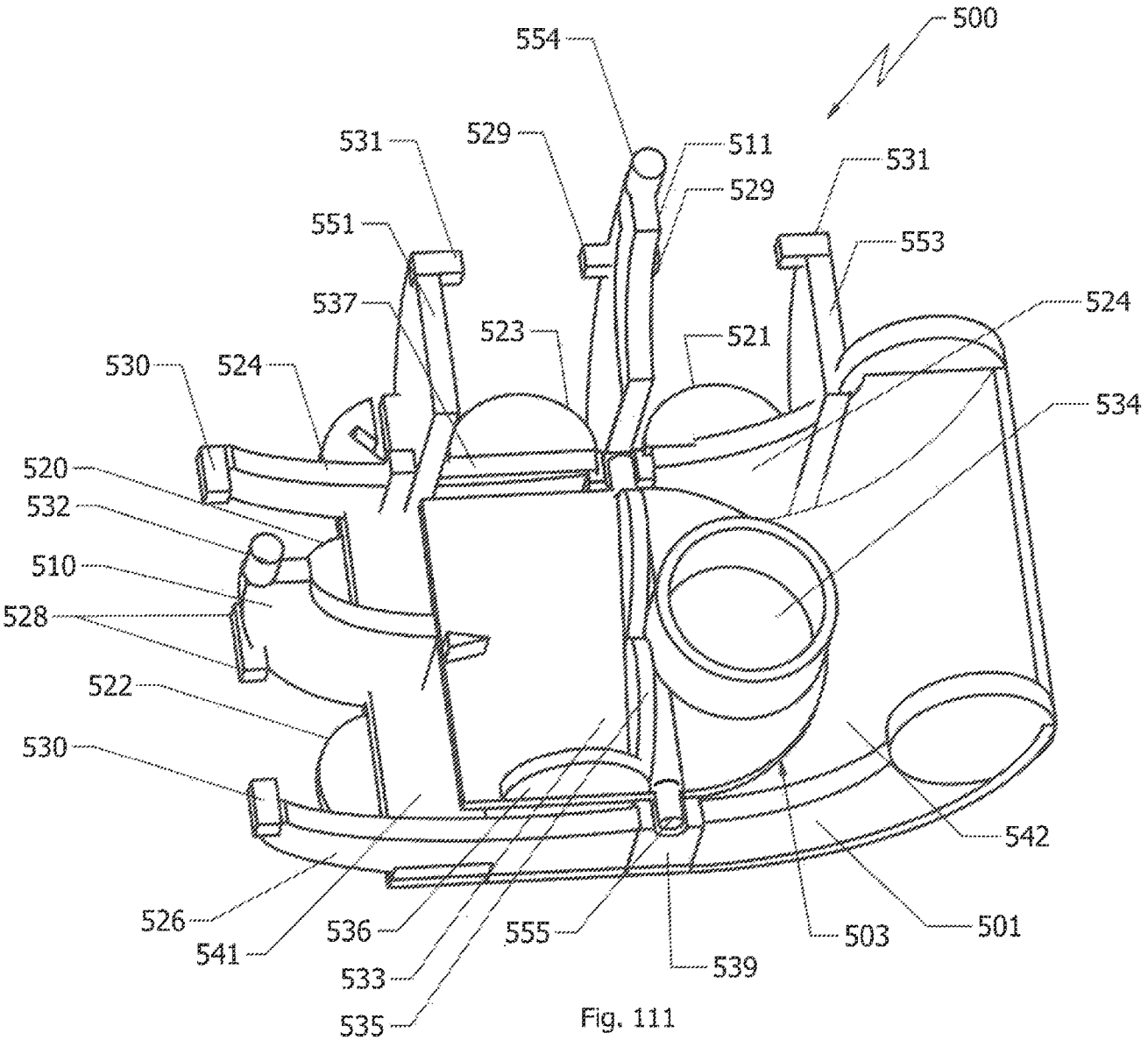
FIG. 111 is a top, end perspective view of a race starter connector according to a still further embodiment of the disclosure.

Referring now to FIG. 111, in a further aspect of the disclosure, a race starter connector, designated generally as 500, provides a means to start a race between two spherical objects such as marbles. Race starter connector 500 has two components, a race starter base 501 and a race starter tipper 503. Race starter tipper 503 has a starter lane 533. Starter lane 533 has a lateral border wall 536 that defines a lateral edge of the lane and a longitudinal wall 535 that defines the longitudinal edge of the lane. Race starter tipper 503 has a pair of radial extending axel shafts 555 secured to race starter lane 533 that can be rotated on the axel shafts to change the angle of the surface of race starter lane 533. A ballast adjustment container 534 provides a location for weights such as coins or lead fishing line weights to be added.

When ballast container 534 contains sufficient weight, race starter lane 533 will rotate and have a surface angle that descends towards longitudinal wall 535. When the ballast container contains insufficient weight, race starter lane 533 will have a surface angle that descends towards the opposite direction away from longitudinal wall 535. Race starter lane 533 is sized to contain one or more spherical objects.

When a spherical object is placed in race starter lane 533, it moves in the direction of the descending angle of the surface. If the ballast container contains sufficient weight, the spherical object moves against longitudinal wall 535. It will remain in this position until additional weight or downward force is added to starter lane 533. If an additional spherical object is added to starter lane 533, the mass of the two spherical objects may trigger the tipping motion of the starter lane 533, and the spherical objects will consequently roll off the starter lane 533 at approximately the same time.

Race starter base 501 provides the supporting structure for race starter tipper 503, and provides the connection to an outgoing track segment and an incoming track segment. Race starter base 501 has two axial shaft receivers 539 shaped to contain axel shafts 555 and provide a receiving fulcrum to allow the shafts to rotate. A starter base front floor 541 registers against and supports the leading edge of tipper 503. A starter base back floor 542 registers against and supports the back edge of tipper 503. Tipper 503 only touches either front floor 541 or back floor 542 at the same time in a static position. The tipper touches neither of the floors when in dynamic rotation.

Race starter base 501 contains track receiving tabs 520 and 522. A center support wall 510 extends upwardly from front floor 541 and is formed with laterally extending center wall locking tabs 528 dimensioned to be inserted into any variation of through-bores 18 of any of the dual track segments to secure the inner walls defining each track tunnel. Extending upwardly from a distal end of the center support wall 510 is a track support post 532. Post 532 is shown having a cylindrical shape. It should be understood that the shape of the post can conform to any regular or irregular geometric shape and remain with the scope of the disclosure. Post 532 is dimensioned to fit within a corresponding through-bore 18 to further secure a track section to the connector.

Extending upwardly and axially from race starter base 501 are first and second lateral lane sidewalls 524 and 526. Extending laterally inwardly from the top ends of the sidewalls are sidewall locking tabs 530. Locking tabs 530 perform the same function as center wall locking tabs 528. Each sidewall locking tab engages a dedicated through-bore 18 (and any variant) to secure a track tunnel to race starter connector 500. Locking tabs 530 may be positioned on a different plane than center wall locking tabs 528 in order to better secure the radial orientation of a dual-track segment relative to race starter connector 500.

Race starter base 501 has another set of track-receiving tabs 521 and 523. These receiving tabs are positioned at an elevation above the highest surface of starter lane 533. A center support wall 511 extends upwardly from the junction of front floor 541 and back floor 542 and has two laterally extending locking tabs 529 and a center post 554. Extending upwardly and axially are first and second longitudinal side walls 551 and 553, with sidewall locking tabs 531 extending laterally inwardly from the sidewalls. Receiving tabs 521 and 523 receive a track segment with two tunnels. The design's intention is to deliver spherical objects through a single tunnel over receiving tab 523. The tunnel over receiving tab 523 delivers spherical objects over wall 537 and onto starter lane 533. The tunnel over receiving tab 521 leads spherical objects to hit wall 524 which stops spherical objects from entering the race starter tipper 503. If a single tunnel track is used rather than a dual-track, then sidewall 553 and receiving tab 521 are eliminated and a single tunnel is attached over receiving tab 523.

Figure 105:
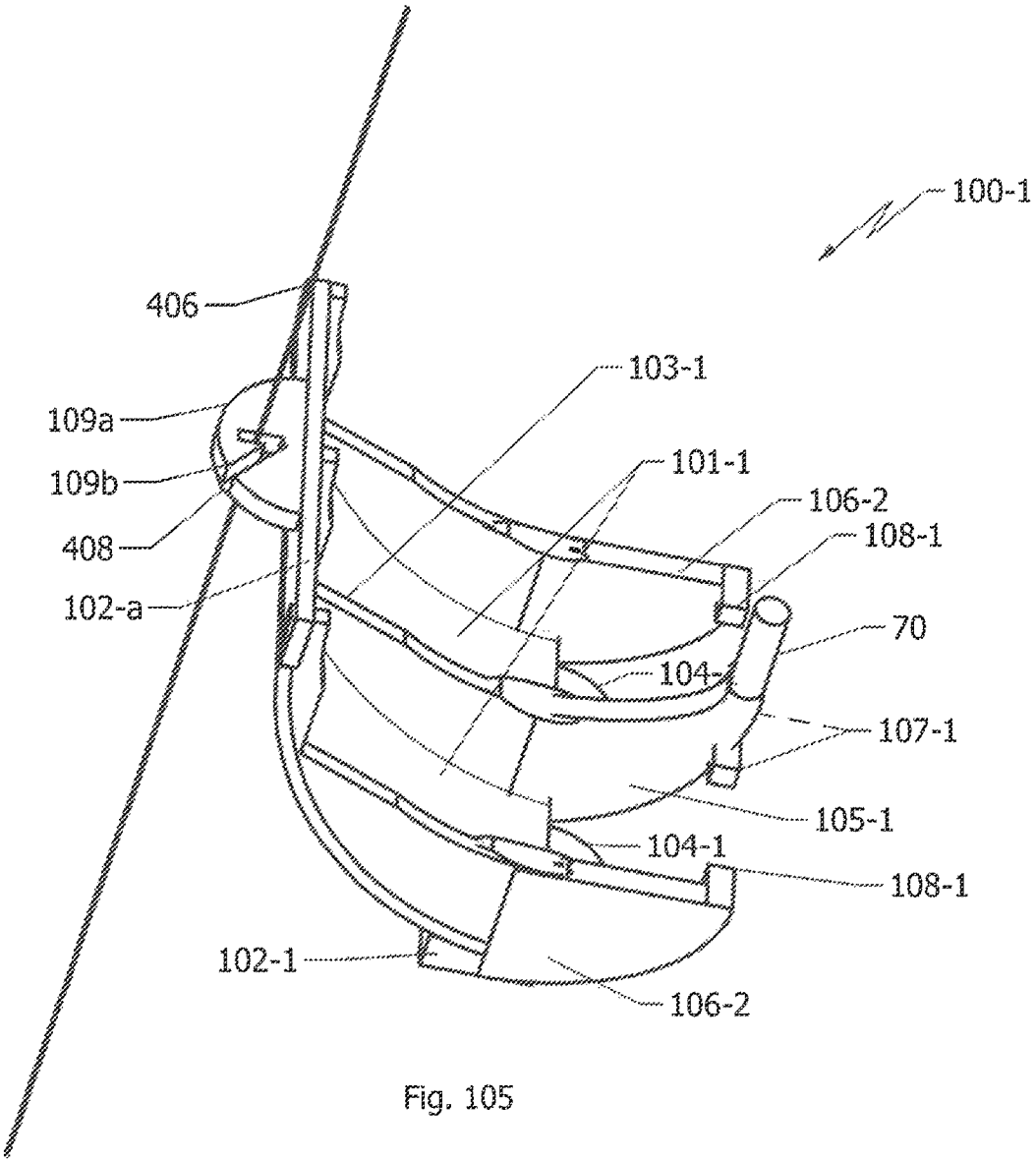
FIG. 105 is a top, back perspective view of vertical drop-connector suspension elevation supports according to yet another embodiment of the disclosure.

Referring now to FIG. 105, in another aspect of the disclosure, a modified drop connector, designated generally as 100', permits the connector to be suspended from an elevated surface. Suspended drop connector 100' includes a frame 102' that defines a pair of voids 101'. A divider rail 103' separates the voids to align with the right and left tunnels of a dual-track segment and to provide a physical boundary to prevent objects travelling in the track segments from crossing over into the other lane when dropping through voids 101'. Track receiving tabs 104' extend from frame 102' and provide structural support for dual-track sections secured to the drop connector. Receiving tabs 104' are offset from the plane occupied by frame 102' to accommodate the thickness of the base sections of a dual-track segment secured to suspended drop connector 100'. This ensures a smooth transition from the track segment to the suspended drop connector.

Suspended drop connector 100' further includes a suspended drop connector center support wall 105' extending vertically from the plane occupied by frame 102' and in alignment with divider rail 103'. Two drop connector side walls 106' extend vertically from opposite lateral edges of frame 102' and are substantially parallel with center support wall 105'. Side walls 106' rigidify the ends of attached dual-track segments in combination with receiving tabs 104'. Post 70 extends from the top of center support wall 105'.

To lock dual-track segments to suspended drop connector 100', a series of locking tabs positioned on center support wall 105' and side walls 106' releasably secure the dual-track segments to the connection segments. A pair of center support wall locking tabs 107' extend inwardly toward each track tunnel from the top ends of center support wall 105'. The tabs are dimensioned to receive a dedicated through-bore 18 or any of the disclosed variations of through-bore 18 disclosed herein.

Extending inwardly from each top end of each side wall 106' is a side wall locking tab 108'. This orientation of the locking tabs 108' is set to correspond to the location of dedicated through-bores 18 and variations thereof. To secure dual-track segments to suspended drop connector 100', a track segment through-bore 18 is placed over center post 70, and an end of a first dual-track segment is urged onto receiving tabs 104'. At the same time, the sides of the dual-track segment are pinched inwardly to allow the leading edge of the track segment to pass over locking tabs 108' and 107'. Once the locking tabs are aligned with the corresponding through-bores 18, the pinching pressure is released to allow the dual-track segment side walls to expand. This results in the locking tabs entering into through-bores 18 to lock the dual-track segment to suspended drop connector 100'. By positioning locking tabs 108' and 107' opposite one another, the dual-track segment and suspended drop connector 100' are locked into a three-dimensional orientation. Spherical objects rolled through the attached dual-track segment simply exit the segment and fall via gravitation force through voids 101'.

To enable suspended drop connector 100' to be suspended from a higher surface or plane, such as a ceiling, a center connector ring 109*a* that defines an opening, such as a bore or a slot, is formed extending outwardly from a back wall 102*a*. A center connector ring slot 109*b* may be formed on the center connector ring in an axial orientation to bisect the ring to permit a suspension elevation support 406 to be inserted into the connector ring through the wall of the ring rather than inserted through the opening defined by the ring. Alternatively, center connector ring 109*a* may be formed without the slot. Once suspension elevation support 406 is secured within the confines of center connector ring 109*a*, a track-position setting ball 408 is secured to suspension elevation support 406 and positioned at the desired height on elevation support 408. Setting ball 408 remains at the desired position on suspension elevation support 406 via friction fit or via the incorporation of a serpentine path through setting ball 408. Use of a serpentine path creates a natural restriction of movement of the elevation support through the setting ball. Suspended drop connector 100' registers against position setting ball 408 via center connector ring 109*a* to set the elevation of height of the drop connector. The weight or force of the connector against setting ball 408 via center connector ring 109*a* may increase the restriction of movement of setting ball 408 relative to suspension elevation support 406 if a serpentine path is used.

Figure 79:
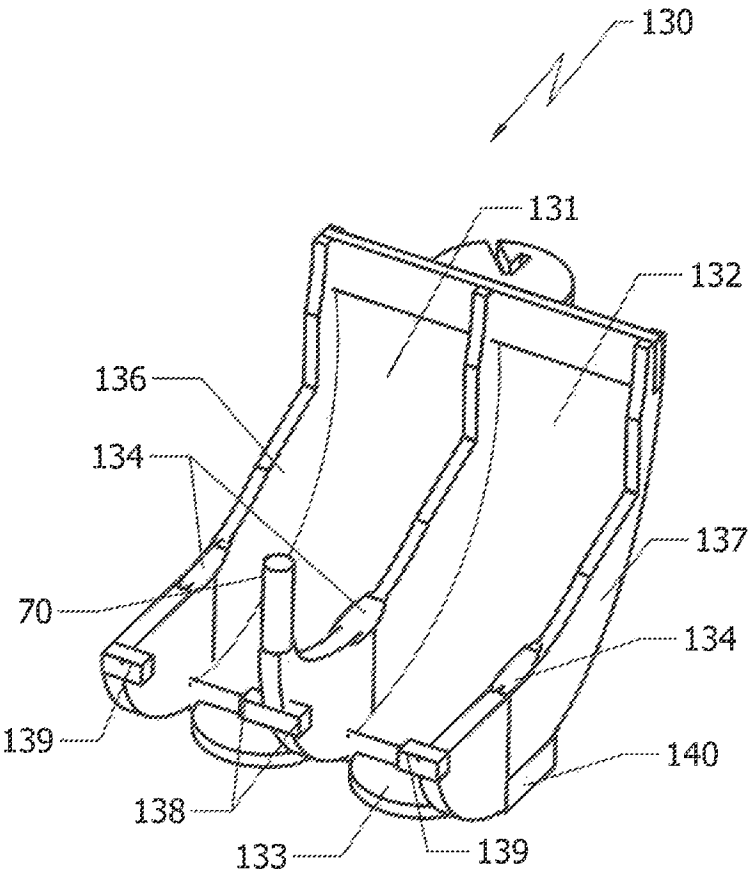
FIG. 79 is a top, side perspective view of the drop catch connector shown in FIG. 78.
Figure 78:
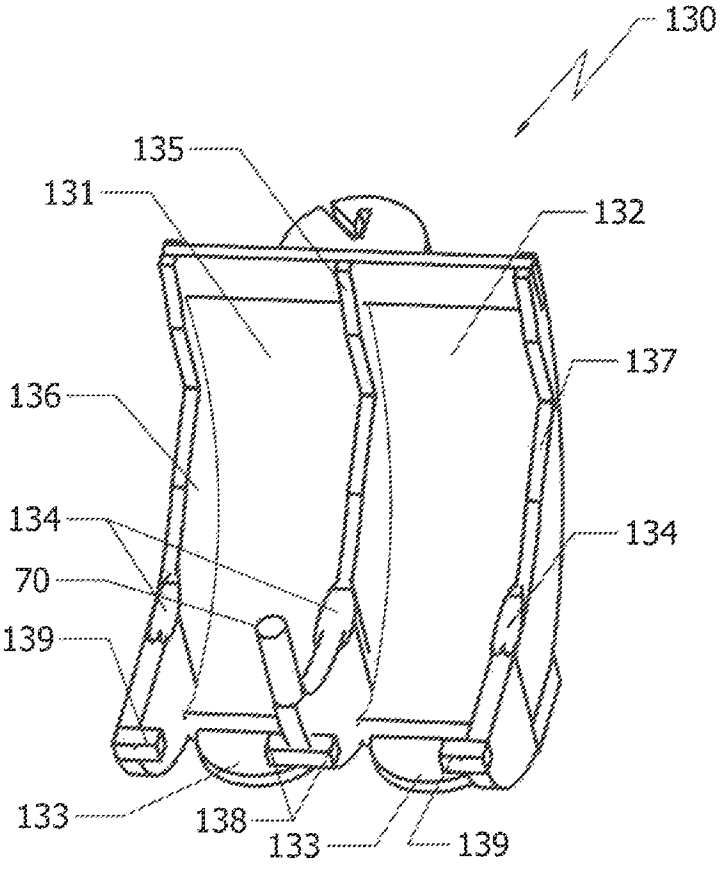
FIG. 78 is a top end perspective view of a drop catch connector according to a still further embodiment of the disclosure.

Referring now to FIGS. 78 and 79, in a further aspect of the disclosure, a drop catch element, designated generally as 130, provides a means to catch a spherical object travelling off a higher-elevation track and redirecting the spherical object onto a new track segment/section not directly connected to the prior track section. Drop catch element 130 has a right track capture slope 131 and a left capture slope 132. The shape of these sections is designed to smoothly transition a falling spherical object onto a new track section. A sloped center wall 135 divides drop catch element 130 into two tracks that correspond to the two tunnels of a dual-track segment. A right drop-catch element sidewall 136 and a left drop catch element sidewall 137 define the lateral edges of the tracks. The distal ends of the center wall and sidewalls are formed with bulges 134 to urge spherical objects toward the centers of the dual-track segments attached to drop catch element 130. Each capture slope has a track-receiving tab 133 extending axially from distal ends with the tabs recessed below the plane of the slopes to accommodate the thickness of a dual-track segment secured to drop catch element 130. Track-receiving tabs 133 provide structural support for the bottom ends of dual-track segments secured to drop catch element 130.

Drop catch element 130 further includes a drop catch element sloped center support wall 135 that has an upwardly-extending distal end and a post 70 to receive a top surface of a dual-track segment. In contrast, the sidewalls do not have upwardly-extending distal ends but are continuums of the sidewall slopes beyond the distal ends of the capture slopes 131 and 132. Thus, the trailing or distal ends of the sidewalls have top surfaces that occupy a plane below the plane occupied by the distal end of sloped center support wall 135. It should be under stood that the relative heights of the center and side walls can be adjusted (equal or unequal) to meet the connection requirements of specific track segments or sections.

To lock a dual-track segment to drop catch element 130, the dual-track segment is placed over the track support post 70 so that the post penetrates a corresponding through-bore 18. A series of locking tabs positioned on sloped center support wall 135 and drop catch element sidewalls 136 and 137 releasably secure the dual-track segment to the drop catch element. A pair of sloped center support wall locking tabs 138 each extends inwardly toward one of the track tunnels from the top end of sloped center support wall 135.

Extending inwardly from each top distal end of each drop catch element sidewall is a drop catch element sidewall locking tab 139. Each sidewall locking tab 139 faces one of the sloped center support wall locking tabs 138. This orientation of the locking tabs is set to correspond to the location of through-bores 18 and any variations of the through-bores on dual-track segments. To secure a dual-track segment to drop catch element 130, an end of a dual-track segment is urged onto and registered against the drop catch element receiving tabs 133. At the same time, the sides of the dual-track segment are pinched inwardly to allow the leading edge of the track segment to pass over locking tabs 138 and 139. Once the locking tabs are aligned with the corresponding through-bores 18, the pinching pressure is released to allow the dual-track segment side walls expand. This results in the locking tabs entering into through-bores 18 to lock the dual-track segment to drop catch element 130. By positioning locking tabs 138 and 139 opposite one another, the dual-track segment and drop catch element 120 are locked into a three-dimensional orientation.

Figure 81:
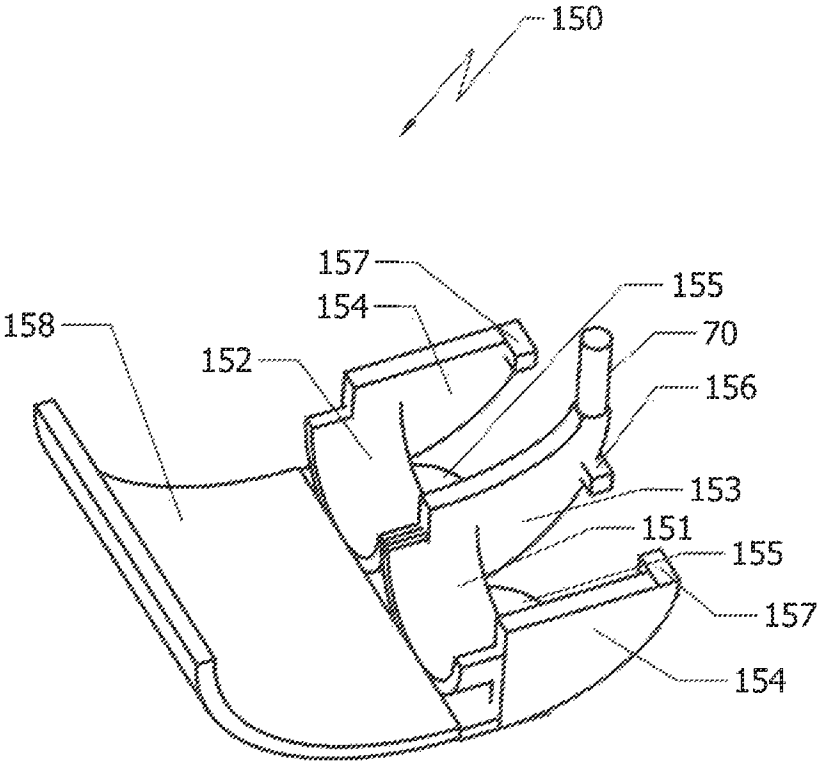
FIG. 81 is a top side perspective view of the high-speed jump connector shown in FIG. 80.
Figure 80:
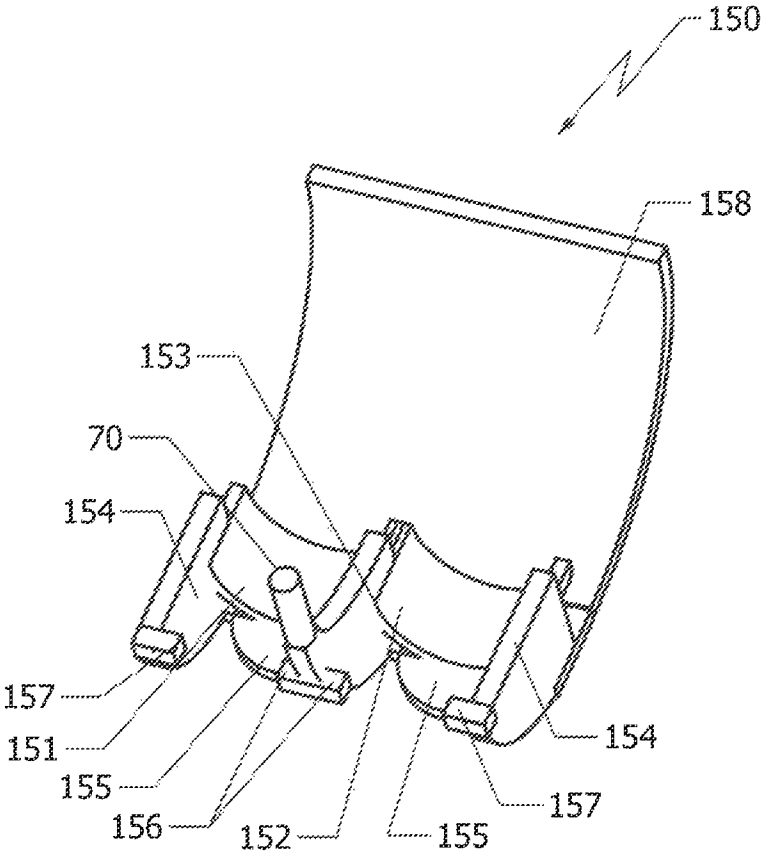
FIG. 80 is a top end perspective view of a high-speed jump connector according to another embodiment of the disclosure.

Referring now to FIGS. 80 and 81, in yet another aspect of the disclosure, a high-speed jump element, designated generally as 150 provides means for launching spherical objects off a section of track into another unconnected track section or catch element such as a vertical receiver element disclosed in more detail herein. Jump element 150 includes a sloped ramp 158. Extending axially from a proximal end of ramp 158 are a right base section 151 and a left base section 152. A jump element center wall 153 extends upwardly between the base sections and defines the inner walls of the base sections. Extending axially from proximal ends of the base sections are track receiving tabs 155 that perform the same functions as any of the other track receiving tabs described herein. With respect to the base sections, it should be understood that the cross-sectional shape of base sections 151 and 152 may be semi-circular, parabolic or any other shape having smooth-transitional surfaces.

Also projecting upwardly from lateral edges of the base sections are jump element sidewalls 154. By design, sidewalls 154 have a top edge set below the height of jump element center wall 153 to better secure dual-track sections to jump element 150. It should be understood that the height of the center wall and sidewalls is variable and can be adjusted to accommodate dual-track sections with different diameters. Jump element center wall 153 also has an upwardly extending post 70.

To lock a dual-track segment to jump element 150, the dual-track element is placed over the post 70 so that post 70 penetrates a corresponding through-bore 18. A series of locking tabs positioned on jump element center support wall 153 and jump element sidewalls 154 releasably secure the dual-track segment to the jump element. A pair of jump element center support wall locking tabs 156 each extends inwardly toward one of the track tunnels from the top proximal end of jump element center support wall 153.

Extending inwardly from each top proximal end of each jump element sidewall is a jump element sidewall locking tab 157. Each sidewall locking tab 157 faces one of the jump element center support wall locking tabs 156. This orientation of the locking tabs is set to correspond to the location of through-bores 18 and any variations of the through-bores on dual-track segments. To secure a dual-track segment to jump element 150, an end of a dual-track segment is urged onto and registered against the jump element receiving tabs 155. The remainder of the procedure is the same as described for other connection elements with pressure applied to and released from the sides of a dual-track segment as the segment is urged onto the connecting features of jump element 150. By positioning locking tabs 156 and 157 opposite one another, the dual-track segment and jump element 150 are locked into a three-dimensional orientation.

Figure 82:
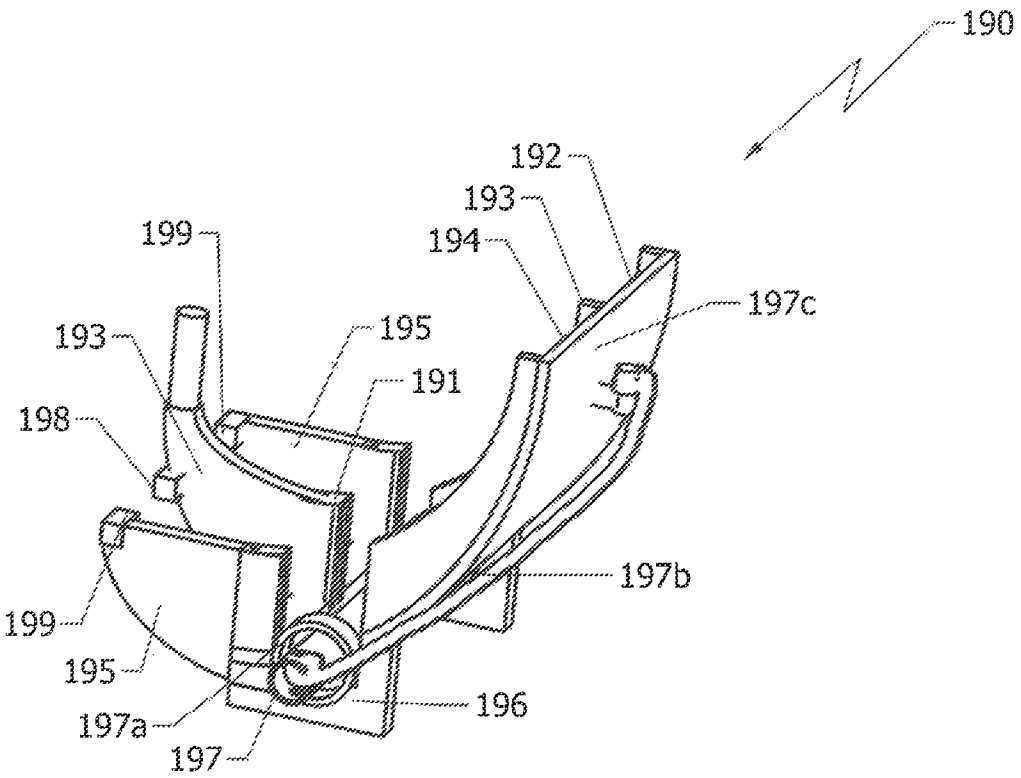
FIG. 82 is a top side perspective view of a musical ramp according to a further embodiment of the disclosure.
Figure 83:
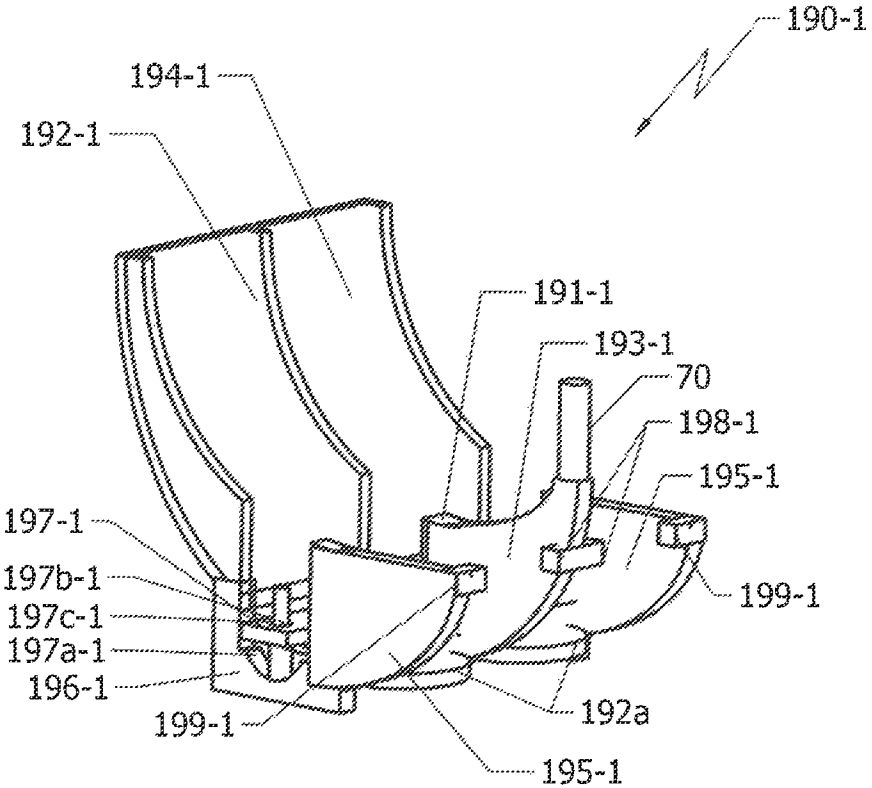
FIG. 83 is a side end perspective view of the musical ramp.

Referring now to FIGS. 82-83, in a further aspect of the disclosure, a variety of musical modules are shown that emit musical notes when a spherical object strikes and passes over them. As shown in FIG. 82, a musical ramp, designated generally as 190, includes a first track slope 192 and a second track slope 194 separated and partially defined by a sloped center wall 193. Sloped musical ramp sidewalls 195 define the lateral edges of the track slopes. Both the center wall and side walls have speed-dampener and travel alignment bulges 191 that adjust the travel path of descending spherical objects. A support base 196 is secured under the track slopes, sidewalls and center wall. Gaps formed in sloped center wall 193 and sloped sidewalls 195 are aligned and accommodate a cylindrical musical pipe 197 that resonates when struck.

As shown in FIG. 82, musical pipe 197 is positioned within two pipe support rings 197*a* that support musical pipe 197 along track slopes for contact with passing spherical objects. Support rings 197*a* may be formed from soft materials such as fabric and felt so that the pipe can musically resonate while in contact with the rings. Musical pipe 197 is loose within ring 197*a* and is restricted from moving laterally out of the cylinder by a pipe retention cord 197*b*. Retention cord 197*b* is secured to pipe 197 via a bore formed at one end of the pipe. The cord is threaded through the bore and secured at one end via a knot or like securement means. A second end of cord 197*b* is secured to cord retention post 197*c* secured to the back sides of the slopes. By using a cord, musical pipe can resonate when struck and emit a musical note.

A proximal end of sloped center wall 193 extends upwardly and has two sloped center wall locking tabs 198 extending laterally toward the track slopes. A post 70 extends upwardly from the top of wall 193. Each sloped sidewall 195 has a distal end that extends upwardly to a height below the height of the sloped center wall distal end. Each sloped sidewall 195 has at least one sloped sidewall locking tab 199 extending laterally toward the track slopes opposite one of the sloped center wall-locking tabs 198 at the same or a different height. Dual-track segments are secured to musical ramp 190 in the same manner used for any of the connectors having the same locking tabs.

Referring now to FIG. 83, in a yet further aspect of the disclosure, a musical ramp or musical drop connector, designated generally as 190', has essentially the same features as musical ramp 190 with the substitution of a musical bar in place of musical pipe 197. Musical ramp 190' includes a first track slope 192' and a second track slope 194' separated and partially defined by a sloped center wall 193'. A post 70 extends upwardly from the top of center wall 193'. Sloped musical ramp sidewalls 195' define the lateral edges of the track slopes. Both the center wall and side walls have speed-dampener and travel alignment bulges 191' that adjust the travel path of descending spherical objects. A support base 196' is secured under the track slopes, sidewalls and center wall. Gaps formed in sloped center wall 193' and sloped sidewalls 195' are aligned and accommodate a musical bar 197' that resonates when struck.

As shown in FIG. 83, musical bar 197' is formed with two bores holes 197*c*', one at each lateral end. A bar support post 197*b*' extends upwardly from support base 196'. A grommet 197*a*' is placed over post 197*b*' and has a bore with a cross-sectional diameter dimensioned to receive 197*b*' in a snug fit. In contrast, the bar bore holes 197*c*' have a cross-sectional diameter larger than the cross-sectional diameter of post 197*b*' to permit musical bar to resonate when struck and emit a musical note.

A proximal end of sloped center wall 193' extends upwardly and has two sloped center wall locking tabs 198' extending laterally toward the track slopes. A post 70 extends upwardly from center wall 193'. Each sloped sidewall 195' has a distal end that extends upwardly to a height below the height of the sloped center wall distal end. Each sloped sidewall 195' has at least one sloped sidewall locking tab 199' extending laterally toward the track slopes opposite one of the sloped center wall-locking tabs 198'. Dual-track segments are secured to musical ramp 190' in the same manner used for any of the connectors having the same locking tabs.

Figure 99:
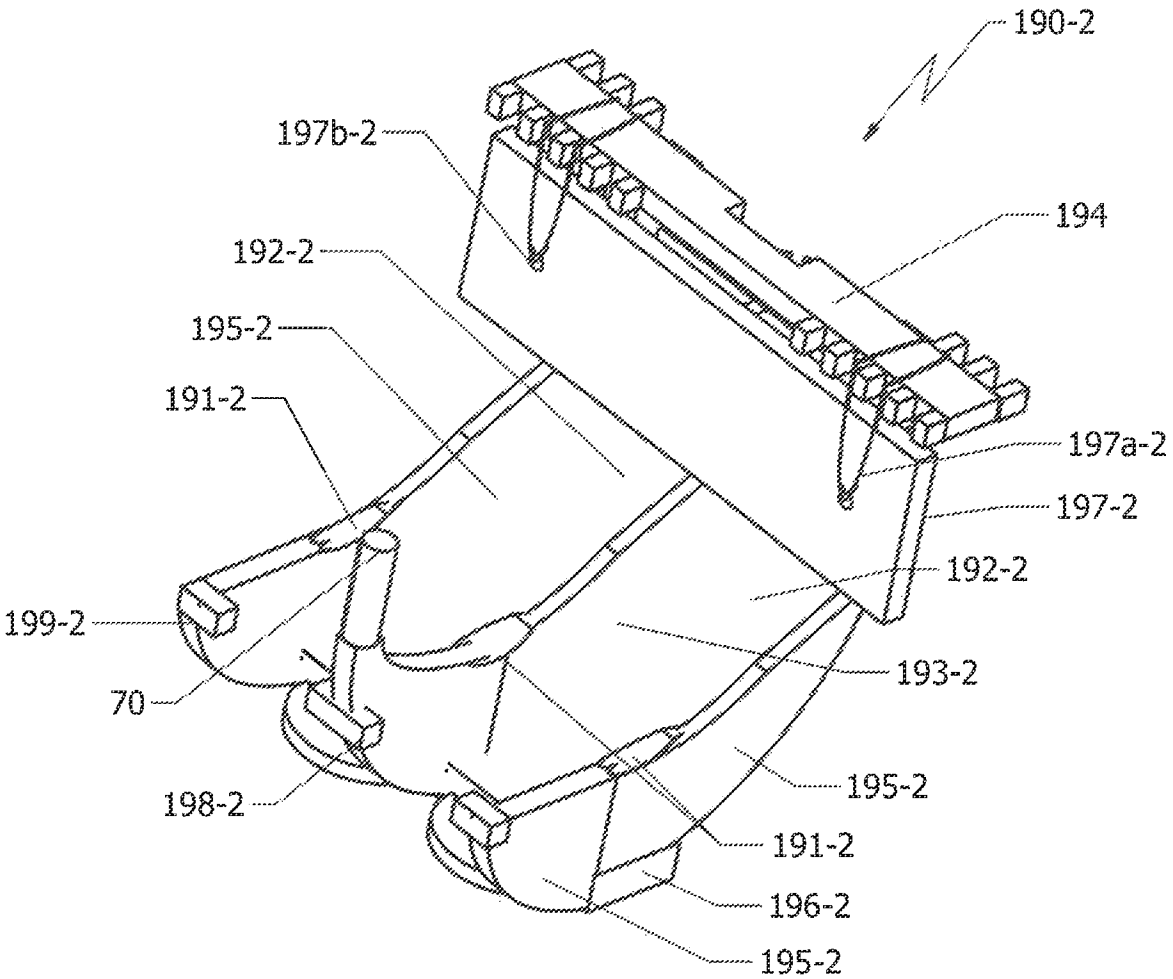
FIG. 99 is a top, side perspective view of a musical ramp according to a further embodiment of the disclosure.

Referring now to FIG. 99, in a still further aspect of the disclosure, a musical ramp, designated generally as 190", has essentially the same features as musical ramp 190' with the placement of a musical bar at the top of the musical ramp. Musical ramp 190" includes two track slopes 192" separated and partially defined by a sloped center wall 193". Sloped musical ramp sidewalls 195" define the lateral edges of the track slopes. Both the center wall and side walls have speed-dampener and travel alignment bulges 191" that adjust the travel path and potentially the velocities of descending spherical objects. A support base 196" is secured under the track slopes, sidewalls and center wall. A music bar support platform 194" is formed with two or more slots to accommodate a music bar suspension wire or string 197*a*". Multiple slots may be included to provide variability to the mounting orientation of musical bar 197" and the various sizes of musical bar 197". The ends of suspension wire 197*a*" may be secured to musical bar 197" via musical bar bore holes 197*b*". Support platform 194" is secured to a distal end of musical ramp 190". Bar suspension wire 197*a*" is secured in two slots to permit musical bar 197" to swing freely from support platform 194". Musical bar 197" resonates when struck by flying spherical objects that then ride down ramps 192".

A proximal end of sloped center wall 193" extends upwardly and has two sloped center wall locking tabs 198" extending laterally toward the track slopes. A post 70 extends upwardly from center wall 193". Each sloped sidewall 195" has a distal end that extends upwardly to a height below or equal to the height of the sloped center wall distal end. Each sloped sidewall 195" has at least one sloped sidewall locking tab 199" extending laterally toward the track slopes opposite one of the sloped center wall-locking tabs 198" but at the same or a different height. Dual-track segments are secured to musical ramp 190" in the same manner used for any of the connectors having the same locking tabs.

Figure 122:
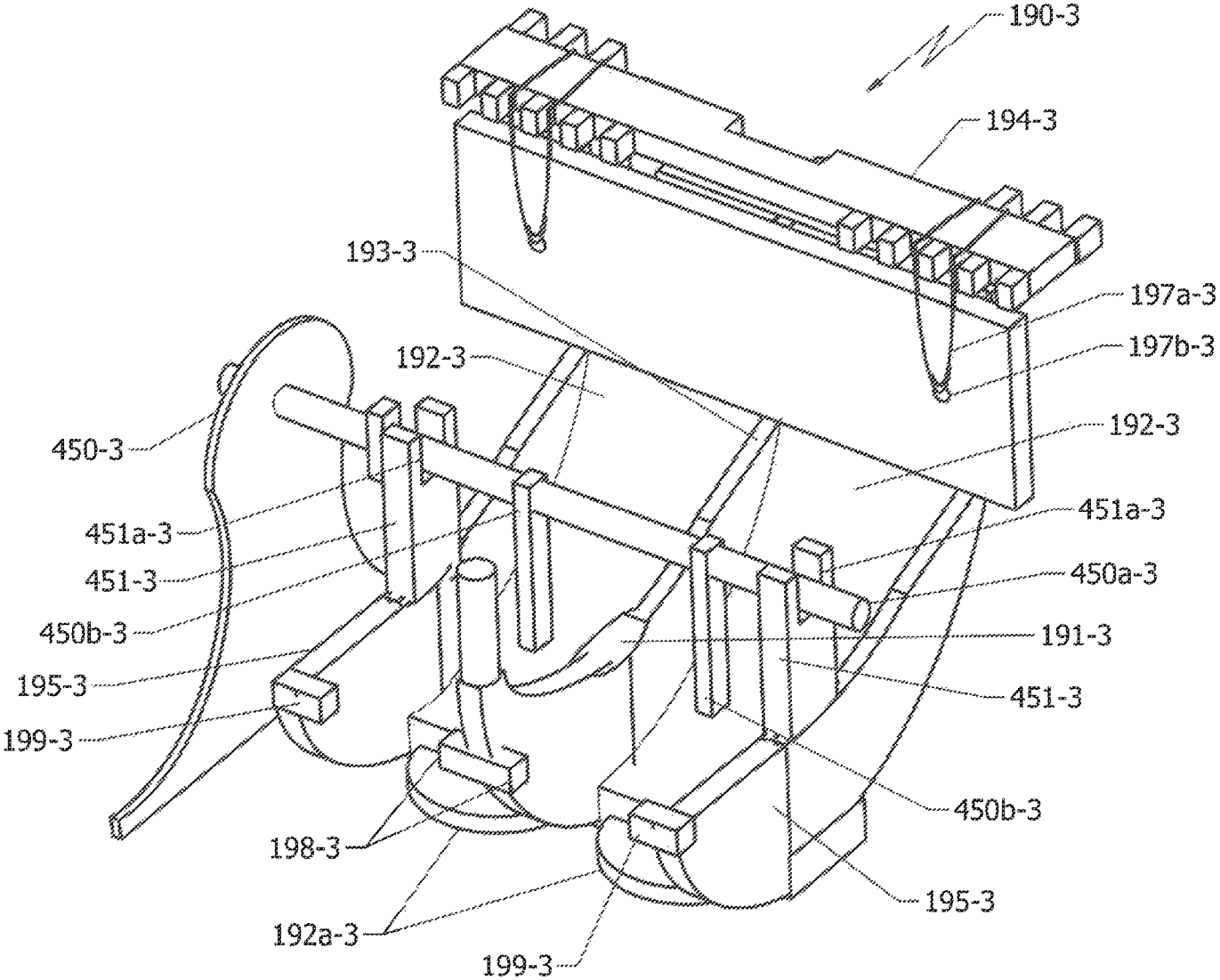

Referring now to FIG. 122, in yet another aspect of the disclosure, a musical drop connector or musical ramp, designated generally as 190''', has essentially the same features as musical ramp 190" with the addition of a rotatable ornament secured to the musical ramp. Musical ramp 190''' includes two track slopes 192''' separated and partially defined by a sloped center wall 193'''. Sloped musical ramp sidewalls 195''' define the lateral edges of the track slopes. The center wall has a speed-dampener and travel alignment bulge 191''' that adjusts the travel path and potentially the velocity of incoming spherical objects. A support base (not shown, but similar to support base 196") is secured under the track slopes, sidewalls and center wall. A track receiving tab 192*a*''' extends from each ramp 192'''. Each tab is recessed below the plane occupied by the lower end of ramps 192" to accommodate the thickness of an attached dual-track segment to ensure smooth transition between the dual-track segment and the ramps 192".

A music bar support platform 194" is formed with two or more slots to accommodate a music bar suspension wire or string 197*a*". The ends of suspension wire 197*a*''' may be secured to musical bar 197" via musical bar bore holes 197*b*". Support platform 194" is secured to a distal end of musical ramp 190". Bar suspension wire 197*a*" is secured in two slots to permit musical bar 197" to swing freely from support platform 194" and resonate. Musical bar 197''' resonates when struck by spherical objects that fly into them.

A proximal end of sloped center wall 193''' extends upwardly and has two sloped center wall locking tabs 198''' extending laterally toward the track slopes. A post 70 protrudes from the top of center wall 193'''. Each sloped sidewall 195''' has a distal end that extends upwardly to a height below or equal to the height of the sloped center wall distal end. Each sloped sidewall 195''' has at least one sloped sidewall locking tab 199''' extending laterally toward the track slopes opposite one of the sloped center wall-locking tabs 198" but at the same or a different height. Dual-track segments are secured to musical ramp 190''' in the same manner used for any of the connectors having the same locking tabs.

To receive a rotating ornament/ornament axle combination, musical ramp 190''' is formed with axle supports 451''' extending upwardly from musical ramp sidewalls 195'''. Axle supports 451''' are formed with slots 451*a*''' to receive an ornament axle 450*a*'''. Ornament axle 450*a*''' is secured to a back side of a rotating ornament 450'''. Suspended downwardly from ornament axle 450*a*''' are two strike posts 450*b*'''. Each strike post 450*b*''' is suspended over a dedicated ramp 192'. To maintain the strike posts in the ready/down position, the attachment of ornament axle 450*a*''' to rotating ornament 450''' is offset or biased toward a top end of the ornament. In this orientation, the majority of the weight of the ornament is positioned below the axle attachment. This results in the ornament and strike posts to be in the ready/down position. When a spherical object rolls down ramp 192''', the spherical object will strike the strike post and cause the rotating ornament/ornament axle assembly to rotate within the axle supports 451'''.

Figure 84:
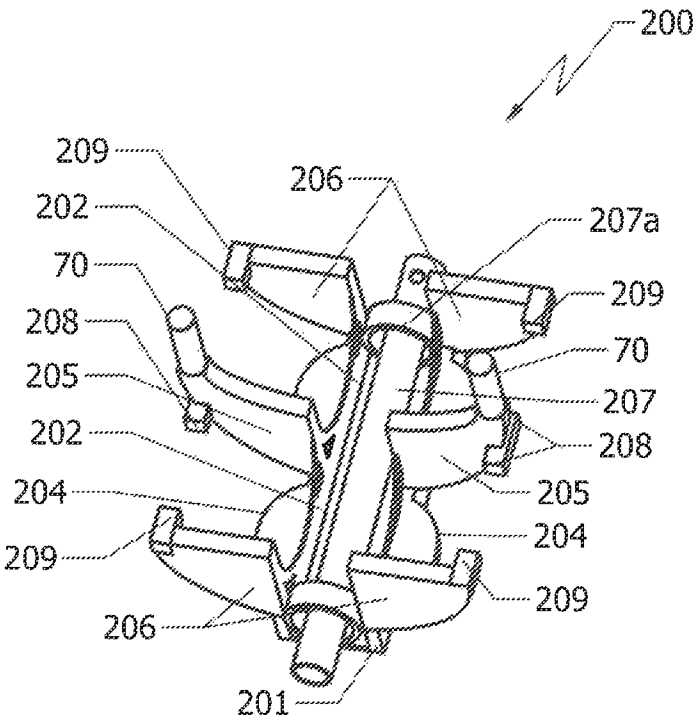
FIG. 84 is a top, side perspective view of a musical ramp according to a yet further embodiment of the disclosure.

Referring now to FIG. 84, in another aspect of the disclosure, a musical connector, designated generally as 200, includes two base sections 202 that conform to the shape of the dual-track segment tunnels to provide a smooth transition between joined track segments. Each base section 202 has a track-receiving tab 204 extending axially from each end and coplanar with, or recessed below the surfaces of the base sections. Track-receiving tabs 204 provide structural support for the bottom ends of dual-track segments secured to musical connector 200.

Musical connector 200 further includes a discontinuous musical connector center support wall 205 that extends vertically from the junction of base sections 202 and partially defines the base sections. Two discontinuous musical connector side walls 206 extend vertically from opposite lateral edges of base sections 202 and are substantially parallel with center support wall 205. Sidewalls 206 rigidify the ends of attached dual-track segments in combination with base sections 202. As shown, center support wall 205 is higher than side walls 206 A support base 201 is secured under the base sections, sidewalls and center support wall. Gaps formed in center support wall 205 and sidewalls 206 are aligned and accommodate a musical pipe 207 that resonates when struck. Musical pipe 207 is loose within two support rings 207*a*. Support rings 207*a* may be formed from soft materials such as fabric and felt so that the pipe can musically resonate while in contact with the rings.

To lock dual-track segments to musical connector 200, a series of locking tabs positioned on center support wall 205 and side walls 206 releasably secure the dual-track segments to the musical connector. Two pairs of center support wall locking tabs 208 extend inwardly toward each track tunnel from the top ends of center support wall 205. The tabs occupy the same plane with each tab pair extending from opposite sides of center support wall 205 with each pair positioned at opposite ends of the support wall. A post 70 extends upwardly from center wall 205.

Extending inwardly from each top end of each side wall 206 is a side wall locking tab 209. Each side wall locking tab 209 faces, and is aligned with, one of the support wall-locking tabs 208. This orientation of the locking tabs is set to correspond to the location of through-bores 18. Dual-track segments are secured to both ends of musical connector 200 in the same manner used for any of the connectors having the same locking tabs.

Figure 85:
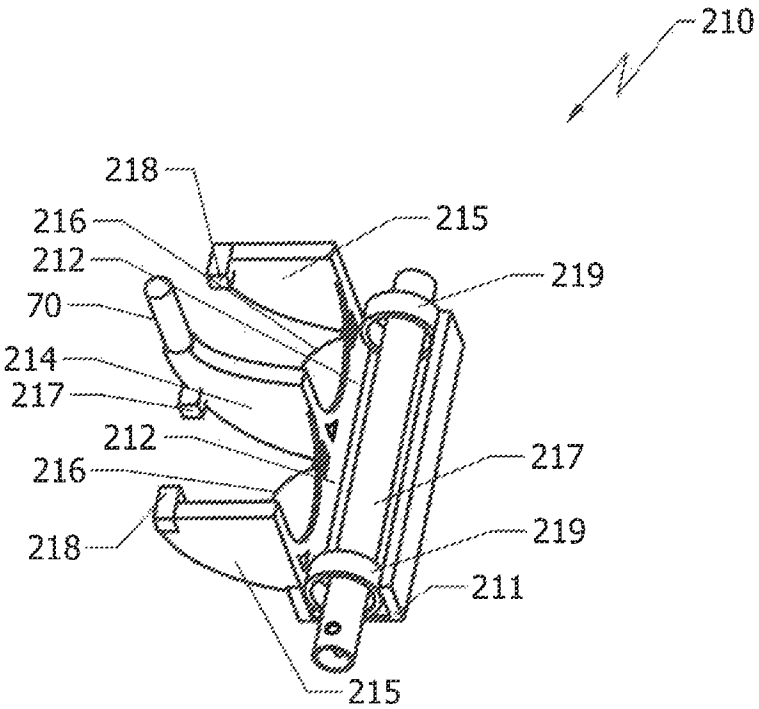
FIG. 85 is a side view in elevation of the musical ramp.

Referring now to FIG. 85, in yet another aspect of the disclosure, a musical drop connector, designated generally as 210, provides a connector that emits a musical tone when a spherical object passes over the drop connector. Musical drop connector 210 includes two base sections 212 that conform to the shape of the dual-track segment tunnels to provide a smooth transition between joined track segments. Each base section 212 has a track-receiving tab 216 extending axially from each end and coplanar with, or recessed below the surfaces of the base sections. Track-receiving tabs 216 provide structural support for the bottom ends of dual-track segments secured to musical drop connector 210.

Musical drop connector 210 further includes a musical drop connector center support wall 214 that extends vertically from the junction of base sections 212 and partially defines the base sections. A post 70 extends upwardly from center wall 214. Two musical drop connector side walls 215 extend vertically from opposite lateral edges of base sections 212 and are substantially parallel with center support wall 214. Sidewalls 215 rigidify the ends of attached dual-track segments in combination with base sections 212. As shown, center support wall 214 is higher than side walls 215. A support base 211 is secured under the base sections, sidewalls and center support wall. Gaps formed in center support wall 214 and sidewalls 215 are aligned and accommodate a musical pipe 217 that resonates when struck. Musical pipe 217 is loose within two support rings 219. Support rings 219 may be formed from soft materials such as fabric and felt so that the pipe can musically resonate while in contact with the rings.

Extending axially from an end of each base section are track receiving tabs 216 that provide structural support for a dual-track section secured to musical drop connector 210. Receiving tabs 216 are offset from the plane occupied by base sections 212 to accommodate the thickness of the bottom surfaces of a dual-track segment secured to the musical connector. As stated previously herein, this ensures a smooth transition from the track segment to the drop connector.

To lock a dual-track segment to musical drop connector 210, a series of locking tabs positioned on center support wall 214 and side walls 215 releasably secure the dual-track segments to the musical connector. A pair of center support wall locking tabs 217 extend inwardly toward each track tunnel from a top end of center support wall 214. The tabs occupy the same plane with each tab extending from opposite sides of center support wall 214.

Extending inwardly from a top end of each side wall 215 is a side wall locking tab 218. Each side wall locking tab 218 faces, and is aligned with, one of the support wall-locking tabs 217. This orientation of the locking tabs is set to correspond to the location of through-bores 18. A dual-track segment is secured to the end of musical drop connector 210 in the same manner used for any of the connectors having the same locking tabs.

Figures 106, 107:
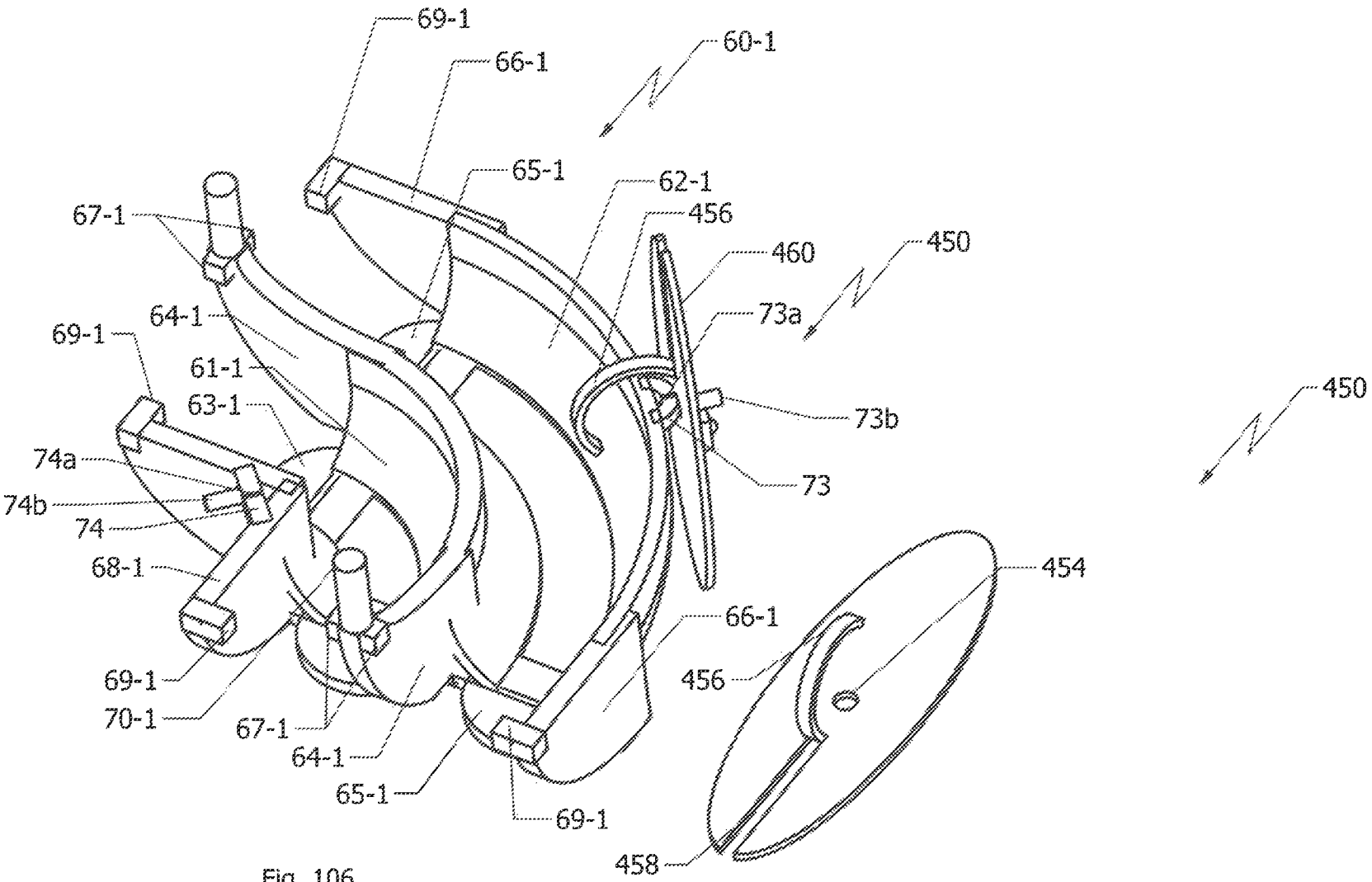
FIG. 106 is a top, end perspective view of a dual-track turn connector with a wiggling, vibrating, or oscillating shield ornament assembled to the connector according to still another embodiment of the disclosure.
FIG. 107 is a back, end perspective view of the vibrating or oscillating shield ornament according to the embodiment of the disclosure shown in FIG. 106

Referring now to FIGS. 106 and 107119, in another aspect of the disclosure, the suspended curve connector 60' may be used to support additional ornamental and/or functional features of the race track assembly. As shown, an oscillating shield ornament, designated generally as 450, provides a means to create a visual effect when struck with a marble or spherical object travelling around curve connector 60'. Oscillating shield 450 is generally oval in shape with a front surface and a back surface 452. The shape of the shield can be modified from the oval shape and remain with the scope of the disclosure. The front surface may be painted or coated to shine and reflect different bands of light when the ornament vibrates or oscillates about outer ring post 73*b*.

An ornament through-bore 454 is formed in oscillating shield 450 to receive outer ring post 74*b*. The diameter of through-bore 454 is dimensioned to provide a loose fit over ring post 73*b*. to permit oscillating shield 450 to oscillate about the post. A rounded strike band 456 extends from back surface 452 and extends into the open space above second outer base section 62'. Strike band 456 can be formed by separating a strip from oscillating shield ornament 450 to form a slot 458. The combination of the slot and the strike band create a weight asymmetry in oscillating shield 450 with the shield's weight biased toward the end to which the strike band is attached. When a spherical object impacts against strike band 456, the asymmetrical weight distribution coupled with the loose fit on outer ring post 73*b* causes oscillating shield 450 to oscillate and deflect light rays with its shiny front surface to provide a pleasurable light effect. It should be understood that an oscillating shield ornament 450 also can be placed on inner ring post 74*b* to provide a similar effect for the inner track.

Figures 108, 109, 110:
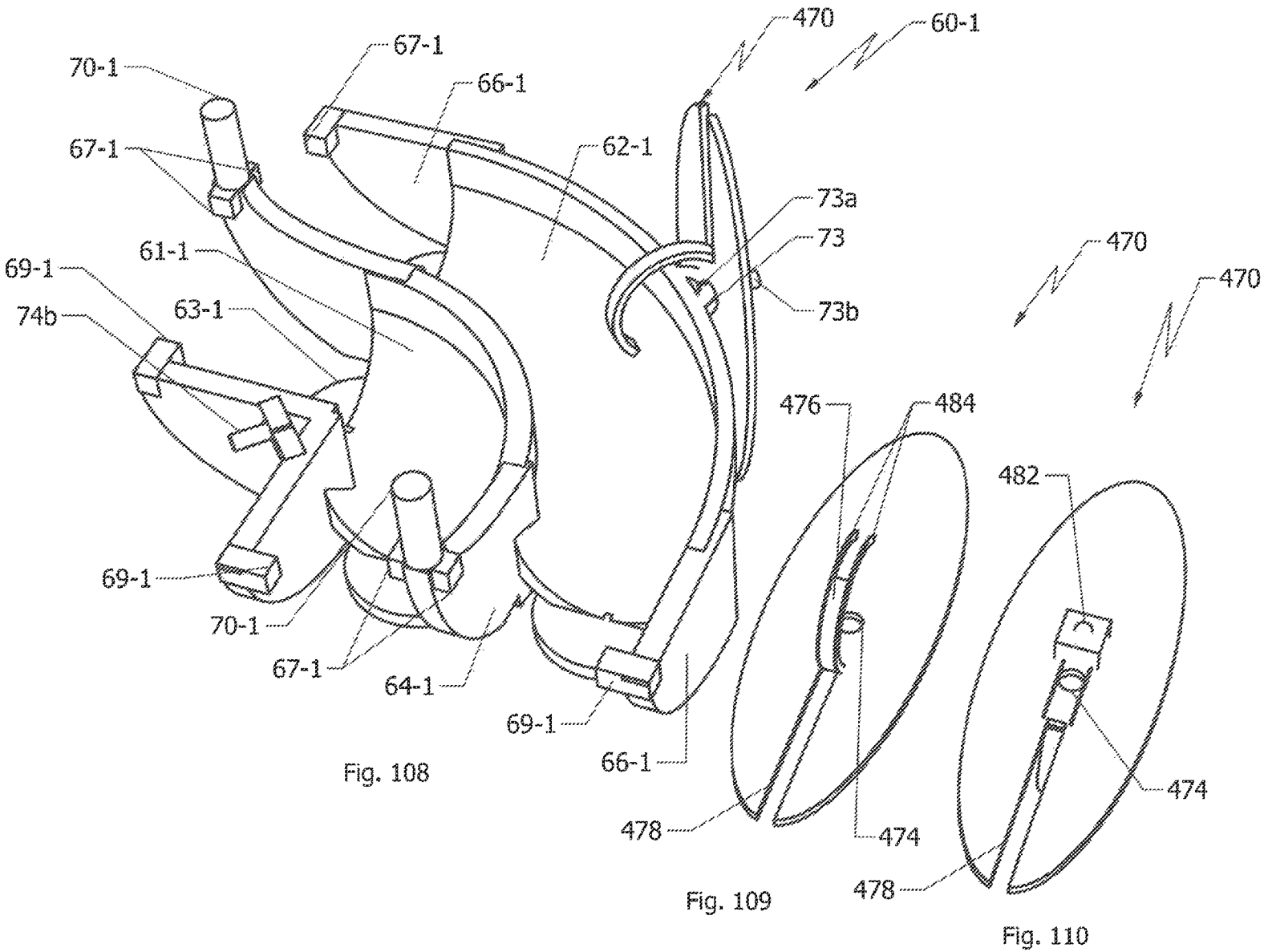
FIG. 108 is a top, end perspective view of a dual-track turn connector with a lighted oscillating shield ornament assembled to the connector according to a further embodiment of the disclosure.
FIG. 109 is a bottom, back, end perspective view of the lighted oscillating shield ornament according to the embodiment of the disclosure shown in FIG. 108.
FIG. 110 is a top, front, end perspective view of the lighted oscillating shield ornament according to the embodiment of the disclosure shown in FIG. 108.

Referring now to FIGS. 108-110, in still another aspect of the disclosure, the suspended curve connector 60' may be used to support a different form of the oscillating shield ornament shown in FIGS. 109 and 110. As shown, a lighted oscillating shield ornament, designated generally as 470, provides a means to create a different visual effect when struck with a marble or spherical object travelling around curve connector 60'. Oscillating shield 470 is generally oval in shape with a front surface 480 and a back surface 472. The shape of the shield can be modified from the oval shape and remain with the scope of the disclosure. The front surface includes a light diode 474 that emits light when oscillating shield is struck.

An ornament through-bore 474 is formed in lighted oscillating shield 470 to receive outer ring post 73*b*. The diameter of through-bore 474 is dimensioned to provide a loose fit over ring post 73*b* to permit lighted oscillating shield 470 to oscillate about the post 474. A rounded strike band 476 extends from back surface 472 and extends into the open space above second outer base section 62'. Strike band 476 can be formed by separating a strip from oscillating shield ornament 470 to form a slot 478. The combination of the slot and the strike band create a weight asymmetry in lighted oscillating shield 470 with the shield's weight biased toward the end to which the strike band is attached. When a spherical object impacts against strike band 476, the asymmetrical weight distribution coupled with the loose fit on outer ring post 73*b* causes lighted oscillating shield 470 to oscillate. At the end of the rounded strike band 476 are two electrical contacts 484. When the spherical object strikes the contacts, the electrical switch is turned on and the light emitting diode 482 is activated. It should be understood that a lighted oscillating shield ornament 470 also can be placed on inner ring post 74*b* to provide a similar effect for the inner track. In an alternative embodiment, light activation includes an inertial switch in the light emitting diode 482. This embodiment does not require electrical contacts 484. All electrical elements—batteries, motion activated sensor and light emitter—are included in the light emitting diode 482.

Figure 121:
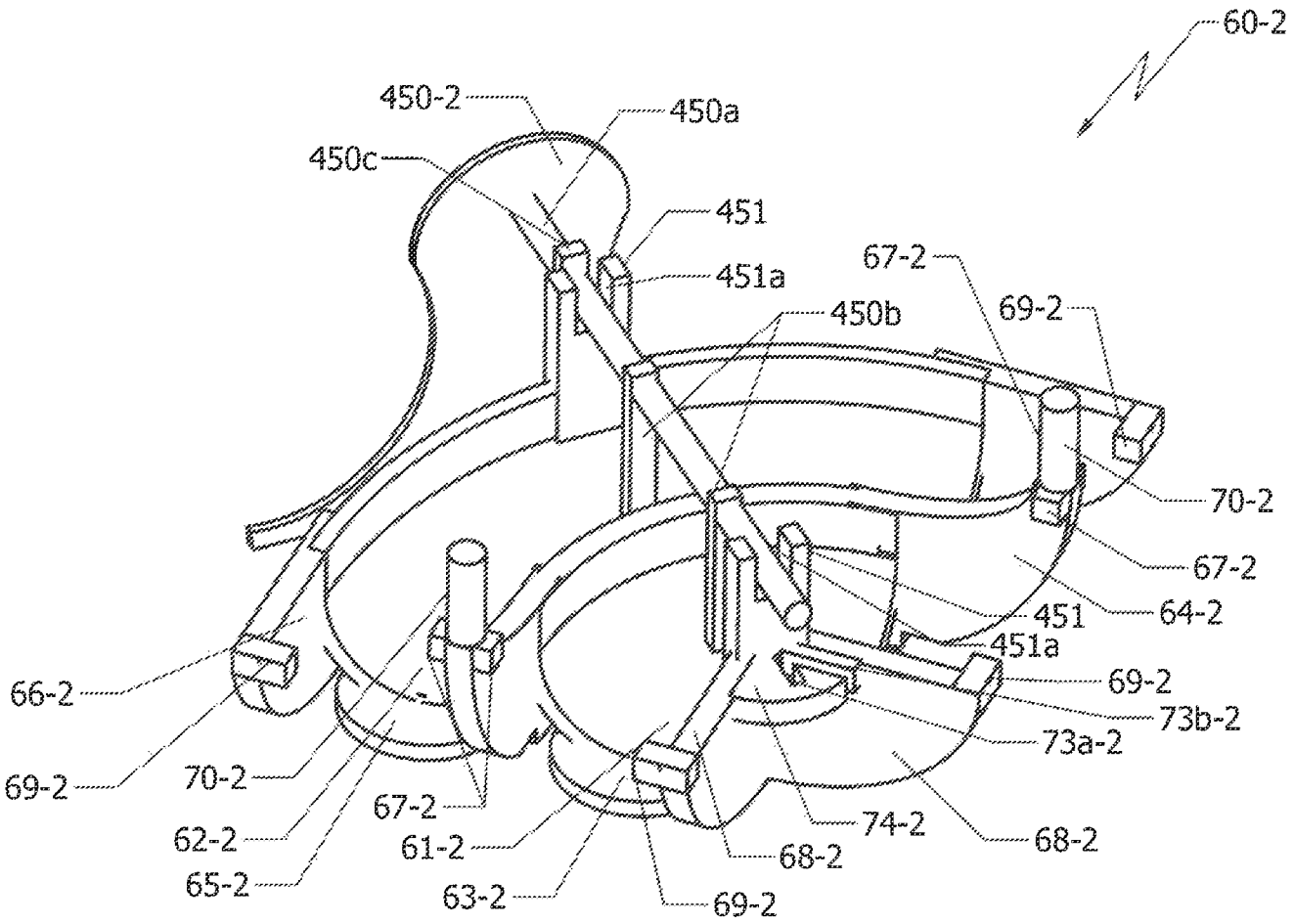

Referring now to FIG. 121, in still another aspect of the disclosure, an ornament curve connector, designated generally as 60", is a modified version of suspended curve connector 60' that includes features to rotate an ornament attached to a rotating axle described in more detail below. Ornament curve connector 60", is formed with an approximately 90° angle. It should be understood that connector 60" may be formed with any angle between 0° and 180°. Curve connector 60" has two radiused or rounded base sections with unequal lengths. A first inner base section 61" is shorter than a second outer base section 62". The unequal lengths of the base sections are required to maintain planar alignment of the leading and trailing edges of the base sections to receive trailing or leading ends of dual-track segments.

First inner base section 61" has a track-receiving tab 63" extending axially from each end and coplanar with the antapex or lowest point of the rounded base section. Second outer base section 62" has a track-receiving tab 65" extending axially from each end and coplanar with the antapex or lowest point of the rounded base section. Like tabs 43, track-receiving tabs 63" and 65" provide structural support for the bottom ends of dual-track segments secured to ornament curved connector 60". A center support wall 64" extends upwardly from each end of the base, between base sections 61" and 62". Each end of center support wall 64" is formed with laterally extending center wall locking tabs 67" dimensioned to be inserted into any variation of through-bores 18 to secure the inner walls defining each track tunnel.

Extending upwardly from each end of support wall 64" is a track support post 70". Post 70" is shown as having a cylindrical shape. It should be understood that the shape of the post can conform to any regular or irregular geometric shape and remain with the scope of the disclosure. Post 70" is dimensioned to fit within a corresponding through-bore 18 to further secure a track section to the connector. Ornament curve connector 60" may be formed with a track connection post (not shown) that extends upwardly from center support wall 64" and is formed at the approximate center of the support wall like track connection post 72 of curve connector 60'. Such a connection post, if included, provides a structural means to further secure track sections to ornament curve connector 60" via elastomeric retaining members, locking bars (disclosed in more detail herein) and the like.

Extending upwardly from the lateral edges of base sections 61" and 62" are connection sidewalls 68" and 66", respectively. Extending laterally inwardly from the top ends of the sidewalls are sidewall locking tabs 69". Locking tabs 69' perform the same function as center wall locking tabs 67". Each sidewall locking tab engages a dedicated through-bore 18 (and any variant) to secure a track tunnel to ornament curve connector 60". Locking tabs 69" may be positioned on a different plane than the plane occupied by center wall locking tabs 67" in order to better secure the radial orientation of a dual-track segment relative to ornament curve connector 60".

To enable ornament curve connector 60" to be suspended from a higher surface, an outer curve connector ring (not shown, but similar to outer curve connector ring 73 of suspended curve connector 60') is formed extending radially outwardly from the approximate apex of the curve at or near the top edge of exterior curved sidewall of ornament curve connector 60". An inner curve connector ring 74" is formed in the angular junction of connection sidewalls 68" at or near the top edge of the sidewalls. Curve connector rings 73 and 74" may be slotted with vertically oriented slots, 73*a*" and 74*b*", respectively, to receive a suspension elevation support 406 (not shown). If the curve connectors are formed without a slot, a suspension elevation support 406 is inserted into each connector ring.

To receive a rotating ornament/ornament axle combination, ornament curve connector 60" is formed with axle supports 451 extending upwardly from connection sidewalls 68" and 66". Axle supports 451 are formed with slots 451*a* to receive an ornament axle 450*a*. Ornament axle 450*a* is secured to a back side of a rotating ornament 450". Suspended downwardly from ornament axle 450*a* are two strike posts 450*b*. Each strike post 450*b* is suspended over a base section, either 61" or 62". To maintain the strike posts in the ready/down position, the attachment of ornament axle 450*a* to rotating ornament 450" is offset or biased toward a top end of the ornament. In this orientation, the majority of the weight of the ornament is positioned below the axle attachment. This results in the ornament and strike posts to be in the ready/down position. When a spherical object rolls around ornament curve connector 60", the spherical object will strike the strike post and cause the rotating ornament/ornament axle assembly to rotate within the axle supports 451. An axle stop 450*c* may be secured to ornament axle 450*a* to register against axle support 451 to set the spatial orientation of rotating ornament 450" to the overall ornament curve connector 60". A second axle stop (not shown) may be secured to an end of rotating axle 450*a* proximal the axle support 451 extending from the inner side walls 68" to lock the radial orientation of the rotating ornament/ornament axle to ornamental curve connector 60".

Figures 86, 87:
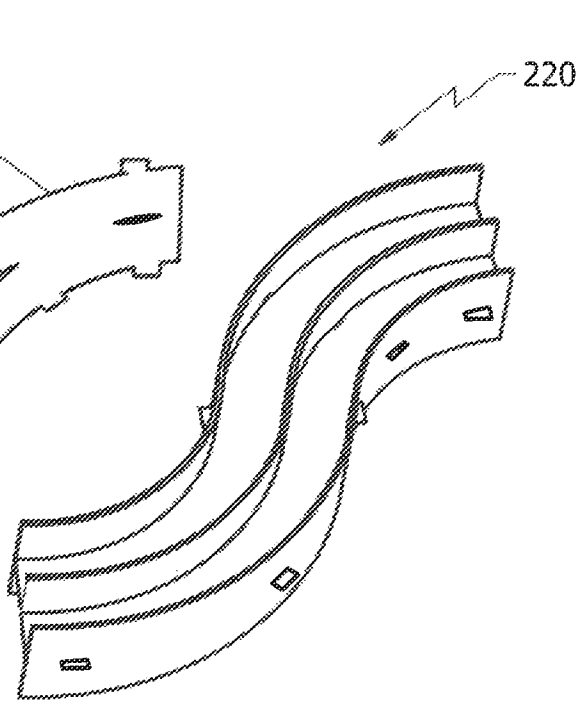
FIG. 86 is a top end exploded view of the components of an S-curve track segment according to yet another embodiment of the disclosure.
FIG. 87 is a top perspective view of an assembled S-curve track segment according to the embodiment of the disclosure shown in FIG. 86

Referring now to FIGS. 86 and 87, in a further aspect of the disclosure, an open dual-track S-curve, designated generally as 220, is formed from a series of interlocking sheet sections to form parallel tracks with open tops. An S-curve base section 222 is formed in the shape of an "S" with a plurality of S-curve slots 225 formed along a centerline of the base section. A plurality of S-curve tabs 226 extend laterally from the side edges of the base section. A pair of S-curve sidewall sections 224 are formed with sidewall slots 218 dimensioned for insertion into S-curve tabs 226. To assemble the sidewalls to the base section, the sidewalls are placed against the base section with the sidewall slots 218 each aligned with a corresponding tab 226. The sidewalls are urged toward the base section until the tabs are fully inserted through the slots until the sidewalls register against the contours of the base section edges. In this manner, the sidewalls take on the "S" shape of the base section.

To create a division of S-curve base section 222 to form two lanes or tracks, an S-curve center wall is formed from S-curve center wall sections 223. The center wall section has a width approximately one-half the width of sidewall sections 224 and is formed with a plurality of tabs 229 extending from one longitudinal edge and dimensioned to fit within slots 225. The wall section 223 is positioned on a top surface of base section 222 with tabs 229 each aligned with a corresponding slot 225. Tabs 229 are inserted into slots 225 until a bottom edge of the wall section registers against the top surface of base section 222. Once the tabs and slots are engaged, center wall section 223 will conform to the "S" shape of base section 222. This wall section will function as a partition to create and define two tracks or lanes.

A second center wall section can be added next to the first center wall section, in order to provide an improved attachment method for the track connectors. Both the sidewalls and the center wall section are formed with through-bores 228 to permit dual track S-curve 220 to be secured to connectors and other track sections. The through-bores are positioned to match the location of the locking tabs from the track connectors, as described herein. The S-curve shown in FIG. 87 has an approximate 45-degree angle at its center with a 0 degree change in the track outgoing direction. The scope of the disclosure includes all combinations of curves and straight sections of track built in the manner described with outgoing directions up to 180 degrees from the incoming direction.

Figure 88:
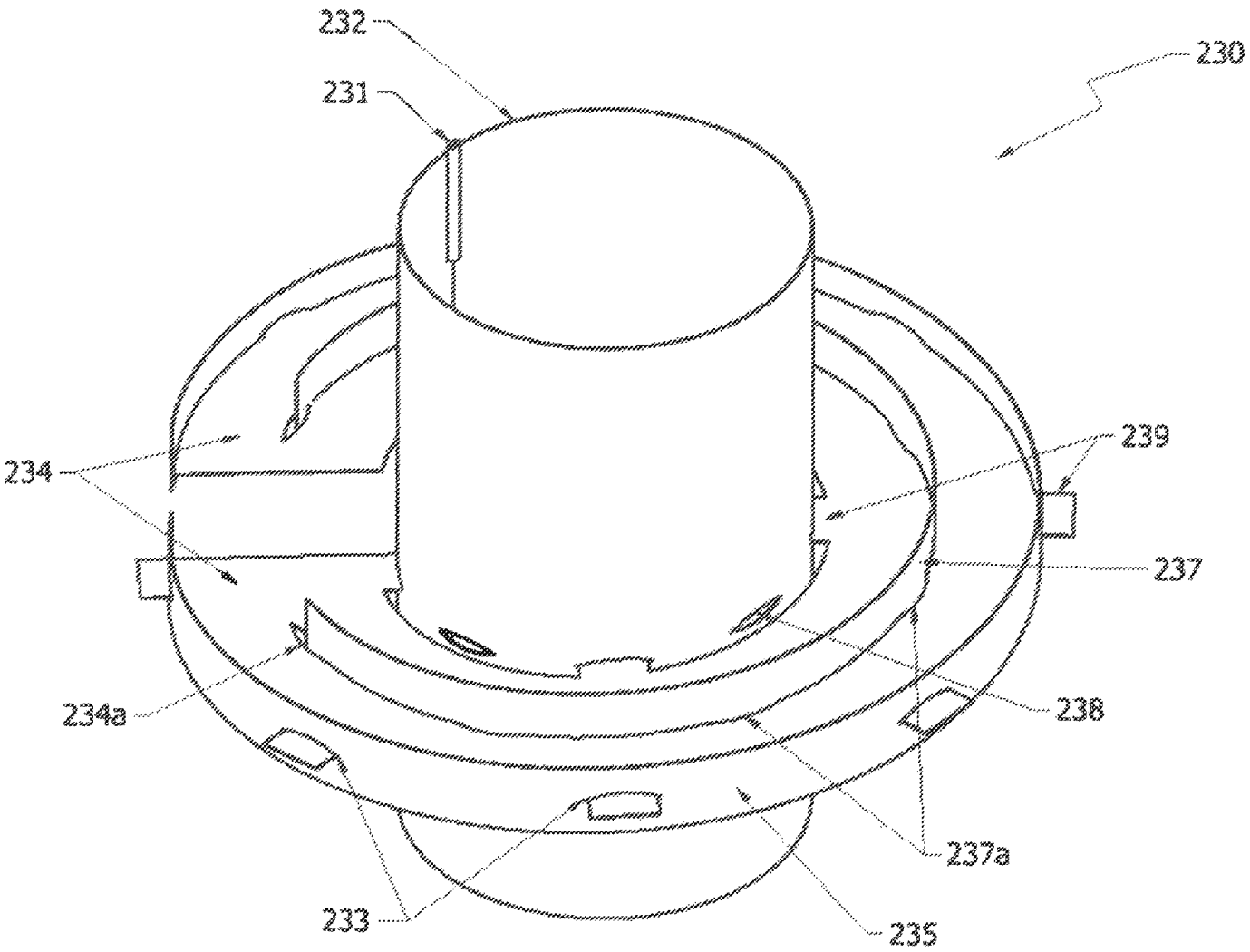
FIG. 88 is a top side perspective view in phantom of a spiral module according to still another embodiment of the disclosure.

Referring now to FIG. 88, in yet another aspect of the disclosure, a spiral module, designated generally as 230, provides a means to change elevation by circling around a center support cylinder 232 that supports a descending dual-track ramp 234. Dual-track ramp 234 is formed from sheet material that conforms to a circular pattern, or some portion of a circular pattern. Center support cylinder 232 is formed from a sheet rolled to form a cylinder. An elongated two-sided retaining clip 231 is used to secure the ends of the sheet to form the cylinder. Center support cylinder 232 can also be formed from a solid tube structure (not shown). A plurality of cylinder slots 238 are formed in a descending spiral pattern about support cylinder 232 to receive dual-track ramp 234. Dual-track ramp 234 is formed with a plurality of ramp tabs 239 on both sides of the ramp. An inner set of ramp tabs 239 are each aligned with a corresponding cylinder slot 238 and urged into the slots until an inner edge of ramp 234 registers against an outer surface of support cylinder 232. With the ramp tabs fully engaged with the cylinder slots, the ramp will conform to the spiral profile of the cylinder slots and form the spiraling ramp as shown. The outer surface of support cylinder 232 will function as an inner wall of the innermost lane or track formed on ramp 234.

To create an outer wall for the ramp, an outer spiral wall 235 is formed from a sheet strip with a plurality of outer wall slots 233 formed in the sheet strip and biased toward one side of the sheet. To secure outer spiral wall 235 to dual-track ramp 234, wall slots 233 are each aligned with ramp tabs 239 positioned on an outer edge of ramp 234. The wall slots are urged over the ramp tabs until an inner surface of spiral wall 235 registers against the outer edge of ramp 234. Once fully engaged, outer spiral wall 235 will conform to the descending spiral shape of ramp 234.

To form two lanes or two tracks on ramp 234, a center wall 237 is formed from a sheet strip with a plurality of center wall tabs 237*a* extending from a lower edge of center wall 237. A series of ramp slots 234*a* are formed along a centerline of ramp 234 to receive center wall tabs 237*a*. To secure center wall 237 to ramp 234, center wall tabs 237*a* are each aligned with a ramp slot 234*a* and urged into the slots until the bottom edge of center wall 237 registers against a top surface of ramp 234 to form two lanes or tracks. The ends of the center wall 237 and outer spiral wall 235 may be formed with through-bores (not shown) to connect to track connectors and other track sections.

Figure 89:
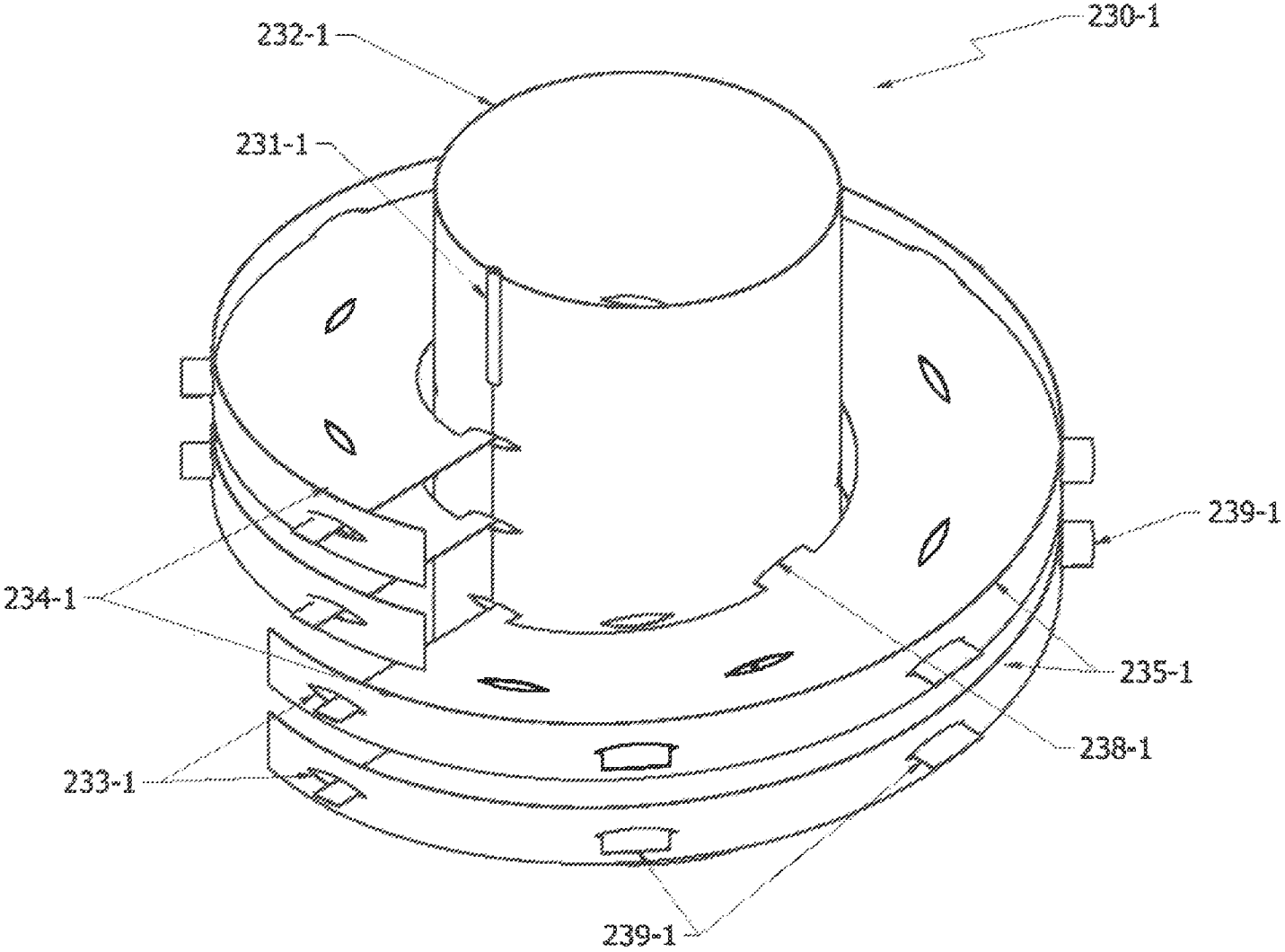
FIG. 89 is a top side perspective view in phantom of an advantage-neutral or fair spiral module according to a further embodiment of the disclosure.

Referring now to FIG. 89, in a still further aspect of the disclosure, a neutral-advantage or fair spiral module, designated generally as 230', has dual tracks or lanes aligned vertically so any spherical objects racing on the lanes or tracks will travel the same distance about the spiral module. A center support cylinder 232' supports two descending single-track ramps 234' aligned vertically. Single track ramps 234' are formed from sheet material that conform to a circular pattern, or some portion of a circular pattern. Center support cylinder 232' is formed from a sheet rolled to form a cylinder. An elongated two-sided retaining clip 231' is used to secure the ends of the sheet to form the cylinder. Center support cylinder 232' can also be formed from a solid structure tube (not shown).

A plurality of cylinder slots 238' are formed in two parallel sets in a descending spiral pattern about support cylinder 232' to each receive a single-track ramp 234'. Each single-track ramp 234' is formed with a plurality of ramp tabs 239' on both sides of the ramp. An inner set of ramp tabs 239' are each aligned with a corresponding cylinder slot 238' from one set of the parallel cylinder slots and urged into the slots until an inner edge of ramp 234' registers against an outer surface of support cylinder 232'. With the ramp tabs fully engaged with the cylinder slots, each ramp will conform to the spiral profile of the cylinder slots and form a spiraling ramp as shown. The outer surface of support cylinder 232' will function as an inner wall for each of the ramps 234'.

To create an outer wall for the ramps, an outer spiral wall 235' is formed from a sheet strip (double the width of the sheet strip used for spiral wall 235) with two spaced parallel sets of a plurality of outer wall slots 233' formed in the sheet strip and biased toward one side of the sheet. By biasing the slots toward one side edge of the sheet, the top section of the sheet will function as the wall for an upper ramp and the space between the parallel slot sets will function as the wall for the lower ramp. To secure outer spiral wall 235' to each of the single-track ramps 234', wall slots 233' from one of the parallel sets are each aligned with ramp tabs 239' positioned on an outer edge of one of the ramps 234'. The wall slots are urged over the ramp tabs until an inner surface of spiral wall 235' registers against the outer edge of the one ramp 234'. Once fully engaged, outer spiral wall 235' will conform to the descending spiral shape of the one ramp 234'. The same procedure is used to secure outer spiral wall 235' to the second ramp 234' with the attachment processes being performed simultaneously. The ends of the outer spiral wall 235' may be formed with through-bores (not shown) to connect to track connectors and other track sections. A special adapter with through-bores may be secured to the outer surface of support cylinder 232' at the ends of ramps 234' to provide a means to secure the inner sides of the lanes or tracks to the connectors and other track sections disclosed herein. In an alternative embodiment, outer wall 235' is one with a single row of outer wall slots. This version attaches to one single-track ramp 234'. This embodiment is shown in FIG. 89.

Figure 90:
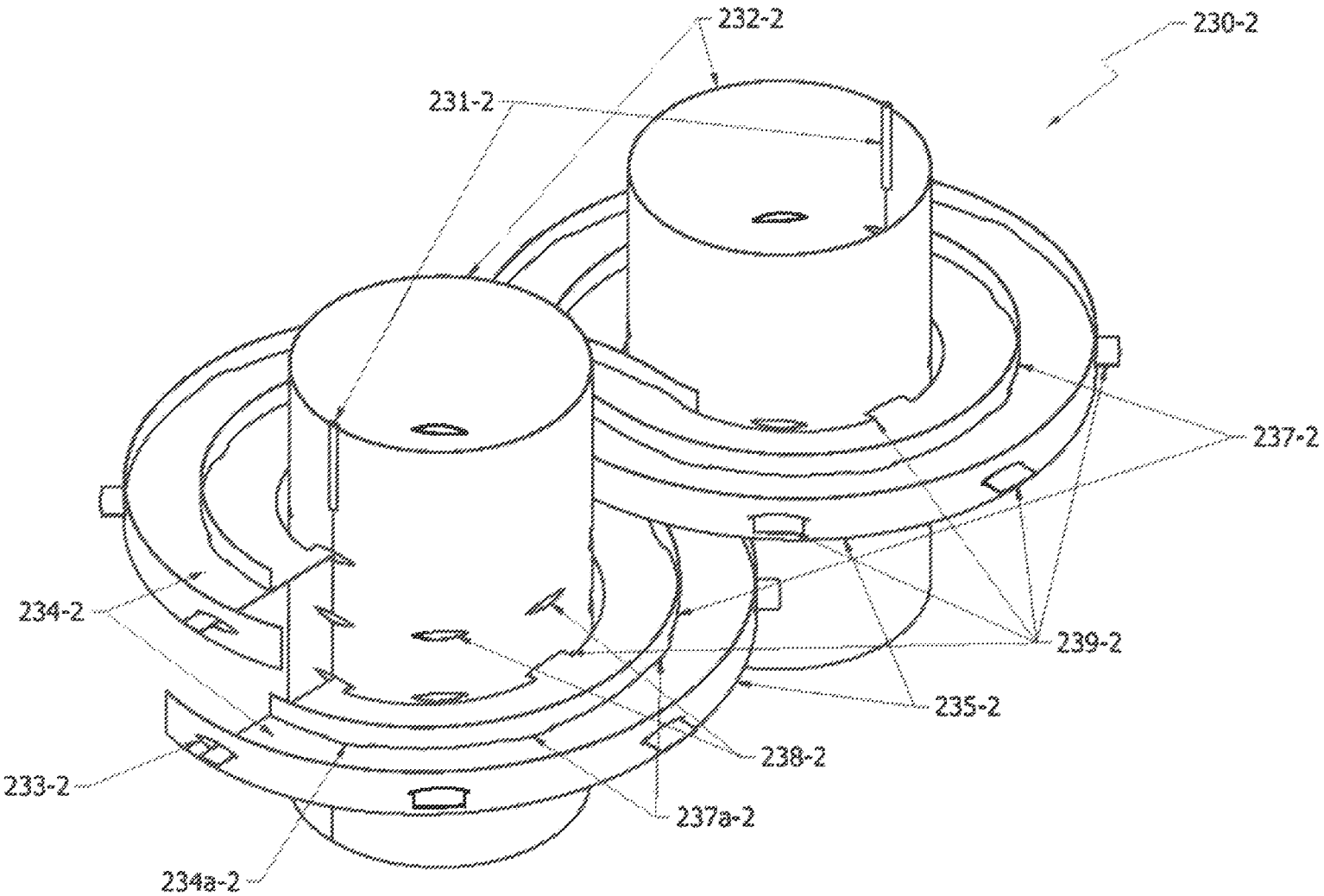
FIG. 90 is a top side perspective view in phantom of a figure-8 spiral module according to a yet further embodiment of the disclosure.

Referring now to FIG. 90, in a still further aspect of the disclosure, a figure-8 spiral module, designated generally as 230", provides a means to change elevation by circling around a pair of center support cylinders 232" in a figure-8 pattern that support a descending dual-track ramp 234". Center support cylinders 232" are each formed from a sheet rolled to form a cylinder. An elongated two-sided retaining clip 231" is used to secure the ends of each sheet to form the cylinder. Center support cylinder can also be formed from a solid structure tube (not shown). A plurality of cylinder slots 238" are formed in a descending spiral pattern about each support cylinder 232" to receive dual-track ramp 234". The spiral pattern on each support cylinder is continuous and aligned with slots formed on the other support cylinder.

Dual-track ramp 234" is formed from sheet material that conforms to a figure-8 pattern, or some portion of a figure-8 pattern. Ramp 234" is formed with a plurality of ramp tabs 239" extending laterally on both sides of the ramp. An inner set of ramp tabs 239" are each aligned with a corresponding cylinder slot 238" on one of the two support cylinders 232" and are urged into the slots until an inner edge of ramp 234" registers against outer surfaces of support cylinders 232". With the ramp tabs fully engaged with the cylinder slots, the ramp will conform to the spiral figure-8 profile of the combined cylinder slots and form the spiraling, figure-8 ramp 234" as shown. The outer surfaces of support cylinders 232" will function as an inner wall of the innermost lane or track formed on ramp 234".

To create an outer wall for the ramp, an outer spiral, figure-8 wall 235" is formed from a sheet strip with a plurality of outer wall slots 233" formed in the sheet strip and biased toward one side of the sheet. To secure outer spiral wall 235" to dual-track ramp 234", wall slots 233" are each aligned with ramp tabs 239" positioned on an outer edge of ramp 234". The wall slots are urged over the ramp tabs until an inner surface of spiral wall 235" registers against the outer edge of ramp 234". Once fully engaged, outer spiral, figure-8 wall 235" will conform to the descending, figure-8 spiral shape of ramp 234".

To form two lanes or two tracks on ramp 234", a figure-8 center wall 237" is formed from a sheet strip with a plurality of center wall tabs 237*a*" extending from a lower edge of center wall 237". A series of ramp slots 234*a*" are formed along a centerline of ramp 234" to receive center wall tabs 237*a*". To secure center wall 237" to ramp 234", center wall tabs 237*a*" are each aligned with a ramp slot 234*a*" and urged into the slots until the bottom edge of center wall 237" registers against a top surface of ramp 234" to form two lanes or tracks in a spiral descending, figure-8 pattern. The ends of figure-8 center wall 237" and outer figure-8 spiral wall 235" may be formed with through-bores (not shown) to connect to track connectors and other track sections.

Figure 91:
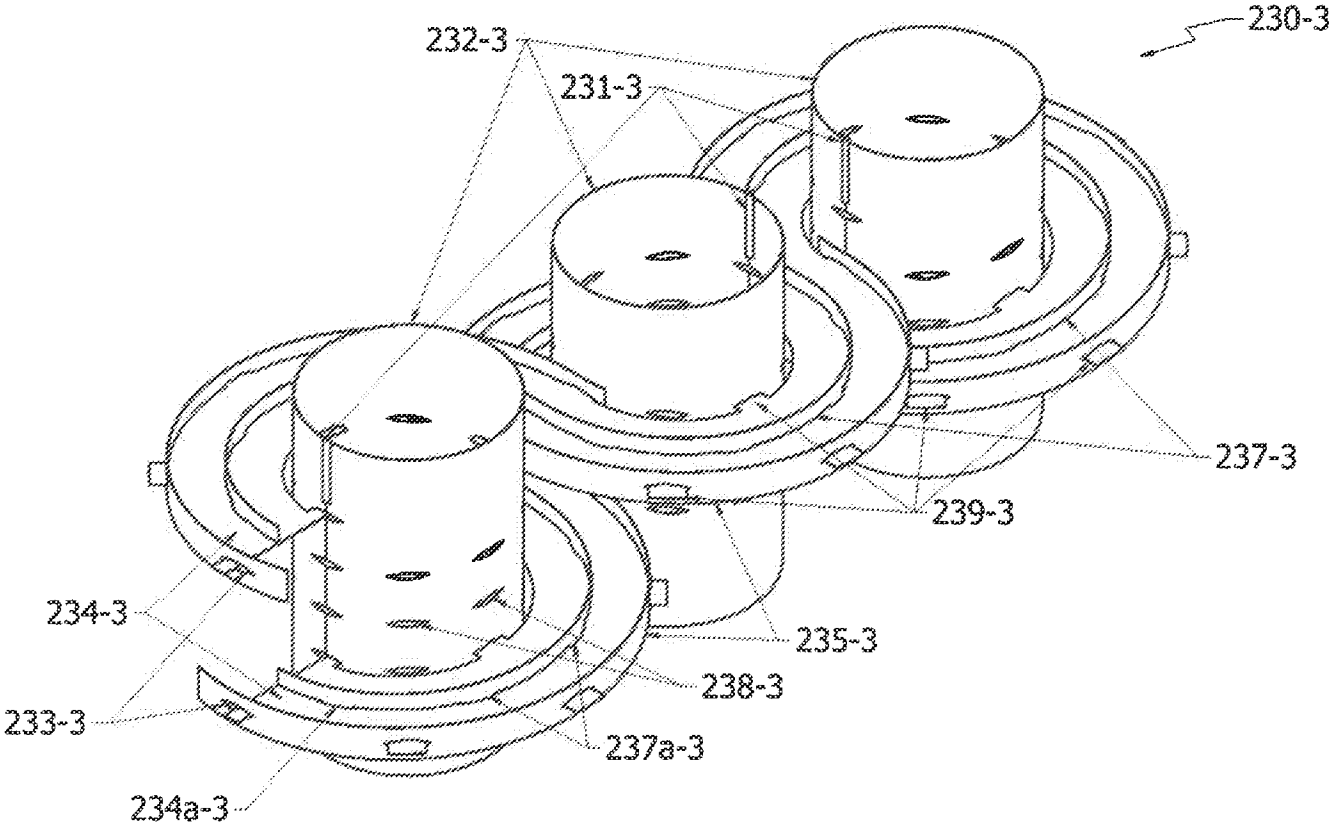
FIG. 91 is a top side perspective view in phantom of a multi-spiral module according to a still further embodiment of the disclosure.

Referring now to FIG. 91, in yet another aspect of the disclosure, a multi-spiral module, designated generally as 230'", provides a means to change elevation by circling around a plurality of center support cylinders 232'" in overlapping figure-8 patterns that support a descending dual-track ramp 234'''. Center support cylinders 232''' are each formed from a sheet rolled to form a cylinder. An elongated two-sided retaining clip 231''' is used to secure the ends of each sheet to form the cylinder. Center support cylinder 232''' can also be formed from a solid structure tube (not shown). A plurality of cylinder slots 238''' are formed in a descending spiral pattern about each support cylinder 232''' to receive dual-track ramp 234'''. The spiral pattern on each support cylinder is continuous and aligned with slots formed on one or more of the other support cylinders.

Dual-track ramp 234''' is formed from sheet material that conforms to an overlapping figure-8 pattern or some portion of a FIG. 8 pattern. Ramp 234''' is formed with a plurality of ramp tabs 239''' on both sides of the ramp. An inner set of ramp tabs 239''' are each aligned with a corresponding cylinder slot 238''' on one of the support cylinders 232''' and are urged into the slots until an inner edge of ramp 234''' registers against outer surfaces of support cylinders 232'''. With the ramp tabs fully engaged with the cylinder slots, the ramp will conform to the spiral overlapping figure-8 profile of the combined cylinder slots and form the spiraling, overlapping figure-8 ramp 234''' as shown. The outer surfaces of support cylinders 232''' will function as an inner wall of the innermost lane or track formed on ramp 234'''.

To create an outer wall for the ramp, an outer spiral, overlapping figure-8 wall 235''' is formed from a sheet strip with a plurality of outer wall slots 233''' formed in the sheet strip and biased toward one side of the sheet. To secure outer spiral wall 235''' to dual-track ramp 234''', wall slots 233''' are each aligned with ramp tabs 239''' positioned on an outer edge of ramp 234'''. The wall slots are urged over the ramp tabs until an inner surface of spiral wall 235''' registers against the outer edge of ramp 234'''. Once fully engaged, outer spiral, overlapping figure-8 wall 235''' will conform to the descending, overlapping figure-8 spiral shape of ramp 234'''.

To form two lanes or two tracks on ramp 234''', a figure-8 center wall 237''' is formed from a sheet strip with a plurality of center wall tabs **237*a*''' extending from a lower edge of center wall 237'''. A series of ramp slots 234*a*''' are formed along a centerline of ramp 234''' to receive center wall tabs 237*a*'''. To secure center wall 237''' to ramp 234''', center wall tabs 237*a*''' are each aligned with a ramp slot 234*a*''' and urged into the slots until the bottom edge of center wall 237''' registers against a top surface of ramp 234''' to form two lanes or tracks in a spiral descending, figure-8 pattern. The ends of figure-8 center wall 237''' and outer figure-8 spiral wall 235'''** may be formed with through-bores (not shown) to connect to track connectors and other track sections.

Figures 92, 93:
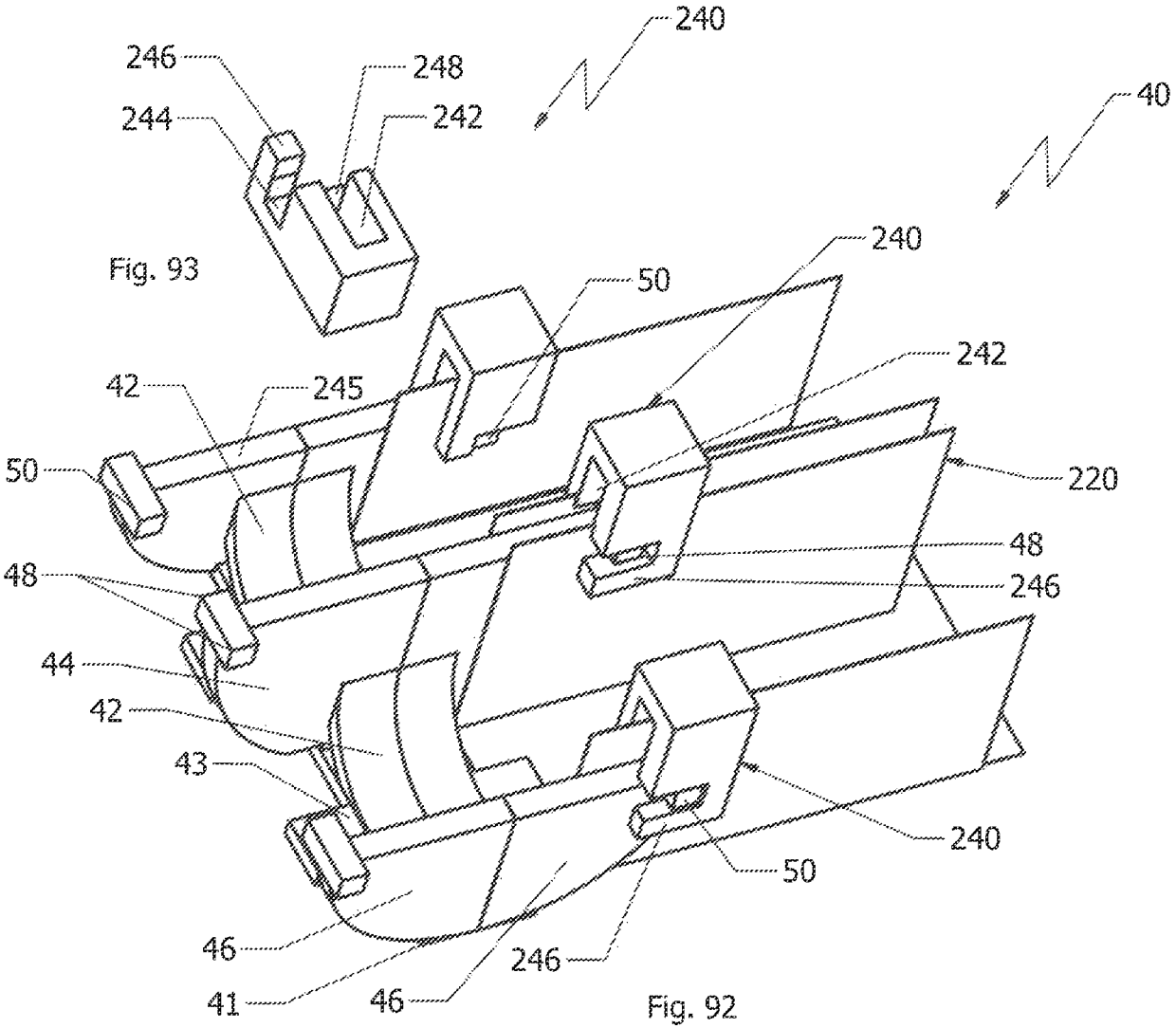
FIG. 92 is a top side perspective view of a dual-track straight connector and open dual-track segment secured with a clip attachment according to another embodiment of the disclosure.
FIG. 93 is a top side perspective view of the clip attachment shown in FIG. 92.

Referring now to FIGS. 92 and 93, a clip attachment for open track sections, designated generally as 240, provides a means to secure track connectors disclosed herein to dual-track S-curve segments 220 that do not form tunnels. In the example shown, the track segment is joined to straight connector 40, the parts of which are disclosed in more detail herein. Straight connector 40 has no post 70 and has additional locking tabs 50 extending out of both sides of sidewalls 46. Clip attachment 240 is formed with a main longitudinal slot 242 dimensioned to slide over either a center wall or a sidewall of a dual-track segment. A partial horizontal slot 244 is formed proximal a bottom end of clip attachment 240 and is partially defined by a clip extension 246 formed on one side of the clip attachment. Slot 244 is dimensioned to receive a locking tab 50 of connector 40 or similar locking tab of other connectors disclosed herein in a releasably locking configuration. The clip attachment side opposite clip extension 246 has a back registration shoulder 248 that registers against a locking tab 50 but does not surround it like slot 244. It should be understood that clip attachment 240 can be formed to be symmetrical with two clip extensions 246 to form a complete horizontal slot or with clip extension 244 formed on either side to construct a left or right clip attachment. The absence of a clip extension 246 on one side of clip attachment 240 is to eliminate a possible surface that may interfere with the free travel of a spherical body through the connector and dual-track segments.

Referring now to FIGS. 94-96, in a still further embodiment of the disclosure, track segment attachment means include an elastomeric component-retaining member 262 (FIG. 94), a locking bar 252 (FIG. 95) and a track assembly clamp 272 (FIG. 96). Referring specifically to FIG. 94, two dual-track segments 10 joined by inserting a leading end of one dual-track segment 10 into a trailing end of a second dual-track segment 10 until a leading tab 14 extending from the one dual-track segment 10 inserted into the second track segment 10 registers against the trailing end of the second track segment 10. The leading tab 14 prevents further insertion of the one dual-track segment into the second dual-track segment. Once assembled, an elastomeric component-retaining member 262, e.g., a rubber band or O-ring, is placed over the leading tab 14 and one of the tabs 14 of the second dual-track segment 10 to releasably lock the dual-track segments together. Another elastomeric component 253 may be placed around the dual-track segment to maintain a round shape to the two tunnels together.

Referring specifically to FIG. 95, two dual-track segments 10 joined by inserting a leading end of one dual-track segment 10 into a trailing end of a second dual-track segment 10 until a leading tab 14 extending from the one dual-track segment 10 inserted into the second track segment 10 registers against the trailing end of the second track segment 10. The leading tab 14 prevents further insertion of the one dual-track segment into the second dual-track segment. The tabs 14 of the two dual-track segments 10 are formed with tab bores 15. Once assembled, a locking bar 252 having pins 254 extending laterally from the locking bar in the same direction, is placed over the interlocked dual-track segments and pins 254 are inserted into tab bores 15 of leading tab 14 and a tab 14 of the second dual-track segment 10 to releasably lock the dual-track segments together. It should be understood that the length of locking bar 252 can be varied to accommodate different tab spacing. It should also be understood that pins 254 can be formed with flanged ends to create a mechanical resistance to being pulled out of tab bores 15 without the application of a force sufficient to remove the pins from the tab bores. A locking pin 256 can also be placed in bore 15 of some tabs to hold the tabs in place. An elastomeric component 253 may be placed around the dual-track segment to maintain a round shape to the two tunnels together.

Referring specifically to FIG. 96, two dual-track segments 10 joined by inserting a leading end of one dual-track segment 10 into a trailing end of a second dual-track segment 10 until a leading tab 14 extending from the one dual-track segment 10 inserted into the second track segment 10 registers against the trailing end of the second track segment 10. The leading tab 14 prevents further insertion of the one dual-track segment into the second dual-track segment. Once assembled, a c-shaped track-assembly clamp 272 having clamp pins 274 extending laterally inwardly from the ends of clamp 272 is placed over the interlocked dual-track segments and clamp pins 274 are inserted into through-bores 18 to secure the dual-track segments together.

It should be understood that to have proper engagement of the clamp pins and the through-bores, the through-bores of the two dual-track segments have to be aligned to ensure full insertion of the clamp pins into the through-bores. It should be understood that track-assembly clamp 272 can be modified such as with the addition of a height adjustment pole adapter secured to a bottom of the clamp to enable the dual-track segments to be elevated.

Figure 103:
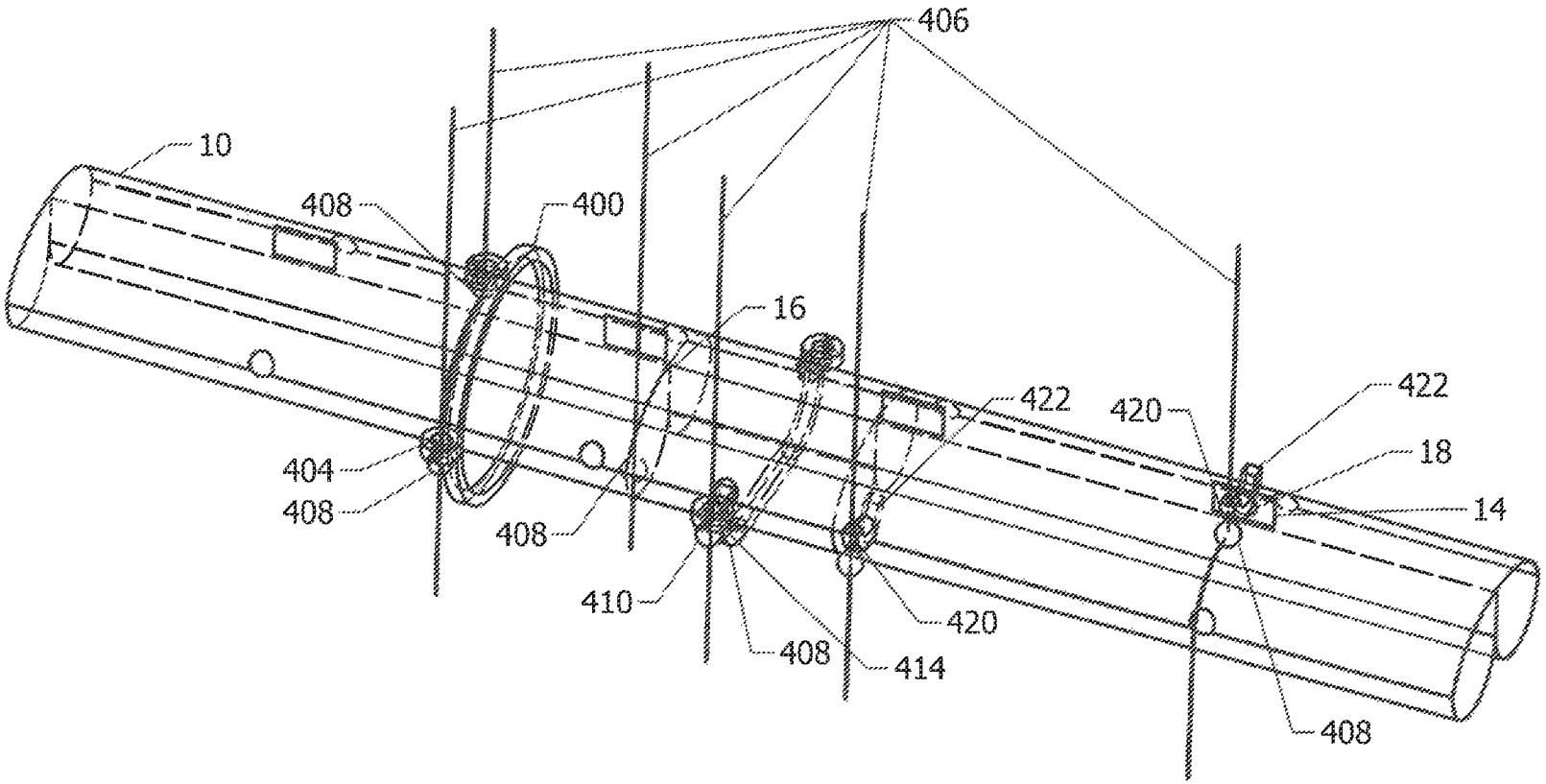
FIG. 103 is a top, side perspective view of a plurality of dual-track segment suspension elevation supports according to a plurality of embodiments of the disclosure.

Referring now to FIG. 103, a plurality of dual-track suspension assemblies are shown that permit dual-track segments to be suspended from an elevated horizontal surface, such as a ceiling. It should be understood that the suspension assemblies can be secured to any elevated surface to permit track segments to be suspended off a floor or ground surface. In one embodiment, a track suspension clamp ring, shown generally as 400, is circular in shape and surrounds a track segment. One or more clamp ring bores 404 are formed on an exterior surface of clamp ring 400. Clamp ring bores 404 may be positioned in diametrically opposite positions to enable a track segment to be elevated without altering its rotational position relative to a ground surface.

To elevate dual-track segment 10, one or more suspension elevation supports 406 are used to set the elevation of the track segment. Suspension elevation supports 406 can take the form of string, rope, chain, or any rigid or pliable elongate material that permits translational positioning of track segments along the suspension elevation supports. To set the height of a track segment on a suspension elevation support, a track-position setting ball 408 is used. Setting ball 408 is essentially a sphere with a through-bore dimensioned to enable movement along a suspension elevation support and yet create frictional engagement with the suspension elevation support when setting ball 408 registers against a clamp ring bore 404. It is believed registration of setting ball 408 against clamp ring bore 404 causes a slight distortion in the suspension elevation support 406 within setting ball 408 that causes the support and ball to be releasably locked into a frictional engagement to lock in a desired height. To change the height, the track/clamp ring assembly is lifted off setting ball 408 and the setting ball is repositioned or removed as desired. Setting ball 408 can also be a friction device such as an adjustable fishing weight made from materials like tin. Or the setting ball 408 can be a friction device similar to a spring energized fishing float adjustment device.

Still referring to FIG. 103, in another embodiment of the suspension elevation support system, a suspension elevation support 406 is fed through a slot 16 and a track segment is elevated by a setting ball 408 under the track segment, holding the track by supporting the bottom of the track directly. The suspension elevation support 406 is attached to an elevated surface such as a ceiling. The track segment is elevated solely with one or more suspension elevation supports 406 and a setting ball 408 for each elevation support.

In a further embodiment, a track assembly clamp 272 is modified with at least one clamp ring, designated 414 in this embodiment. The elevation track assembly clamp, designated generally as 410, has two track assembly clamp pins 412 extending inwardly from the ends of the clamp. Clamp pins 412 are dimensioned to fit within through-bores 18 to secure the clamp to track segment 10. Clamp ring 414 is part of the elevation track assembly clamp 410. The means used to secure a track segment/elevation track assembly clamp to a suspension elevation support 406 is the same as that used to secure the track segment 10/clamp ring 400 assembly. A setting ball 408 is moved along a suspension elevation support 406 until the desired height is reached and registration is achieved between the setting ball and clamp ring 414. Changes in the height of a track segment 10/elevation track assembly clamp 410 assembly are performed in the same manner as described for the track segment 10/clamp ring 400 assembly.

In a yet further embodiment of the disclosure, an outrigger support, designated generally as 420, is essentially one-half of a track assembly clamp 410. Outrigger support 420 has a clamp pin 422 extending inwardly relative to a track segment, dimensioned to fit within, and register against, a through-bore 18. A hole in an end of outrigger support 420 can receive a suspension elevation support 406. A setting ball 408 locks the elevation of a track segment 10 when the setting ball registers against clamp ring 424. The manner and means to adjust the height of the track segment relative to suspension elevation support 406 is the same as described for the track segment 10/clamp ring 400 assembly. In an alternative embodiment, a through-bore 18 can be formed in a tab 14. An end of outrigger support 420, opposite the end from which clamp ring 424 extends, is inserted through the tab through-bore until the clamp ring registers against the tab. A setting ball 408 releasably locks the position of the track segment on the suspension elevation support 406.

Figures 123, 124:
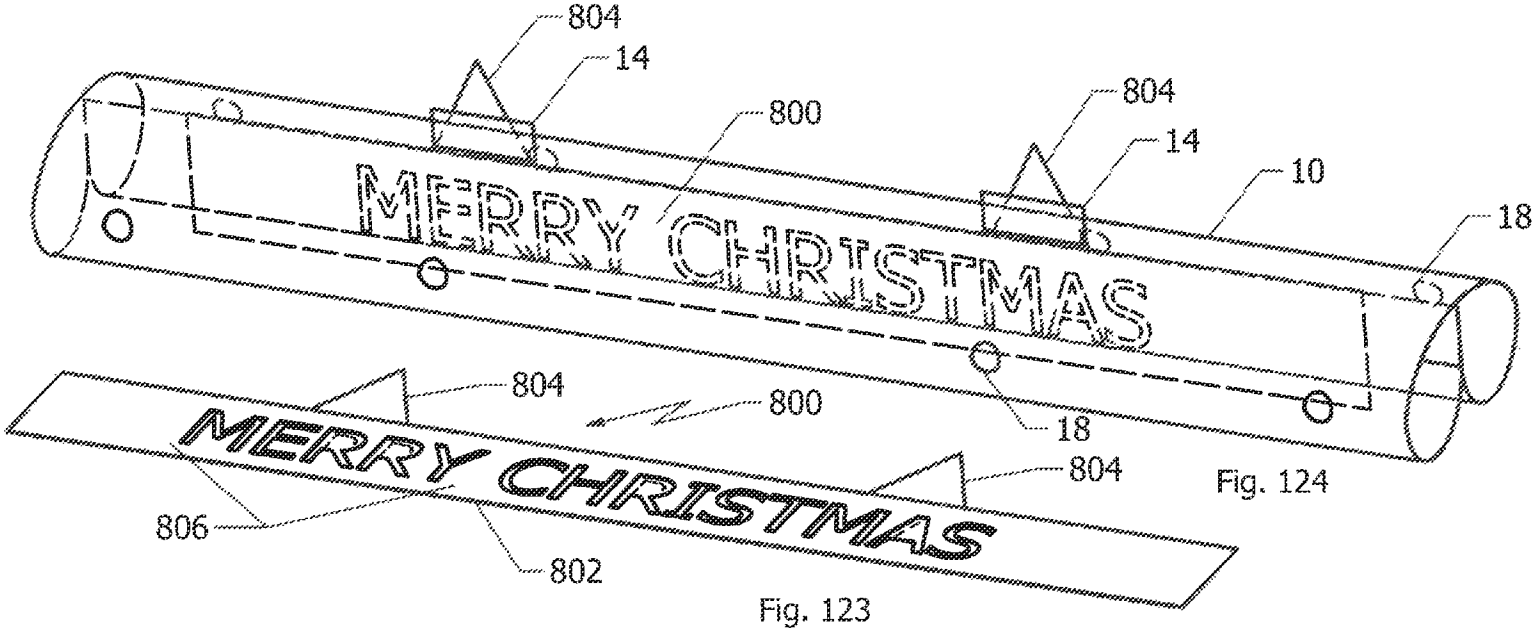

Referring now to FIGS. 123 and 124, in another aspect of the disclosure, a color/design/advertisement track modifier, shown generally as 800, enables modification of color and other characteristics of dual-track segments 10 and any of the variants disclosed herein. Track modifier 800 is formed from sheet material to be elongate with track modifier tabs 804 extending from a top edge and dimensioned to fit within slots 16 of a dual-track segment 10. Track modifier 800 may be made from any of the materials disclosed herein, may be transparent, opaque, colored and/or formed with terms, slogans, etc., such as the term "MERRY" 806 as shown. To secure track modifier 800 to a dual-track segment, the track modifier is slid into the central gap defined by the two track tubes and the track modifier tabs 804 are inserted into slots 16 along with tabs 14 to lock the track modifier to the dual-track segment. Track modifier 800 may also be formed without tabs 804 and held in place in the track segment by the frictional engagement of the two inner side walls 20 of the track segment.

Figures 126, 127:
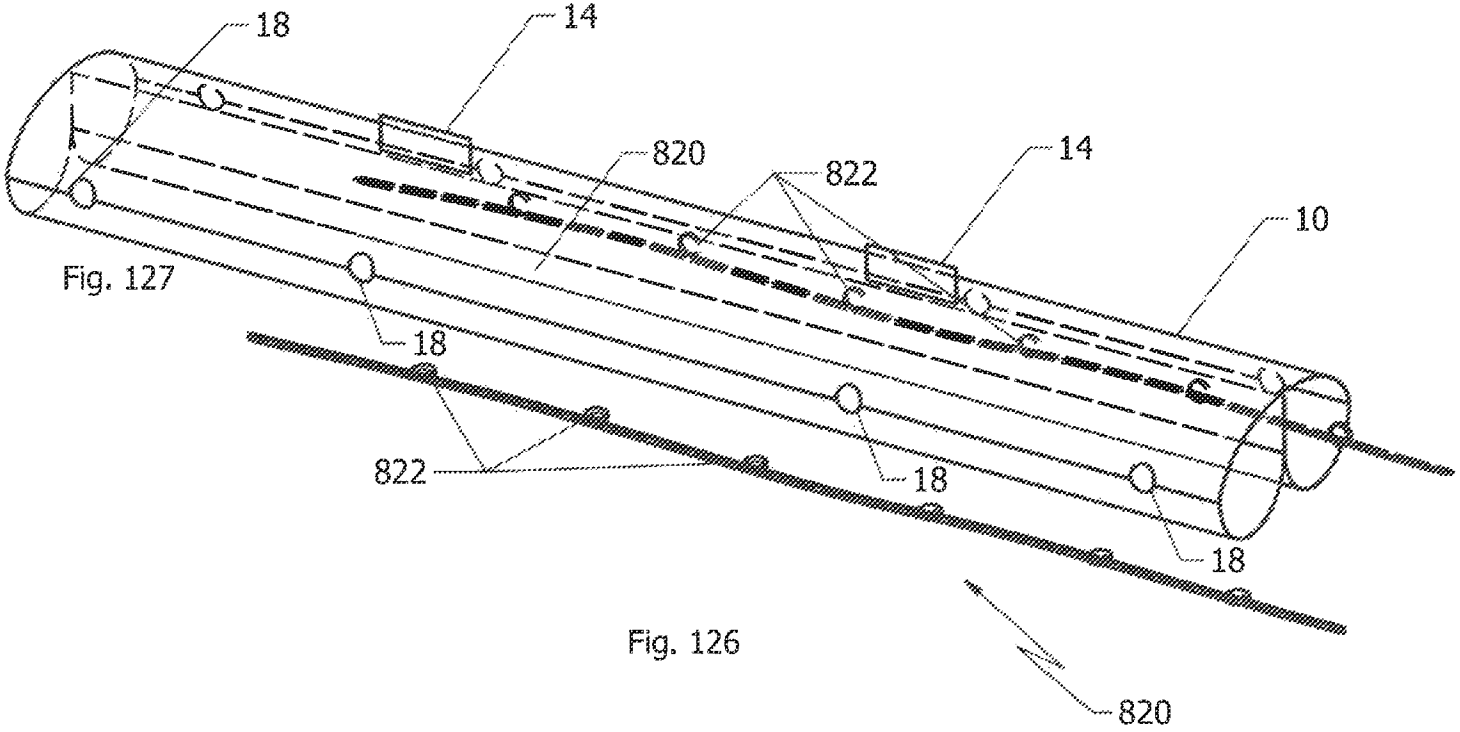

Referring now to FIGS. 126 and 127, in yet another aspect of the disclosure, a light string, designated generally as 820 in FIG. 139, provides a means to create lighting within a dual-track segment 10 or any variant of dual-track segments disclosed herein. Light string 820 includes a plurality of lights 822, such as LED lights spaced along the light string. Light string 820 may be opaque, transparent and/or colored. To secure light string 820 to dual-track assembly 10, the light string is inserted into the gap formed between the two track tubes. The force of the sidewalls 20 imparted against the light string maintains light string 820 within the dual-track assembly.

Figure 125:
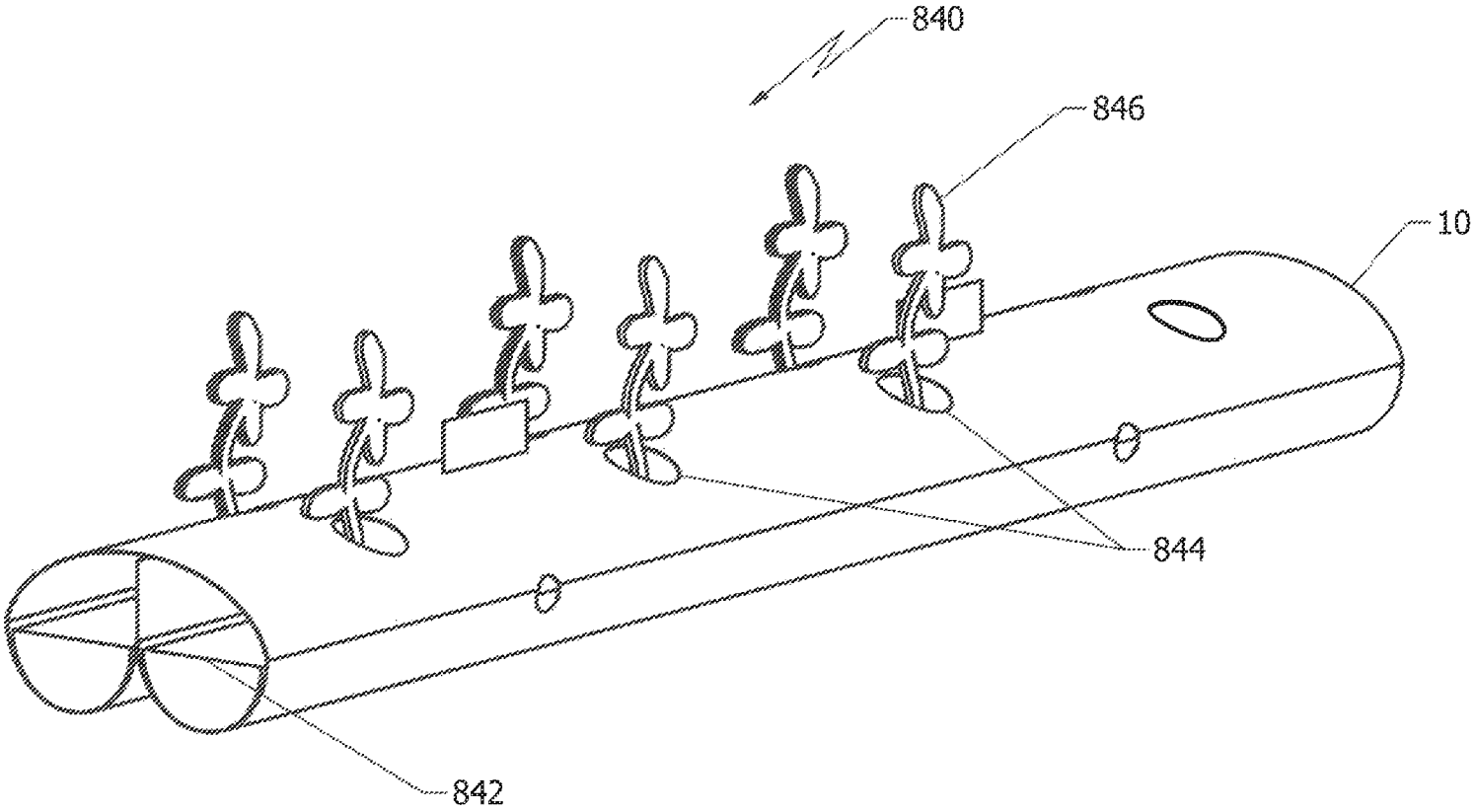

Referring now to FIG. 125, in a further aspect of the disclosure, a dual-track segment is modified to function to support horticulture activities. Horticulture growing segment, designated generally as 840, provides a means to support plant growth within a dual-track segment 10 or any variant of dual-track segments disclosed herein. As shown in FIG. 125, a plurality of plant-receiving bores 844 are formed proximal a top end of dual-track segment 10 and spaced to permit plant growth. Plants 846 have their stems and any root base inserted into plant-receiving bores 844 and secured into a plant-support growth matrix 842 set in the dual channels formed by the dual track segment. Growth matrix 842 contains the nutrients (such as phosphorus and nitrogen) and water necessary to support plant growth and propagation. In an alternative embodiment, the ends of dual-track segment 10 can be closed to permit a liquid-based growth matrix to be placed in the enclosed channels to enable the dual-track segment to function as a hydroponic system.

Figures 119, 120:
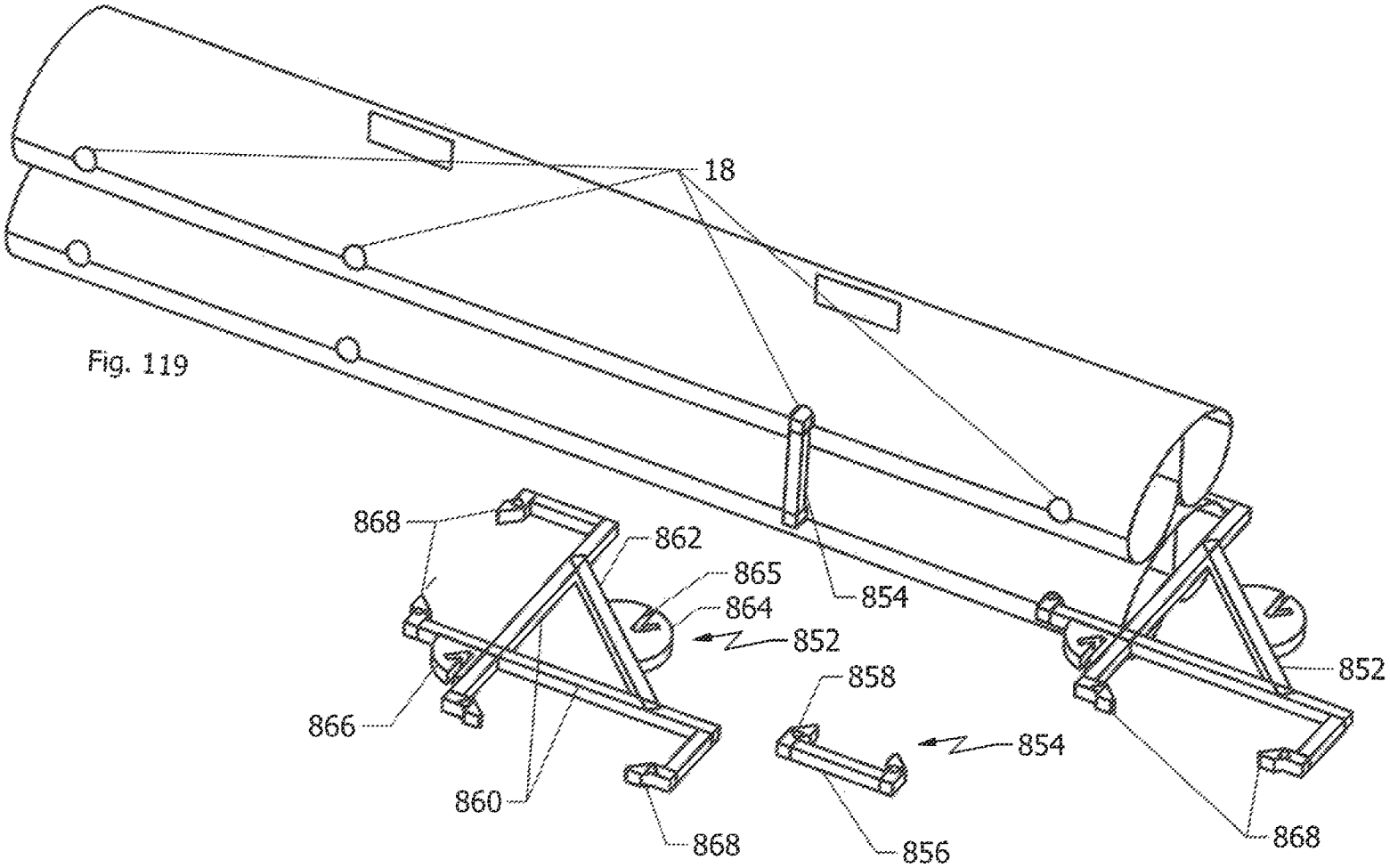
FIG. 119 is a side, top perspective view of a multi-tube corner connection according to another embodiment of the disclosure.
FIG. 120 is a top view of a corner connection element according to the embodiment of the disclosure shown in FIG. 119.

Referring now to FIGS. 119 and 120, in still another aspect of the disclosure, a corner connection set, designated generally as 850, includes a corner connection bracket, designated generally as 852, and a segment clip, designated generally as 854. Segment clip 854 includes a segment clip main shaft 856 and to barb-like clip tines 858 each extending from an end of main shaft 856 in substantially the same direction in substantially the same plane. Clip tines 858 are dimensioned for insertion into segment-connection through-bores 18. Each tine is secured within a segment-connection through-bore 18 of a first dual-track segment 10 vertically aligned with a segment-connection through-bore 18 of a second dual-track segment 10 stacked onto the first dual-track segment 10. Due to the barb-like features of the clip tine ends, the clip tines mechanically engage the portion of the dual-track segments that define the segment-connection through-bores 18. In this manner, multiple dual-track segments can be stacked vertically.

Connection bracket 852 provides a means to create a corner with two dual-track segments 10 that does not permit a spherical object in the segments to traverse the corner. Connection bracket 852 has two cross beams 860 that intersect and extend beyond the intersection in two directions. Each end of each cross beam 860 is formed with a bracket tine 868 extending substantially orthogonally from the axis of the cross beam. The bracket tines 868 of each cross beam extend in opposite directions but substantially on the same plane as the cross beams 860. In this configuration, each bracket tine is opposed to a bracket tine of the other cross beam. The spacing between opposed bracket tines is set to permit each bracket tine pair to be inserted into segment-connection through-bores 18 positioned on opposite sides of, and proximal an end of, a dual-track segment 10. This results in each end of connection bracket 852 being secured to the end of a dual-track segment as shown in FIG. 119.

The point of intersection of cross beams 860 creates an asymmetry in the lengths of the cross beams on either side of the intersection. To strengthen and support the longer lengths of the cross beams of connection bracket 852, a bracket gusset 862 is secured across the open side of the intersected cross beams 860. To further add structural strength to the configuration, a bracket wedge 866 is formed between the smaller lengths of the cross beams. To facilitate digital manipulation of connection bracket 852, a finger tab 864 is formed on bracket gusset 862 that provides a free surface to grasp to secure the connection bracket to dual-track segments. A slot 865 in finger tab 864 provides a position for the suspension elevation support 406 (not shown) to engage with the connection bracket 852. It should be understood that the use of connection bracket 852 is purely to create an angular connection between dual-track segments and not to function as a turn that can be negotiated by a spherical object. As shown, the angle of the connection is approximately 90°. It should be understood that the angle of the connection can be varied by varying the angle of the cross-beam intersection.

V. Track Assemblies

Figure 97:
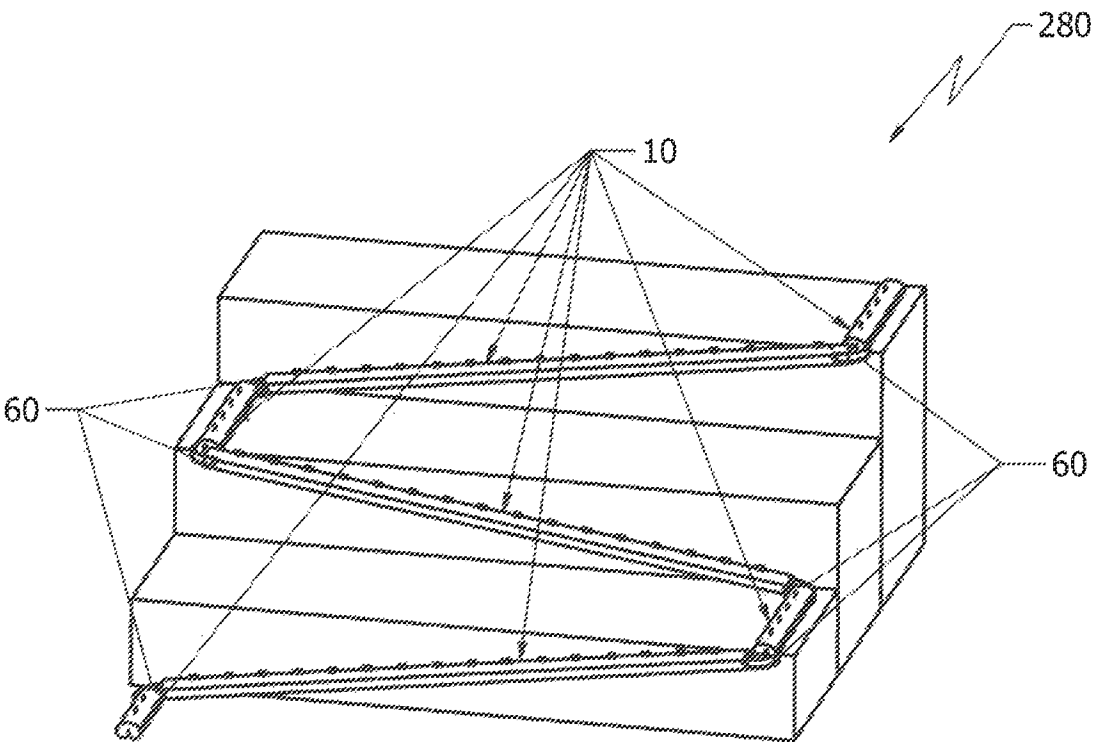
FIG. 97 is a spherical object race track assembly according to one embodiment of the disclosure.

Having described all the components of the disclosed marble racing game, referring now to FIG. 97, a racing track assembly, designated generally as 280, is constructed from a variety of the track segments and connectors disclosed herein. As shown, track assembly 280 is constructed from a series of dual-track segments 10 and curve connectors 60. In this illustrative iteration of a racing track assembly, the spherical objects are placed at the top of the run on the top stair and travel along the race track until emerging at the end of the run at the bottom stair landing. It should be understood that the race track assembly shown in FIG. 97 is purely illustrative in purpose. Any combination of any of the track, connector and specialty accessory components are within the scope and spirit of the disclosure.

Referring now to FIG. 98, in another aspect of the disclosure, a race track assembly, designated generally as 290, uses wall mount components along with various dual-track segments, connectors and specialty accessories to construct a gravity-driven racing game. FIG. 98 is a partial view and does not show any vertical connections between the two different elevations of track. The partial sections of track assembly 290 shown are constructed from a series of dual-track segments 10, curve connectors 60, elevation supports 282 and wall mounts 294. To construct the straight runs, a plurality of dual-track segments 10 are secured together as disclosed herein.

Curve connectors 60 connect each pair of angularly-offset straight track sections to form a continuous race track. To create a continuous grade for the straight segments, elevation supports 282 are secured to wall mounts 294 at incrementally decreasing elevations along the length of a straight track section to set the grade and allow gravity to urge the spherical objects along the race track. In this illustrative iteration of a racing track assembly, like the race track assembly shown in FIG. 97, the spherical objects are placed at the top of the run (not shown) and travel along the race track until emerging at the end of the run shown with a curve connector 60. Like the race track assembly shown in FIG. 97, it should be understood that the race track assembly shown in FIG. 98 is purely illustrative in purpose and should not be considered to limit the scope of the disclosure. Any combination of any of the track, connector and specialty accessory components are within the scope and spirit of the disclosure.

Figure 113:
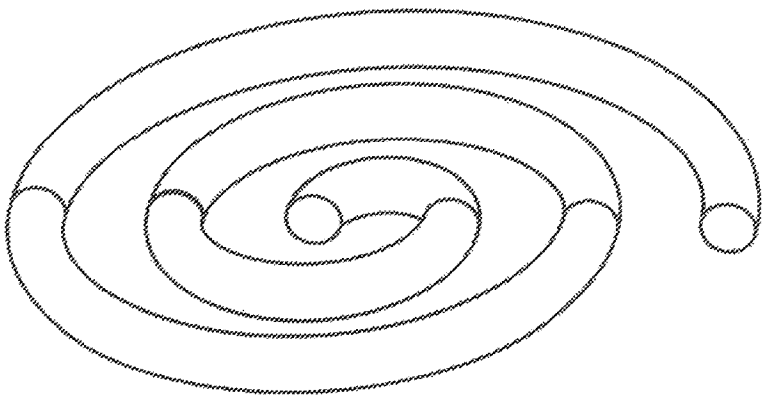
FIG. 113 is a perspective view of the coiled spherical object rack track assembly shown in FIG. 112 without the suspension elevation supports.
Figure 112:
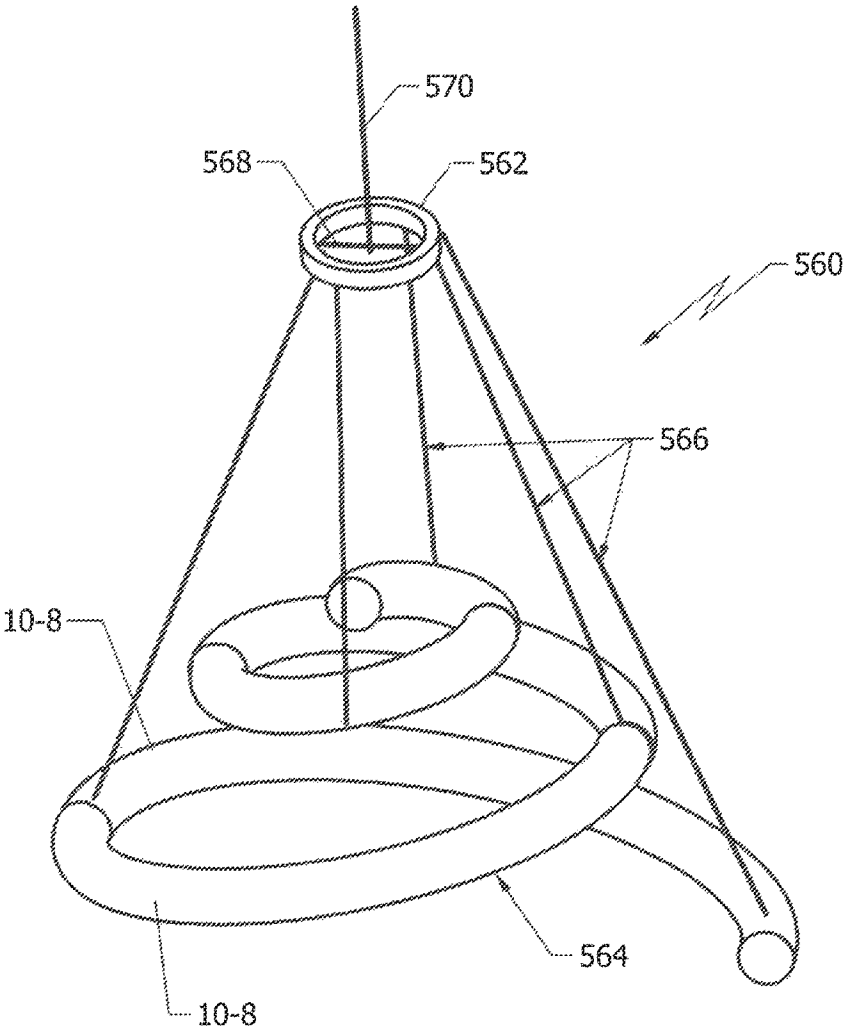
FIG. 112 is a side, perspective view of a coiled spherical object race track assembly suspended from suspension elevation supports according to another embodiment of the disclosure.

Referring now to FIGS. 112 and 113, in another aspect of the disclosure, a suspended track assembly, designated generally as 560, incorporates a suspension ring 562 to suspend a track assembly 564. In this embodiment, track assembly 564 is constructed from a plurality of single-track segments $\mathbf{10}^{VIII}$. Track assembly 564 also may include sections of flexible tubing to construct smooth radiused curves and the like. Any flexible tubing used can be opaque or transparent. It should be understood that suspended track assembly 560 can be constructed from any combination of the track segments and connectors disclosed herein. As shown, the plurality of single-track segments $\mathbf{10}^{VIII}$ are formed into a helical pattern to create a single descending track assembly. A plurality of suspension lines are secured to suspension ring 562 at one end and to a single-track segment $\mathbf{10}^{VIII}$ as a second end to support the helically-shaped track assembly. A crossbar 568 may be secured across a diameter of suspension ring 562. A ring suspension line 570 is secured to crossbar 568 at one end and to an elevated surface, such as a ceiling, at a second end to suspend the ring and enable the track assembly to be suspended.

Figure 114:
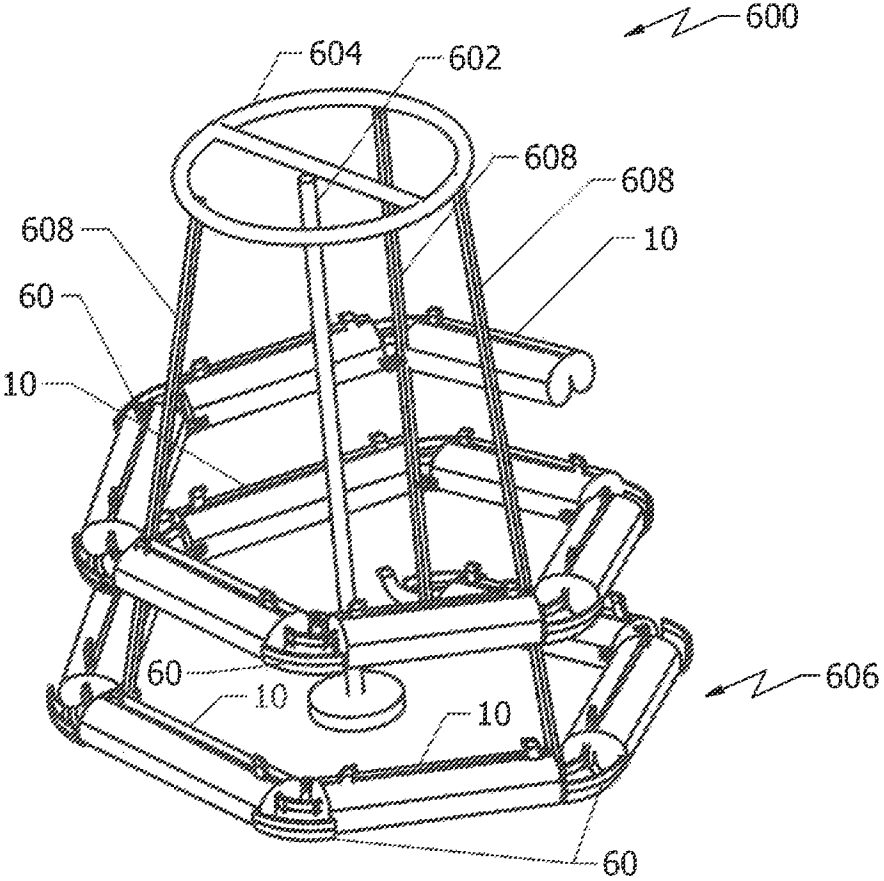
FIG. 114 is a side perspective view of a spherical object rack track assembly with a central support post formed as a Christmas tree suspended from suspension elevation supports according to yet another embodiment of the disclosure.

Referring now to FIG. 114, in still another aspect of the disclosure, a suspended track assembly, designated generally as 600, incorporates a center pole 602 in combination with a suspension ring 604 to suspend a track assembly 606 in a helical pattern to mimic the overall shape of a Christmas tree. Suspension ring 604 is secured proximal a top end of center pole 602. A plurality of suspension lines or elevation supports 608 are secured at one end to suspension ring 604 and at a second end at a section of a dual-track segment 10 or a curve connector 60. In the illustrative configuration shown, track assembly 606 is constructed from a plurality of dual-track segments 10 and curve connectors 60. The assembled track is then placed in a helical pattern to mimic triangular shape of a Christmas tree. It should be understood that any combination of the track segments and connectors disclosed herein may be used to construct track assembly 606 and remain with the scope of the disclosure.

Figure 115:
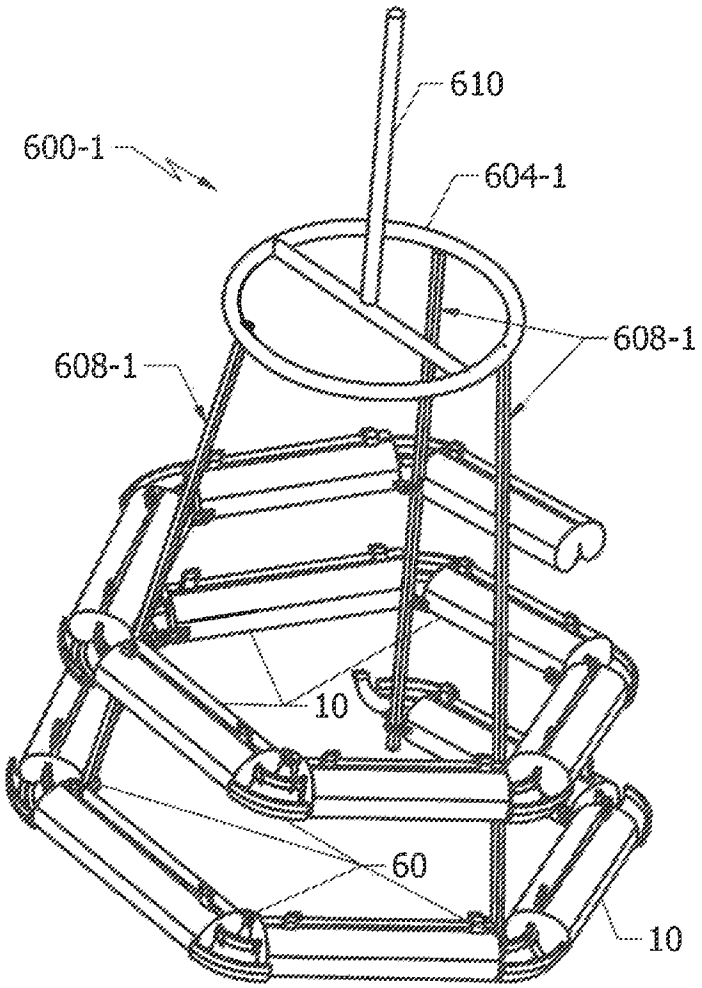
FIG. 115 is a side perspective view of a spherical object rack track assembly with a central suspension post formed as a Christmas tree suspended from suspension elevation supports secured to the central suspension post according to still another embodiment of the disclosure.

Referring now to FIG. 115, in still another aspect of the disclosure, a suspended track assembly, designated generally as 600', is a modified embodiment of track assembly 600 without a center support pole. In this embodiment, a suspension ring or suspension bar (shown) 604' is used. A vertically-oriented suspension beam or line 610 is secured to suspension bar 604' at one end and to an elevated surface, such as a ceiling, at a second end. This combination is used to suspend a track assembly 606' in a helical pattern to mimic the overall shape of a Christmas tree. A plurality of suspension lines or elevation supports 608' are secured at one end to suspension bar 604' and at a second end at a section of a dual-track segment 10. In the illustrative configuration shown, track assembly 606' is constructed from a plurality of dual-track segments 10 and curve connectors 60. The assembled track is then placed in a helical pattern to mimic triangular shape of a Christmas tree. It should be understood that any combination of the track segments and connectors disclosed herein may be used to construct track assembly 606' and remain with the scope of the disclosure.

Figure 116:
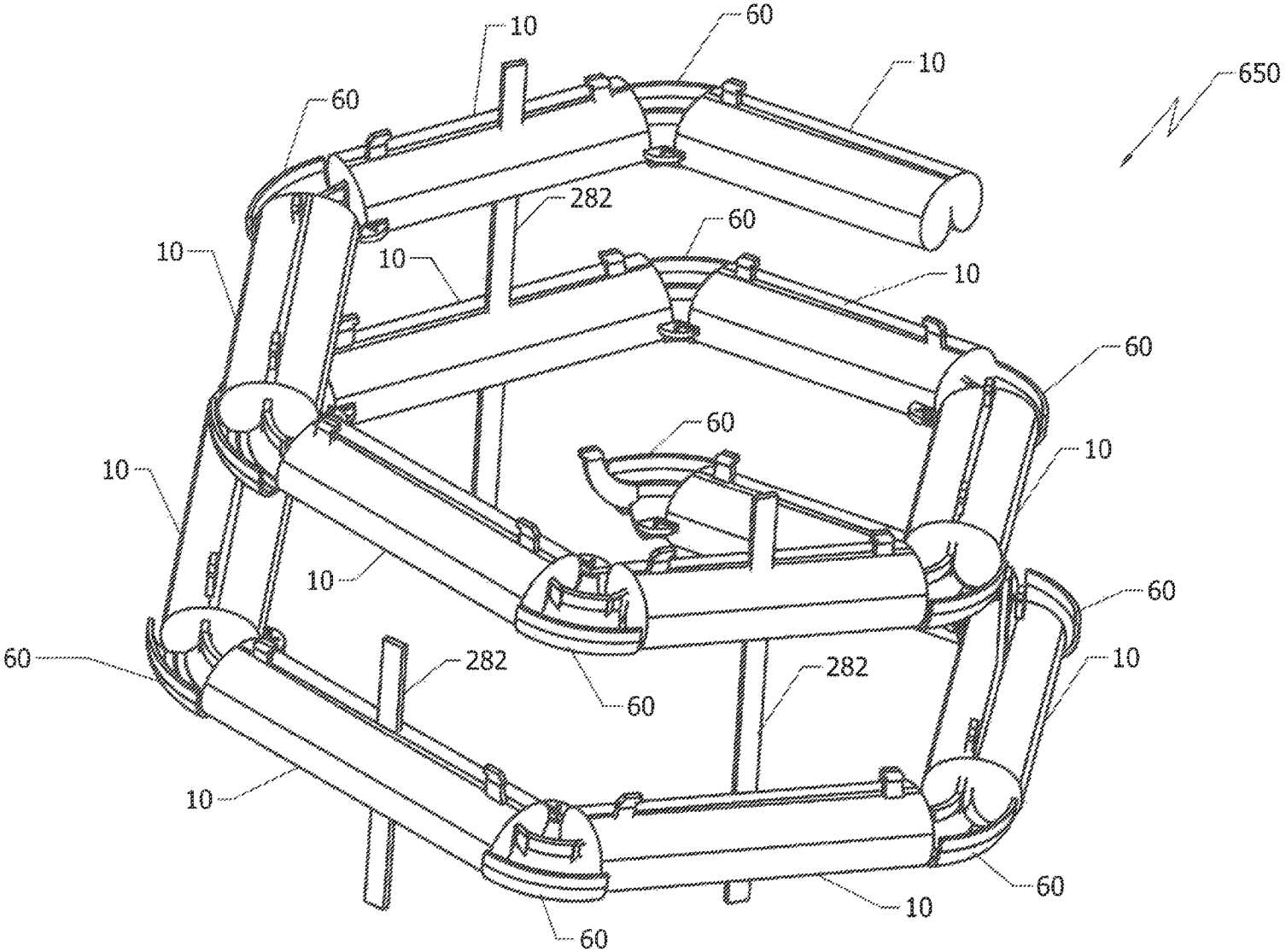
FIG. 116 is a spherical object rack track assembly formed as a Christmas tree with vertical elevation supports according to yet another embodiment of the disclosure.

Referring now to FIG. 116, in a further aspect of the disclosure, a track assembly, designated generally as 650, is configured using different length elevation supports 282 to create an elevated helical pattern to mimic the profile of a Christmas tree. As shown, a plurality of dual-track segments 10 and curve connectors 60 are used to construct track assembly 650. By incrementally increasing the lengths of successive elevation supports 282, a Christmas-tree like pattern is formed. It should be understood that any combination of the track segments and connectors disclosed herein may be used to construct track assembly 650 and remain with the scope of the disclosure.

Figure 117:
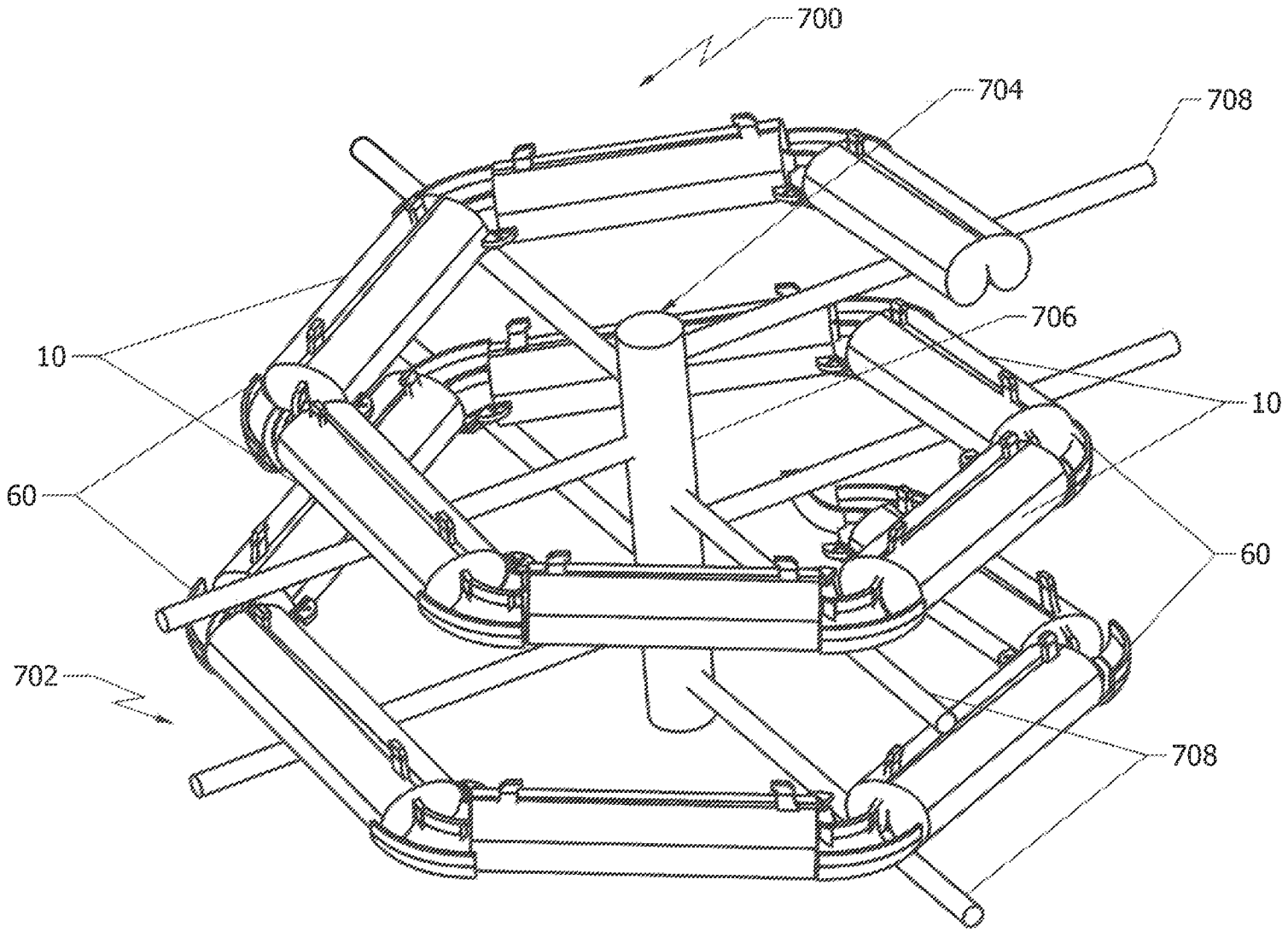
FIG. 117 is a side, perspective view of an artificial Christmas tree with a spherical object race track assembly secured to the ascending levels of artificial tree branches according to still another embodiment of the disclosure.

Referring now to FIG. 117, in a still further aspect of the disclosure, a track assembly/artificial Christmas tree combination, designated generally as 700, includes a track assembly, designated generally as 702, intertwined with the branches of an artificial Christmas tree, designated generally as 704. In an alternative embodiment, live cut trees may be used as well to create track assembly/Christmas tree combination 700. Christmas tree 704 includes a central pole or branch 706. A series of artificial branches 708 are attached to pole 706 at various vertical points along the pole. Successively higher branches 708 are formed with diminishing diameters or lengths to mimic the triangular profile of a natural Christmas tree. In this embodiment, track assembly 702 is constructed from a plurality of dual-track segments 10 and curve connectors 60. The track assembly is configured in a helical pattern and is placed on the plurality of artificial branches 708 that function as structural supports for the vertically-elevated coils of track assembly 702.

The materials used to construct the various track sections are in sheet form and may be made from Mylar®, polyester or any similar material known in the art. The key feature needed in any material used from the track sections is the ability to be rolled and secured. The material should be resistant to fluids such as water to ensure the integrity of the track sections. The connectors and specialty accessories may be formed from thermoset polymers via injection molding, vacuum forming, 3-D printing and the like. The elevation supports and the binding bars may be formed via extrusion processes as are well known in the art. As with the other track assembly embodiments disclosed herein, it should be understood that any combination of the track segments and connectors disclosed herein may be used to construct track assembly 700 and remain with the scope of the disclosure.

Figure 118:
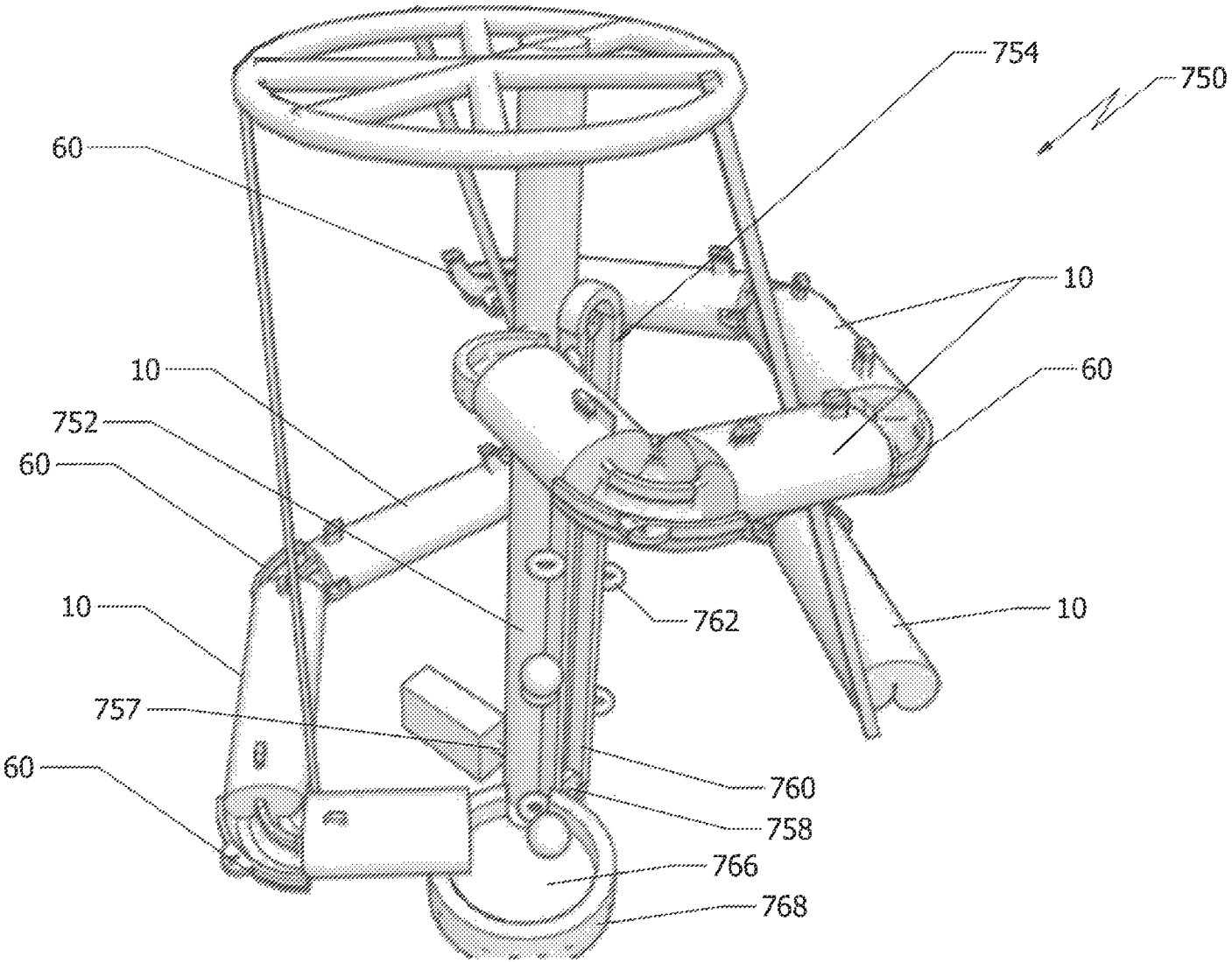
FIG. 118 is a perspective view of a spherical object race track assembly formed as a Christmas tree with a central support post and vertical, spherical-object elevator according to a further embodiment of the disclosure.

Referring now to FIG. 118, in a yet further aspect of the disclosure, a Christmas-tree-shaped track assembly, designated generally as 750, includes an elevator system to repeatedly run spherical objects along the track assembly. Track assembly 750 has a center, vertically-oriented pole support 752 that functions as the main support structure for the track assembly. The pole structure also may not function as the main support structure for the track assembly, in a suspended design such as a ceiling hung Christmas-tree shaped track. A spherical-object elevator, designated generally as 754 provides a means to transfer spherical objects from the track assembly end to the track assembly beginning at the top of the assembly.

Elevator 754 includes a chain or belt 760 secured over at least two geared or tensioned pulleys. A bottom gear or pulley is secured or keyed to a shaft 757 or a motor 756, which is attached to the pole support 752. Motor 756 has an on/off switch to operate the motor. Motor operation turns shaft 757 that, in turn, rotates the bottom gear or pulley to rotate chain or belt 760. A plurality of spherical object support rings 762 are secured to, and spaced apart on, chain or belt 760. Support rings 762 define a hole having a diameter smaller than the diameter of the spherical objects using in the track assembly. An annular feeder plate 766 is positioned adjacent elevator 754 proximal a bottom end of the elevator to supply spherical objects to the elevator. Feeder plate 766 is positioned below an end of track assembly 750 to receive spherical objects exiting the assembly. An annular axially-extending shoulder 768 positioned at the periphery of feeder plate 766 prevents spherical objects on the plate from falling off. A portion of shoulder 768 is cut away to permit spherical objects to fall onto support rings 762 for elevation to the starting point of the track assembly. The spacing between feeder plate 768 and chain or belt 760 is set so that spherical objects passing through the cut-away portion of shoulder 768 will register against chain or belt 760 to freeze the spherical object in place while a support ring 762 travels upwardly and registers against the spherical object.

At a top end of elevator 754, when the support ring/spherical object combination reach the top of the elevator, the spherical object is released for delivery to a first dual-track segment 10 or a race starter connector 500 (not shown). Once loaded onto track assembly 750, the spherical ball(s) travel along a helical course with incrementally elevated coils and formed with a plurality of dual-track segments 10 and curve connectors 60. Like all the other track assemblies disclosed herein, it should be understood that any combination of the track segments and connectors disclosed herein may be used to construct track assembly 750 and remain with the scope of the disclosure.

Figures 128, 129:
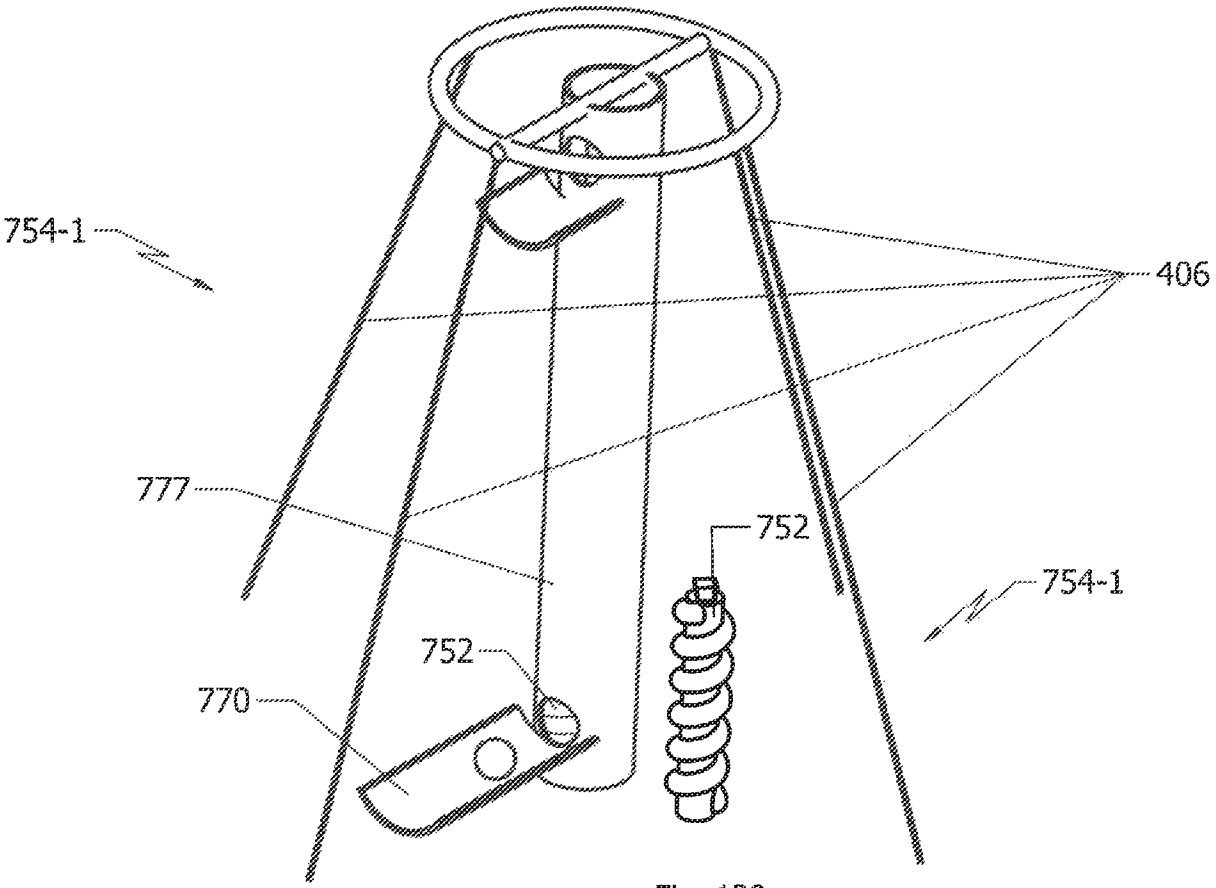

Referring now to FIGS. 128 and 129, in another aspect of the disclosure, a coil elevator system, designated generally as 754', includes many of the structural features of elevator system 754. Unlike elevator system 754, coil elevator system 754' forms a helical pattern around a pole support 752.

A loading ramp 770 is angled to bias movement of spherical objects towards the coil elevator system. As an illustrative embodiment, the coil elevator system enables the transfer of marbles upward inside the pole in a Christmas-tree shaped track system.

While the present disclosure has been described in connection with several embodiments thereof, it will be apparent to those skilled in the art that many changes and modifications may be made without departing from the true spirit and scope of the present disclosure. Accordingly, it is intended by the appended claims to cover all such changes and modifications as come within the true spirit and scope of the disclosure.

What I claim as new and desire to secure by United States Letters Patent is:

1. A sphere racing game comprising:

a sheet having a field defined by lateral edges including a first lateral edge and a second lateral edge, a top edge and a bottom edge;

a plurality of tabs disposed laterally from the lateral edges including a first set of tabs extending from the first lateral edge and a second set of tabs extending from the second lateral edge, wherein each one of the first set of tabs is planar with one of the second set of tabs to form pairs of planar tabs;

a plurality of slots formed in a central portion of the field, wherein each slot has a length dimension, and wherein each slot is oriented planar with one of the pairs of planar tabs; and, a plurality of segment-connection though-bores formed in the field, each proximal to one of the top edge or the bottom edge, wherein the lateral edges are rotated toward the central portion of the field and each tab of a pair of planar tabs is inserted into the slot planar with the pair of planar tabs to form two parallel tunnels that form a dual-track segment having a leading end and a trailing end opposite the leading end.

2. The sphere racing game of claim 1 wherein at least one tab of the plurality of tabs is formed in the shape of a "T" with a cross element of the "T" dimensioned to be larger than the length dimension of at least one of the plurality of slots, wherein insertion of the at least one tab into the at least one of the plurality of slots results in the cross element of the "T" shaped tab to form an interference fit with the at least one slot to releasably secure the at least one tab to the at least one slot to which it is registered against.

3. The sphere racing game of claim 1 further comprising at least one c-shaped track-assembly clamp having opposing ends each formed with clamp pins that extend laterally inwardly, wherein the clamp pins are each dimensioned to fit within one of the plurality of segment-connection though-bores.

4. The sphere racing game of claim 1 wherein the sheet is creased along its length to form multiple sections, wherein engagement of the pairs of planar tabs to the plurality of slots produces dual-track segment having a triangle, square or rectangle cross-sectional shape.

5. The sphere racing game of claim 1 wherein two dual-track segments are connected by inserting the trailing end of a first dual-track segment into the leading end of a second dual-track segment.

6. The sphere racing game of claim 1 further comprising straight dual-track connector comprising:

two semi-circular or rounded base sections arranged in tandem and registered against one another to form a junction;

two pairs of track-receiving tabs, wherein each tab of a pair of tabs extends axially from each end of one of the two semi-circular base sections;

a center support wall extending vertically from the junction;

a pair of side walls, each of the pair of side walls extending vertically from one edge of one of the two semi-circular bases, wherein the pair of side walls are substantially parallel with the center wall;

a pair of track support posts, wherein each of the pair of track support posts extends vertically from an end of the center wall;

a plurality of center support wall locking tabs extending inwardly toward each track tunnel from the center support wall; and, a plurality of side wall locking tabs extending inwardly from each top end of each side wall, wherein at least some of the plurality of center support wall locking tabs and at least some of the plurality of side wall locking tabs and/or at least one of the pair of track supports posts are each secured in a segment-connection through-bore of two dual-track segments to secure the dual-track segments together.

7. The sphere racing game of claim 1 further comprising a curved dual-track connector comprising:

a pair of unequal length, curved base sections including an inner base section and an outer base section, wherein the outer base section is longer than the inner base section with the ends of each base section aligned with the ends of the other base section, and wherein the two curved base sections are connected to form a junction;

two pairs of track-receiving tabs, wherein each tab of a pair of tabs extends axially from each end of one of the two curved base sections;

a curved center support wall extending vertically from the junction;

a pair of curved side walls, each of the pair of curved side walls extending vertically from one edge of one of the two curved semi-circular bases, wherein the pair of curved side walls are substantially parallel with the curved center wall;

three track support posts, wherein two of the track support posts extends vertically from the ends of the curved center wall and the third track support post extends vertically from substantially the center of the curved center wall;

a plurality of curved center support wall locking tabs extending inwardly toward each track tunnel from the curved center support wall; and a plurality of curved side wall locking tabs extending inwardly from each top end of each curved side wall, wherein at least some of the plurality of curved center support wall locking tabs and at least some of the plurality of curved side wall locking tabs and/or at least one of the three track support posts are each secured in a segment-connection through-bore of two dual-track segments to secure the dual-track segments together in an angular orientation.

8. The sphere racing game of claim 7 wherein the curved dual-track connector further comprises an outer curve connector ring extending radially outwardly from an apex of the curve proximal a top edge of an exterior curved sidewall and an inner curve connector ring formed in an angular junction of an interior curved sidewall, wherein each of the connector rings is slotted to receive a suspension elevation support.

9. The sphere racing game of claim 8 further comprising at least one suspension elevation support, wherein the at least one suspension elevation support is secured in the slot of one of the exterior or interior connector rings.

10. The sphere racing game of claim 1 further comprising a straight switch connector comprising:

a first lane-change base section and a second lane-change base section connected to the first lane-change base section, the connection forming a junction, wherein each lane-change base section has counter-curving, opposed-radiused section;

two pairs of track-receiving tabs, wherein each tab of a pair of tabs extends axially from each end of one of the two lane-change base sections;

a discontinuous center support wall extending vertically from the junction;

two switch-connector side walls, wherein each of the two side walls extends vertically from one lateral edge of the counter-curving base sections, wherein the two switch-connector side walls are substantially parallel with the discontinuous center support wall;

a pair of track support posts, wherein each of the support posts extends upwardly from one end of the discontinuous center support wall;

a plurality of center support wall locking tabs extending laterally outwardly from the ends of the discontinuous center support wall; and, a plurality of side wall locking tabs extending inwardly from each top end of each side wall, wherein at least some of the plurality of center support wall locking tabs and at least some of the plurality of side wall locking tabs and/or one of the pair of track support posts are each secured in a segment-connection through-bore of two dual-track segments to secure the dual-track segments together in straight orientation.

11. The sphere racing game of claim 1 further comprising a curve switch connector comprising:

a first lane-change curve base section having a first curve section and a first straight section and a second lane-change curve base section having a second curve section and a second straight section, wherein the second lane-change curve base section is secured to the first lane-change curve base section to form a junction;

two pairs of track-receiving tabs, wherein each tab of a pair of tabs extends axially from each end of one of the two curve lane-change base sections;

a discontinuous curve switch center support wall extending vertically from the junction;

two curve switch-connector side walls, wherein each of the two curve switch side walls extends vertically from one lateral edge of the lane-change curve base sections, wherein the two curve switch side walls are substantially parallel with the discontinuous curve switch center support wall;

a pair of track support posts, wherein each of the support posts extends upwardly from one end of the discontinuous curve switch center support wall;

a plurality of curve switch center support wall locking tabs extending laterally outwardly from the ends of the discontinuous center support wall; and, a plurality of curve switch side wall locking tabs extending inwardly from each top end of each curve switch side wall, wherein at least some of the plurality of curve switch center support wall locking tabs and at least some of the plurality of curve switch side wall locking tabs and/or at least one of the pair of track support posts are each secured in a segment-connection through-bore of two dual-track segments to secure the dual-track segments together in straight orientation.

12. The sphere racing game of claim 1 further comprising a musical ramp connector comprising:

a first track slope and a second track slope separated by a sloped center wall extending upwardly from the two track slopes;

a first sloped musical ramp sidewall extending upwardly from a lateral edge of the first track slope, wherein the first sloped musical ramp sidewall defines the lateral edge of the first track slope;

a second sloped musical ramp sidewall extending upwardly from a lateral edge of the second track slope, wherein the second sloped musical ramp sidewall defines the lateral edge of the second track slope;

a musical bar support platform secured to upper ends of at least the first sloped musical ramp sidewall and the second sloped musical ramp sidewall, wherein the musical bar support platform is formed with two or more slots;

at least one suspension wire secured within at least one of the two or more slots; and, a musical bar secured to the at least one suspension wire and suspended from the musical bar support platform.

13. The sphere racing game of claim 1 further comprising a corner connection set comprising:

a corner connection bracket and a segment clip each secured separately to the dual-track segment, wherein the segment clip includes a segment clip main shaft with clip tines extending from each end of the segment clip main shaft, wherein the clip tines extend in the same direction and in the same plane and are dimensioned to be secured in one of the plurality of segment-connection through-bores, wherein the corner connection bracket includes two intersecting cross beam wherein each cross beam extends beyond the intersection in two directions, wherein each cross beam end is formed with a bracket tine extending substantially orthogonally from an axis of the cross beam, and wherein the bracket tines of each cross beam extend in opposite directions but substantially on the same plane as the cross beams so as to form pairs of opposed bracket tines spaced and each dimensioned to be secured in one of the plurality of connection-segment through-bores.

14. The sphere racing game of claim 1 further comprising at least one elevation support comprising:

an elongated pole or tube; and, an elevation support clamp having a support clamp slot dimensioned to receive and be secured to the elongated pole or tube, wherein the elevation support clamp includes a support clamp base with at least one vertical support post extending downwardly from a bottom surface of support clamp base, wherein the at least one vertical post is dimensioned to be secured in one of the plurality of connection-segment through-bores.

15. The sphere racing game of claim 1 further comprising an ornament curve connector comprising:

a curved inner base section and a curved outer base section connected to the curved inner base section, wherein the connection forms a junction, wherein the curved inner base section is shorter than the curved outer base section to maintain planar alignment of leading and trailing edges of each base section;

a plurality of track-receiving tabs each extending from one of the leading and trailing edges of the base sections;

a center support wall extending upwardly from the junction;

two sidewalls each extending upwardly from one of the lateral edges of the curve connector;

axle supports extending upwardly from each sidewall;

an ornament axle secured in the axle supports so as to permit the free rotation of the ornament axle in the axle supports, at least one strike post extending downwardly from the ornament axle;

an ornament secured to one end of the ornament axle; and, at least one axle stop to prevent the lateral movement of the ornament axle out of the axle supports.

16. The sphere racing game of claim 1 further comprising an open dual-track S-curve secured to the dual-track segment and comprising:

an S-curve base section formed in the shape of an "S", wherein the S-curve base section has portions defining S-curve slots formed along a centerline of the S-curve base section, and wherein a plurality of S-curve tabs extend laterally from side edges of the S-curve base section;

a pair of S-curve sidewall sections, each having portions defining sidewall slots dimensioned to receive and be secured to the plurality of S-curve tabs; and, at least one S-curve center wall formed with a plurality of S-curve center wall tabs extending from a longitudinal edge of the at least one S-curve center wall and dimensioned to be inserted into the S-curve slots to form an open track S-curve dual-track segment.

17. The sphere racing game of claim 16 further comprising a straight dual-track connector and an open track clip attachment comprising:

a straight dual-track connector having two semi-circular or rounded base sections arranged in tandem and registered against one another to form a junction;

at least one pair of track-receiving tabs, wherein each tab of the at least one pair of tabs extends axially from one end of one of the two semi-circular base sections;

a center support wall extending vertically from the junction;

a pair of side walls, each of the pair of side walls extending vertically from one edge of one of the two semi-circular bases, wherein the pair of side walls are substantially parallel with the center wall;

a pair of track support posts, wherein each of the pair of track support posts extends vertically from an end of the center wall;

a plurality of center support wall locking tabs extending inwardly toward each track tunnel from the center support wall;

a plurality of side wall locking tabs extending inwardly and outwardly from each top end of each side wall, wherein at least some of the plurality of center support wall locking tabs and at least some of the plurality of side wall locking tabs and/or at least one of the pair of track support posts are each secured in a segment-connection through-bore of the dual-track segment to secure the dual-track segment to the straight dual-track connector; and, an open track clip attachment having a main longitudinal slot dimensioned to receive the center support wall or one of the sidewalls of the straight dual-track connector, wherein the open track clip attachment further has a partial horizontal slot formed proximal a bottom end and partially defined by a clip extension formed on one side of the open track clip attachment, wherein the partial horizontal slot is dimensioned to receive one of the plurality of outwardly extending side wall locking tabs, and wherein a back registration shoulder is formed on a second side of the open track clip attachment to register against an inwardly extending side wall locking tab.

18. The sphere racing game of claim 1 further comprising:

a plurality of dual-track segments;

a plurality of curve connectors, wherein each of the curve connectors has features to register against and be removably fixed to and between two of the plurality of dual-track segments; and, at least one suspension elevation support or at least one elongate pole disposed through at least one of the plurality of dual-track segment or at least one of the plurality of curve connectors to create a gradient, wherein the combination of the plurality of dual-track segments connected with the plurality of curve connectors and elevated by the at least one suspension elevation support or the at least one elongate pole forms a dual-track sphere racing track.

19. A sphere racing game comprising:

at least two spaced center support cylinders formed from sheets and secured in cylindrical shapes with elongated retaining clips or formed from tubing, wherein each of the two spaced center support cylinders is formed with a plurality of cylinder slots arranged in a continuous descending spiral pattern, wherein the spiral patterns on each of the two center support cylinders is aligned with the other;

a dual-track ramp formed in a figure-8 pattern, wherein the dual-track ramp is formed with a plurality of ramp tabs extending from sides of the dual-track ramp including an inner set of ramp tabs and an outer set of ramp tabs, and further formed with a plurality of ramp slots formed along a centerline of the dual-track ramp, wherein the inner set of the plurality of ramp tabs are aligned with a corresponding member of the plurality of cylinder slots, wherein engagement of the inner set of the plurality of ramp tabs with the plurality of cylinder slots forms a dual-track figure-8 race track;

an outer spiral, figure-8 wall formed from a sheet and having a plurality of outer wall slots spaced to align with the outer set of the plurality of ramp tabs, wherein insertion of the outer set of the plurality of ramp tabs into the plurality of outer walls slots secures the outer spiral, figure-8 wall to the dual-track ramp; and, a figure-8 center wall formed from a sheet and having a plurality of center wall tabs extending from a bottom edge of the center wall spaced to align with the plurality of ramp slots, wherein insertion of the plurality of center walls tabs into the plurality of ramp slots secures the center wall to the dual-track ramp to form two lanes for the dual-track.

20. A sphere racing game comprising:

a single-tunnel, dual-track segment formed from a sheet and a retaining clip, wherein the sheet has a field defined by lateral edges including a first lateral edge and a second lateral edge, a top edge and a bottom edge, wherein the retaining clip has a divider wall extending upwardly and two pairs of tines extending laterally outwardly in opposite directions and substantially orthogonal to a plane of the divider wall, wherein the lateral edges of the sheet are each secured in one of the pair of tines to form a tunnel, wherein the divider wall defines two parallel racing tracks; and, a plurality of segment-connection though-bores formed in the field, each proximal to one of the top edge or the bottom edge of the sheet.

* * * * *